US009360160B2

(12) United States Patent
Kim et al.

(10) Patent No.: US 9,360,160 B2
(45) Date of Patent: Jun. 7, 2016

(54) LIQUEFIED NATURAL GAS STORAGE CONTAINER AND METHOD FOR MANUFACTURING THE SAME

(75) Inventors: Yong Tai Kim, Seoul (KR); Joong Kyoo Kang, Geoje-si (KR); Jung Han Lee, Geoje-si (KR); Seong Woo Park, Busan (KR); Young Bin Kwon, Geoje-si (KR); Jung Sub Shin, Seoul (KR); Kwang Seok Kim, Geoje-si (KR); Haeng Sung Heo, Busan (KR)

(73) Assignee: DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 768 days.

(21) Appl. No.: 13/810,885

(22) PCT Filed: May 14, 2012

(86) PCT No.: PCT/KR2012/003767

§ 371 (c)(1),
(2), (4) Date: Jan. 17, 2013

(87) PCT Pub. No.: WO2012/154015

PCT Pub. Date: Nov. 15, 2012

(65) Prior Publication Data

US 2014/0069931 A1 Mar. 13, 2014

(30) Foreign Application Priority Data

May 12, 2011 (KR) ..... 10-2011-0044529
May 1, 2012 (KR) ..... 10-2012-0045978
May 1, 2012 (KR) ..... 10-2012-0045979
May 7, 2012 (KR) ..... 10-2012-0048232
May 11, 2012 (KR) ..... 10-2012-0050301

(51) Int. Cl.
*F17C 1/12* (2006.01)
*F17C 1/16* (2006.01)
(Continued)

(52) U.S. Cl.
CPC . *F17C 5/02* (2013.01); *F17C 3/025* (2013.01); *F25J 1/005* (2013.01); *F25J 1/0022* (2013.01);
(Continued)

(58) Field of Classification Search
CPC ..... F17C 3/04; F17C 1/08; F17C 1/12; F17C 2203/012; F17C 2209/232; F17C 2221/033; F17C 2223/0161; F17C 2223/035; F17C 2227/0107; F17C 2227/0376; F17C 2227/0383; F17C 2265/034; F17C 5/02; F17C 2260/016; F17C 2270/0105; F17C 2205/0192; F17C 3/025; F17C 2201/0109; F17C 2201/0123; F17C 2201/0138; F17C 2201/032; F17C 2201/035; F17C 2201/052; F17C 2201/054; F17C 2203/015; F17C 2203/018; F17C 223/0329; F17C 2203/0333; F17C 2203/0341; F17C 2203/035; F17C 2203/0629; F17C 2203/0643; F17C 2203/0646; F17C 2203/0648; F17C 2205/0111; F17C 2205/0305; F17C 2265/2265; F17C 2265/05; F17C 2270/0113; F25J 2220/68; F25J 2290/44; F25J 2290/62; F25J 1/0022; F25J 1/005; F25J 1/0212; F25J 1/0254; F25J 1/0263; F25J 1/0265; F25J 1/0272; F25J 2205/20; F25J 2205/24; F25J 2205/84; F25J 2220/66
USPC ..... 220/560.1, 560.05, 560.06, 560.12, 220/592.25, 670
See application file for complete search history.

(56) References Cited

U.S. PATENT DOCUMENTS 3,347,402 A * 10/1967 Forman ..... F17C 13/082 114/74 A
3,719,302 A * 3/1973 Hamilton ..... B63B 25/16 114/74 A
(Continued)

*Primary Examiner* — J. Gregory Pickett
*Assistant Examiner* — Niki M Eloshway
(74) *Attorney, Agent, or Firm* — Knobbe Martens Olson & Bear LLP

(57) ABSTRACT

Provided are an LNG storage container with an inner shell, which is capable of efficiently storing LNG or pressurized LNG (PLNG) pressurized at a predetermined pressure and supplying the LNG or PLNG to a consumption place, and capable of reducing manufacturing costs by minimizing the use of a metal having excellent low temperature characteristic, and a method for manufacturing the same. The LNG storage container includes: an inner shell configured to store LNG inside; an outer shell configured to enclose the outside of the inner shell such that a space is formed between the inner shell and the outer shell; a support installed in the space between the inner shell and the outer shell to support the inner shell and the outer shell; and a heat insulation layer part installed in the space between the inner shell and the outer shell and configured to reduce a heat transfer.

30 Claims, 59 Drawing Sheets

(51) Int. Cl.

| | |
|---|---|
| ***F17C 5/02*** | (2006.01) |
| ***F17C 3/02*** | (2006.01) |
| ***F25J 1/00*** | (2006.01) |
| ***F25J 1/02*** | (2006.01) |
| *F17C 13/00* | (2006.01) |

(52) U.S. Cl.

CPC ..... *F25J 1/0055* (2013.01); *F25J 1/0212* (2013.01); *F25J 1/0254* (2013.01); *F25J 1/0263* (2013.01); *F25J 1/0265* (2013.01); *F25J 1/0272* (2013.01); *F17C 2201/0109* (2013.01); *F17C 2201/0123* (2013.01); *F17C 2201/0138* (2013.01); *F17C 2201/032* (2013.01); *F17C 2201/035* (2013.01); *F17C 2201/052* (2013.01); *F17C 2201/054* (2013.01); *F17C 2203/015* (2013.01); *F17C 2203/018* (2013.01); *F17C 2203/035* (2013.01); *F17C 2203/0329* (2013.01); *F17C 2203/0333* (2013.01); *F17C 2203/0341* (2013.01); *F17C 2203/0629* (2013.01); *F17C 2203/0643* (2013.01); *F17C 2203/0646* (2013.01); *F17C 2203/0648* (2013.01); *F17C 2205/0111* (2013.01); *F17C 2205/0192* (2013.01); *F17C 2205/0305* (2013.01); *F17C 2209/232* (2013.01); *F17C 2221/033* (2013.01); *F17C 2223/0161* (2013.01); *F17C 2223/035* (2013.01); *F17C 2227/0107* (2013.01); *F17C 2227/0376* (2013.01); *F17C 2227/0383* (2013.01); *F17C 2260/016* (2013.01); *F17C 2265/034* (2013.01); *F17C 2265/05* (2013.01); *F17C 2270/0105* (2013.01); *F17C 2270/0113* (2013.01); *F25J 2205/20* (2013.01); *F25J 2205/24* (2013.01); *F25J 2205/84* (2013.01); *F25J 2220/66* (2013.01); *F25J 2220/68* (2013.01); *F25J 2290/44* (2013.01); *F25J 2290/62* (2013.01)

(56) References Cited

U.S. PATENT DOCUMENTS

| | | | | | |
|---|---|---|---|---|---|
| 3,839,981 | A * | 10/1974 | Gilles | B63B 25/16 | 114/74 A |
| 3,990,382 | A * | 11/1976 | Lootvoet | B63B 25/16 | 114/74 A |
| 4,170,952 | A * | 10/1979 | McCown | B63B 25/16 | 114/74 A |
| 5,464,116 | A * | 11/1995 | Aoki | F17C 3/025 | 220/4.13 |
| 5,501,359 | A * | 3/1996 | Chauvin | B63B 25/16 | 220/560.12 |
| 5,924,656 | A * | 7/1999 | Okada | F16L 3/00 | 138/106 |
| 6,106,449 | A * | 8/2000 | Wynne | B29C 44/1266 | 493/101 |
| 7,900,794 | B2 * | 3/2011 | Dhellemmes | B63B 25/16 | 114/74 A |
| 8,272,530 | B2 * | 9/2012 | Rebernik | F17C 3/08 | 220/560.05 |

* cited by examiner (a)

(b)

(c)

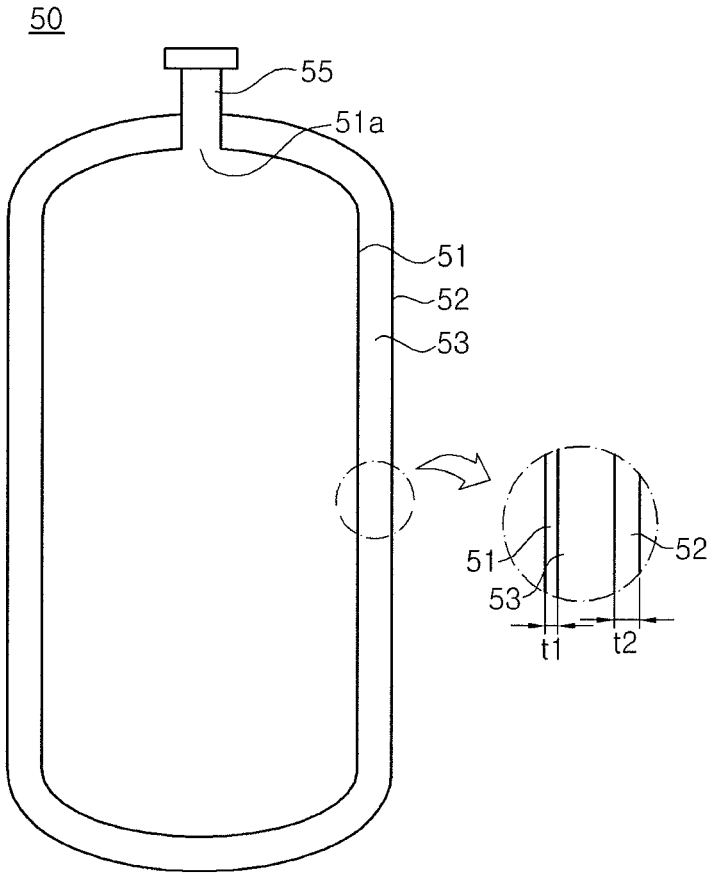
Fig. 11
Fig. 12
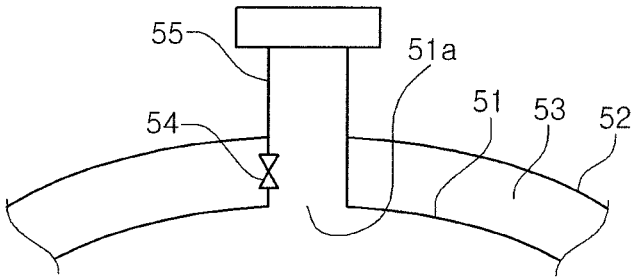

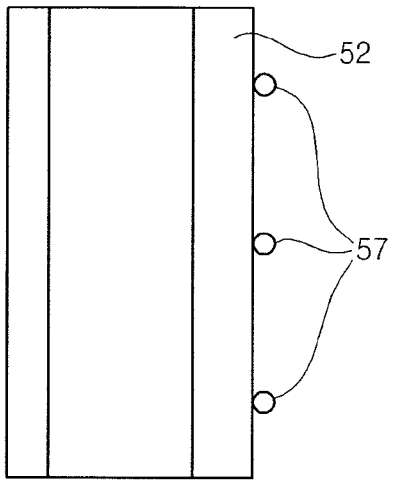
Fig. 15
Fig. 16
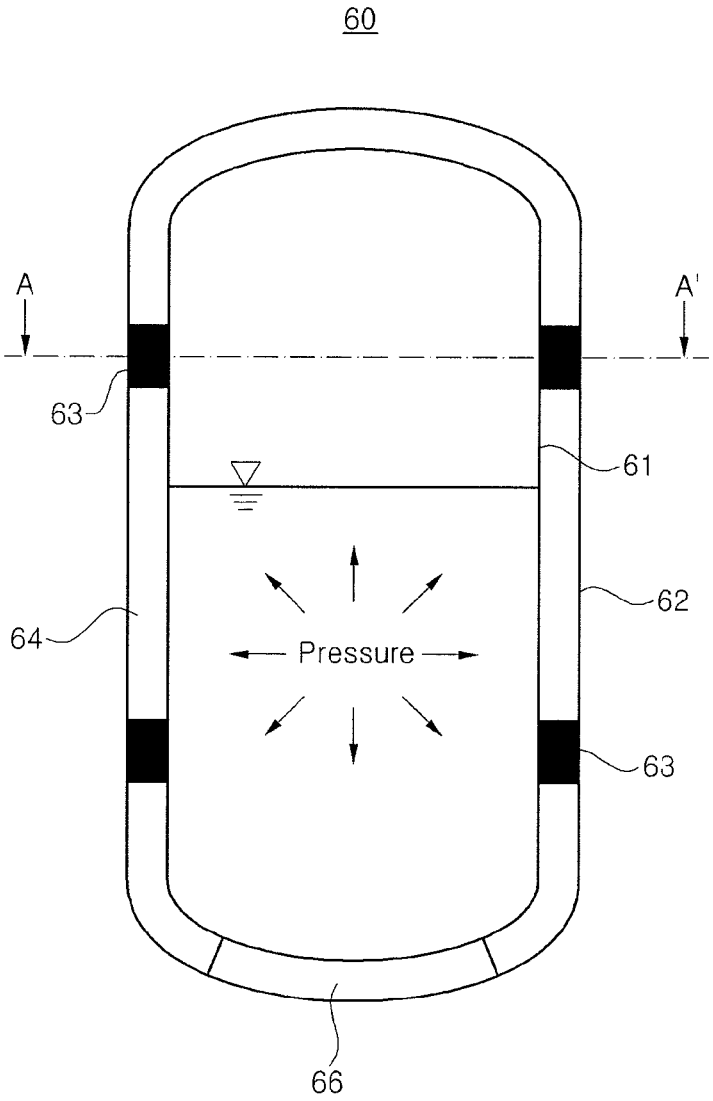

(a)

(b)

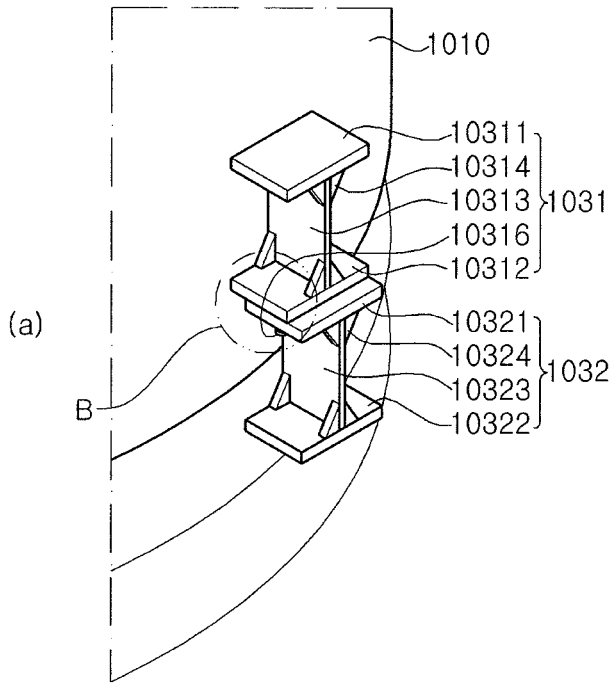
Fig. 55
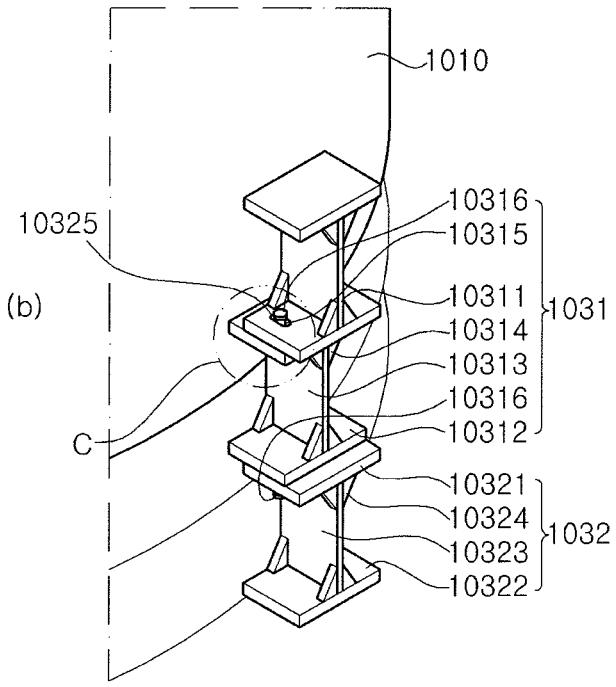

(a)

(b)

LIQUEFIED NATURAL GAS STORAGE CONTAINER AND METHOD FOR MANUFACTURING THE SAME

BACKGROUND OF THE INVENTION

1. Field of the Invention

The present invention relates to a liquefied natural gas (LNG) storage container and a method for manufacturing the same, and more particularly, to an LNG storage container, which is capable of efficiently storing LNG or pressurized LNG (PLNG) pressurized at a predetermined pressure and supplying the LNG or PLNG to a consumption place, capable of reducing manufacturing costs by minimizing the use of a metal having excellent low temperature characteristic, and has an inner shell having high-efficiency heat insulation performance, and a method for manufacturing the same.

2. Description of the Related Art

In general, liquefied natural gas (LNG) is a cryogenic liquid produced by cooling natural gas (predominantly methane) to a cryogenic state of −162° C. at atmospheric pressure. The LNG takes up about 1/600th the volume of natural gas. The LNG is colorless and transparent. It has been known that the LNG is cost-efficient in terms of a long-distance transportation because of high transportation efficiency as compared to a gaseous state.

Since a large amount of cost is spent in the construction of production plants and the building of carriers, the LNG has been applied to a large-scale long-distance transportation in order for cost reduction. On the other hand, it has been known that a pipeline or compressed natural gas (CNG) is cost-efficient in terms of small-scale short-distance transportation. However, the transportation using the pipeline may have geographical restrictions and cause environmental pollution, and the CNG has low transportation efficiency.

A conventional method for distributing LNG to consumption places requires high costs and has difficulty in flexibly responding to various demands of consumption places. Also, since it is necessary to provide separate storage tanks at the consumption places, high infrastructure costs are needed and a lot of time and effort to unload LNG are needed.

In addition, natural gas has a liquefaction point of −163° C. at atmospheric pressure. If a predetermined pressure is applied, the liquefaction point of the natural gas further increases than at the atmospheric pressure. This characteristic may reduce processing steps in a liquefaction process, such as acid gas removal and natural gas liquid (NGL) fractionation. This leads to a reduction in facilities and facility capacity. Therefore, the LNG production costs may be reduced.

However, a conventional LNG storage tank installed in a vessel having a gasification facility or an LNG terminal has a limitation in size. In addition, it is unsuitable for cost-efficient storage of LNG while reflecting the above-described LNG characteristic. It is difficult to easily transport LNG to consumption places according to consumer's various demands.

In order to solve the above problems, a container for storing general LNG or PLNG may be made of a metal having excellent low temperature characteristic in order to withstand a high pressure and a cryogenic temperature of −120° C. or below. To this end, the thickness of the wall of the storage container is inevitably increased. Furthermore, since an expensive metal having excellent low temperature characteristic is used, it is difficult to ensure economic feasibility.

SUMMARY OF THE INVENTION

An aspect of the present invention is directed to provide a structure of an LNG storage container, which can efficiently store LNG or PLNG and supply the LNG or PLNG to a consumption place, can reduce manufacturing costs by minimizing the use of a metal having excellent low temperature characteristic, can easily satisfy various purposes and consumer's demands, and can ensure diversity in types and sizes of container carriers.

Another aspect of the present invention is directed to provide a structure of an LNG storage container, which can maintain heat insulation performance even when LNG leaks out, and can reduce a material cost of a heat insulator.

According to an embodiment of the present invention, an LNG storage container includes: an inner shell (910) configured to store LNG inside; an outer shell (920) configured to enclose the outside of the inner shell (910) such that a space is formed between the inner shell (910) and the outer shell (920); a support (930) installed in the space between the inner shell (910) and the outer shell (920) to support the inner shell (910) and the outer shell (920); and a heat insulation layer part (940) installed in the space between the inner shell (910) and the outer shell (920) and configured to reduce a heat transfer.

The inner shell (910) may have a corrugated structure (950).

The inner shell (910) may have a cylindrical structure.

The corrugated structure (950) may include one or more corrugations (951), each of which includes one or more curved portions (952).

Each of the curved portions (952) may include one or more of an angled edge curved portion (9521), a rounded edge curved portion (9522), and a wave-shaped curved portion (9523).

The support (1030) may include an internal support (1031) connected to the inner shell (1010), and an external support (1032) connected to the outer shell (1020). A sliding bar (10315) may be formed in one of the internal support (1031) and the external support (1032). A sliding hole (10325) may be formed in the other thereof such that the sliding bar (10315) is slidably inserted into and connected to the sliding hole (10325).

The sliding bar (10315) may be formed to protrude outward from one of the internal support (1031) and the external support (1032). The sliding hole (10325) may be formed in the other of the internal support (1031) and the external support (1032). The sliding bar (10315) may be inserted into the sliding hole (10325) and be slidable in a horizontal direction.

The sliding bar (10315) may have a sliding head (10316) at an end portion, the sliding head (10316) being larger than a width of the sliding hole (10325).

The support (1030) may include one or more internal supports (1031) and external supports (1032) alternately arranged, and a lowermost external support (1032) at a lowermost side thereof.

The internal support (1031) and the external support (1032) may include upper flanges (10311, 10321) and lower flanges (10312, 10322) on both sides thereof, and webs (10313, 10323) connecting the upper flanges (10311, 10321) and the lower flanges (10312, 10322).

A sliding hole (10325) may be formed in the upper flange (10321) of the lowermost external support (1032), and a sliding bar (10315) may be formed in the lower flange (10312) of the lowermost internal support (1031) disposed on the top of the lowermost external support (1032).

The internal support (1031) may be made of a metal that withstands a low temperature. The external support (1032) may be made of a reinforced plastic. The external support may be connected to a connection plate (10326), which is made of a metal withstanding a low temperature, by a connecting part (10327). The connection plate (10326) may be welded to the outer shell (1020) so that the external support (1032) is connected to the outer shell (1020).

The support (1030) may be provided in plurality around lateral circumferences of the inner shell (1010) and the outer shell (1020) at predetermined intervals in a vertical direction. A lower support (1033) may be further provided in a lower space between the inner shell (1010) and the outer shell (1020) such that the inner shell (1010) is supported to the outer shell (1020).

The LNG storage container may further include an equalizing line (1090) connecting an inner space of the inner shell (1010) and a space between the inner shell (1010) and the outer shell (1020).

The equalizing line (1090) may protrude from the inner space of the inner shell (1010) to the outside of the storage container (1000) and be connected to the space between the inner shell (1010) and the outer shell (1020).

One end of the equalizing line may communicate with the inside of the inner shell. The other end of the equalizing line may communicate with the space between the inner shell and the outer shell. The other end of the equalizing line may be located at a ½ position of a width (h) of the space.

The equalizing line may be made of a metal that withstands a low temperature of the LNG.

An equalizing line flange (519) may be formed in the outer shell side contacting the equalizing line protruding to the outside of the storage container, such that the equalizing line flange (519) is connected to the equalizing line, and the equalizing line flange (519) and the equalizing line may be made of a metal that withstands a low temperature of the LNG.

The LNG storage container may further include a first exhaust line (1085) connected to the upper internal space of the inner shell (1010) and extends outward. A first exhaust valve (1086) may be installed in the first exhaust line (1085).

The LNG storage container may further include first and second connecting parts (1080, 1081) connected to the upper internal space of the inner shell (1010) and extending outward. The first and second connecting parts (1080, 1081) may be connected to a loading line (7) and an unloading line (8), respectively.

The equalizing line (1090) may be provided with an on/off valve (1091) for opening/closing a liquid flow.

The equalizing line (1090) may be connected to a second exhaust line (1095) in which the second exhaust valve (1096) is installed.

A first heat insulation layer (1041) made of an open cell heat insulator may be formed in the inner shell (1010) side of the heat insulation layer part (1040), and a second heat insulation layer (1042) made of a closed cell heat insulator may be formed in the outer shell (1020) side.

A passage (1043) allowing a liquid to flow along a wall surface of the inner shell (1010) may be formed in the inner shell (1010) side of the heat insulation layer part (1040), and a heat insulation layer (1044) may be formed in the outer shell (1020) side.

The inner shell may be made of a metal that withstands a low temperature of the LNG, and the outer shell may be made of a steel that withstands internal pressure.

The inner shell may withstand a temperature of −120 to −95° C., and the outer shell may withstand a pressure of 13 to 25 bar.

The inner shell may withstand a pressure of 0.5 bar.

According to another embodiment of the present invention, an LNG storage container includes: an inner shell (1010) configured to store LNG inside; an outer shell (1020) installed in the outside of the inner shell to enclose the outside of the inner shell (1010), such that a space is formed between the inner shell (1010) and the outer shell (1020); a support (1030) installed in the space between the inner shell (1010) and the outer shell (1020) to support the inner shell (1010); and a heat insulation layer part (1040) including two or more laminated heat insulation layers in the space between the inner shell (1010) and the outer shell (1020) so as to reduce a heat transfer, wherein the heat insulation layer installed in a contact surface with the outer shell (1020) among the two or more heat insulation layers is higher in density than the heat insulation layer installed in the inner shell (1010) side.

Among the two or more heat insulation layers, the heat insulation layer installed in the contact surface with the outer shell (1020) may be made of a closed cell heat insulator, and the heat insulation layer installed in the inner shell (1010) side may be made of an open cell heat insulator.

According to another embodiment of the present invention, a method for manufacturing an LNG storage container includes: making an outer shell (1020) of the storage container; installing a closed cell in the inside of the outer shell (1020); forming a corrugated structure (1050) in an inner shell (1010) of the storage container; inserting the inner shell (1010) having the corrugated structure into the inside of the outer shell (1020); installing a support (1030) in a space between the inner shell (1010) and the outer shell (1020) such that the inner shell (1010) is supported to the outer shell (1020); and filling an open cell heat insulator into the space between the inner shell (1010) and the outer shell (1020).

According to another embodiment of the present invention, an LNG storage container includes: an inner shell (1010) configured to store LNG inside; an outer shell (1020) installed in the outside of the inner shell to enclose the outside of the inner shell (1010), such that a space is formed between the inner shell (1010) and the outer shell (1020); a support (1030) installed in the space between the inner shell (1010) and the outer shell (1020) such that the inner shell (1010) is supported to the outer shell (1020); and a heat insulation layer part (1040) including heat insulation layers in the space between the inner shell (1010) and the outer shell (1020) so as to reduce a heat transfer, wherein the heat insulation layer part (1040) includes a passage (1043) configured to allow a liquid to flow through, and a heat insulation layer (1044) made of a heat insulator.

The heat insulation layer (1044) may be provided with two or more heat insulator blocks (10441) installed at regular intervals in a vertical direction, and reinforced heat insulators (10442) may be installed between the respective heat insulator blocks (10441).

The reinforced heat insulators (10442) may be filled between the respective heat insulator blocks (10441) by injection molding.

A reinforced heat insulator groove (10443) may be formed in the inner shell (1010) side of the reinforced heat insulator (10442).

The heat insulator block (10441) may be provided with two or more laminated heat insulators.

Among the two or more heat insulators, the heat insulator installed in the contact surface with the outer shell (1020) may be higher in density than the heat insulator installed in the inner shell (1010) side.

The heat insulator installed in the contact surface with the outer shell (1020) may be a closed cell heat insulator.

BRIEF DESCRIPTION OF THE DRAWINGS

FIG. 11 is a sectional view showing an LNG storage container according to a first embodiment of the present invention.

FIG. 12 is a sectional view showing another example of a connecting part of the LNG storage container according to the first embodiment of the present invention.

FIG. 15 is a partial sectional view showing an LNG storage container according to a third embodiment of the present invention.

FIG. 16 is a sectional view showing an LNG storage container according to a fourth embodiment of the present invention.

FIG. 55 is an enlarged view of a portion A of FIG. 54, showing various types of supports.

FIG. 56(*a*) is an enlarged view of a portion B, and FIG. 56(*b*) is an enlarged view of a portion C.

FIG. 57(*a*) is a diagram when viewing the external support in a radial direction of the storage container, and FIG. 57(*b*) is a side view of FIG. 57(*a*).

DESCRIPTION OF REFERENCE NUMERALS

Figure 1:
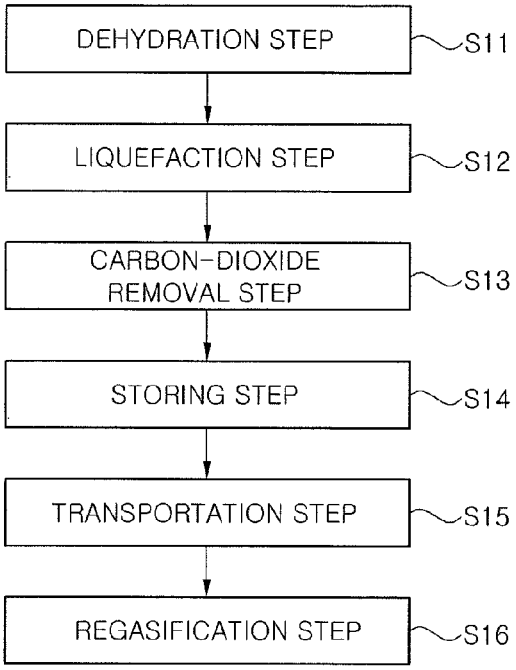
FIG. 1 is a flow diagram showing a PLNG producing method according to the present invention.

| | |
|---|---|
| 1: natural gas field | 2: vessel |
| 3: place of consumption | 3a: consumer |
| 4: valve | 5: quay |
| 6: storage tank | 7: loading line |
| 7a: valve | 8: unloading line |
| 8a: valve | 9a: external injection part |
| 10: PLNG production system | 11: dehydration facility |
| 12: liquefaction facility | 13: carbon-dioxide removal facility |
| 14: storage facility | 21: storage container |
| 21a: nozzle | 22: container assembly |
| 22a: integral nozzle | 23: regasification system |
| 30: LNG storage tank | 31: main body |
| 31a: spacer | 31b: support |
| 32: storage container | 33: loading/unloading line |
| 33a, 33b: loading/unloading valve | 34: BOG line |
| 34a, 34b: BOG valves | 35: pressure sensing unit |
| 36: controlling unit | 36a: manipulating unit |
| 37: displaying unit | 38: heating unit |
| 38a: heat exchanger | 38b: electric heater |
| 39: heating value adjusting unit | 41: bypass line |
| 41a: bypass valve | 42: temperature sensing unit |
| 50: storage container | 51: inner shell |
| 51a: inlet/outlet port | 52: outer shell |
| 53: heat insulation layer part | 54: connection passage |
| 55: connecting part | 56: external heat insulation layer |
| 57: heating member | 60, 70: storage container |
| 61: inner shell | 62: outer shell |
| 63: support | 63a: first flange |
| 63b: second flange | 63c: first web |
| 64: heat insulation layer part | 65: heat insulation member |
| 66: lower support | 80, 90: storage container |
| 81: inner shell | 82: outer shell |
| 83: metal core | 83a: support point |
| 84: heat insulation layer part | 86: lower support |
| 100: storage container | 95: inner shell |
| 120: outer shell | 130: heat insulation layer part |
| 140, 150, 160, 170: connecting part | 141, 151, 161,: injection part |
| 142, 152, 162, 172: first flange | 143: extension part |
| 144, 174: second flange | 163: coupling member |
| 163a: coupling part | 181, 183: bolt |
| 182: nut | 200: PLNG production apparatus |
| 210: coolant supply unit | 211: coolant line |
| 220: supply line | 221: first branch line |
| 230: heat exchanger | 240: recycling unit |
| 241: recycled liquid supply part | 242: recycled liquid line |
| 243: first valve | 244: second valve |
| 250: sensing unit | 260: controlling unit |
| 270: third valve | |
| 300: floating structure having storage tank carrying apparatus | |
| 310: storage tank carrying apparatus | 311: elevating unit |
| 311a: loading table | 311b: movable foothold |
| 311c: hinge coupling part | 311d: auxiliary rail |
| 312: rail | 313: cart |
| 313a: wheel | 313b: tank protection pad |
| 320: floating structure | 330: storage tank |
| 400: system for maintaining high pressure of PLNG storage container | |
| 410: unloading line | 411: storage container |
| 420: pressure compensation line | 430: evaporator |
| 440: BOG line | 450: compressor |
| 510: storage container | 511: inner shell |
| 512: outer shell | 513: heat insulation layer part |
| 514: equalizing line | 514a: on/off valve |
| 514b: second exhaust valve | 514c: second exhaust line |
| 515: first exhaust line | 515a: first exhaust valve |
| 516a: first connecting part | 516b: second connecting part |
| 517: support | 518: lower support |
| 520: storage container | 521: inner shell |
| 521a: injection port | 522: outer shell |
| 522a: extension part | 523: heat insulation layer part |
| 524: connecting part | 525, 526, 527: buffer part |
| 525a, 526a, 527a: loop | 525b: joint part |

-continued

| | |
|---|---|
| 610, 640: natural gas liquefaction apparatus having separable heat exchanger | |
| 620, 650: liquefaction heat exchanger | 621: first passage |
| 622: second passage | 623: liquefaction line |
| 624: on/off valve | 630, 660: coolant cooling part |
| 631, 632, 661: coolant heat exchanger | 631a, 632a, 661a: first passage |
| 631b, 632b, 661b: second passage | 631c: third passage |
| 633, 663: compressor | 634, 664: after-cooler |
| 635: separator | 636a: first J-T valve |
| 636b: second J-T valve | 636c: third J-T valve |
| 637: coolant supply line | 638: coolant circulation line |
| 638a: gaseous line | 638b: liquid line |
| 638c: connecting line | 665: expander |
| 666: flow distribution valve | 700: LNG storage container carrier |
| 710: hull | 711: deck |
| 720: cargo hold | 721: opening |
| 730: first upper support | 740: second upper support |
| 750: lower support | 751: reinforcement member |
| 760: support block | 761: support plane |
| 770: container loading part | 791: storage container |
| 792: container box | |
| 810: solidified carbon-dioxide removal system | |
| 811: supply line | 812: expansion valve |
| 813: solidified carbon-dioxide filter | 814: first on/off valve |
| 815: second on/off valve | 816: heating unit |
| 816a: heat medium line | 816b: regenerative heat exchanger |
| 816c: fourth on/off valve | 816d: fifth on/off valve |
| 817: third on/off valve | 817a: exhaust line |
| 820: connection structure of LNG storage tank | |
| 821: sliding connecting part | 822: connecting part |
| 823: connecting part | 824: extension part |
| 830: LNG storage container | 831: inner shell |
| 831a: injection port | 832: outer shell |
| 833: heat insulation layer part | 840: external injection part |
| 900: LNG storage container | 910: inner shell |
| 920: outer shell | 930: support |
| 931: lower support | 940: heat insulation layer part |
| 950: corrugated structure | 951: corrugation |
| 952: curved portion | 9521: angled edge curved portion |
| 9522: rounded edge curved portion | 9523: wave-shaped curved portion |
| 953: curved angle | 954: corrugation depth |
| 955: corrugation distance | 960: top cover |
| 970: bottom cover | |
| 1000: storage container | 1010: inner shell |
| 1020: outer shell | 1030: support |
| 1031: internal support | 1032: external support |
| 10311, 10321: upper flange | 10312, 10322: lower flange |
| 10313, 10323: web | 10314, 10324: reinforcement member |
| 10315: sliding bar | 10316: sliding head |
| 10325: sliding hole | 10326: connection plate |
| 10327: connecting part | 1033: lower support |
| 1040: heat insulation layer part | 1041: first heat insulation layer |
| 1042: second heat insulation layer | 1043: passage |
| 1044: heat insulation layer | 10441: heat insulator block |
| 10442: reinforced heat insulator | |
| 10443: reinforced heat insulator groove | |
| 1050: corrugated structure | 1051: corrugation |
| 1060: top cover | 1070: bottom cover |
| 1080: first connecting part | 1081: second connecting part |
| 1085: first exhaust line | 1086: first exhaust valve |
| 1090: equalizing line | 1091: on/off valve |
| 1095: second exhaust line | 1096: second exhaust valve |

DETAILED DESCRIPTION OF EXEMPLARY EMBODIMENTS

Exemplary embodiments of the present invention will be described below in detail with reference to the accompanying drawings. Throughout the disclosure, like reference numerals refer to like parts throughout the drawings and embodiments of the present invention.

FIG. 1 is a flow diagram showing a PLNG producing method according to the present invention.

As shown in FIG. 1, the PLNG producing method according to the present invention produces PLNG by removing water from natural gas, without a process of removing acid gas from natural gas supplied from a natural gas field 1, and liquefying the natural gas by pressurization and cooling, without a process of fractionating natural gas liquid (NGL). To this end, the PLNG producing method may include a dehydration step S11 and a liquefaction step S12.

In the dehydration step S11, water such as water vapor is removed from natural gas by a dehydration process, without a process of removing acid gas from natural gas supplied from a natural gas field 1. That is, the dehydration process is performed on the natural gas, without undergoing the acid gas removal process. The skip of the acid gas removal process may simplify the producing process and reduce investment costs and maintenance expenses. In addition, since water is sufficiently removed from the natural gas in the dehydration step S11, it is possible to prevent the water freezing of the natural gas at the operating temperature and pressure of the production system.

In the liquefaction step S12, PLNG is produced by liquefying the dehydrated natural gas at a pressure of 13 to 25 bar and a temperature of −120 to −95° C., without an NGL fractionation process. For example, the PLNG having a pressure of 17 bar and a temperature of −115° C. may be produced. Since the process of fractionating the NGL, i.e., liquid hydrocarbon, from the natural gas is skipped, the LNG producing process may be simplified and the power consumption for cooling and liquefying the natural gas to a cryogenic temperature. Therefore, investment costs and maintenance expenses are reduced, lowering the production costs of LNG.

In the PLNG producing method according to the present invention, the condition of the natural gas field 1 may be that the produced natural gas has carbon dioxide ($CO_2$) of 10% or less. In addition, when an amount of carbon dioxide existing in the natural gas after the dehydration step S11 is 10% or less, a carbon dioxide removal step S13 of freezing and removing carbon dioxide may be further included in the liquefaction step S12.

The carbon dioxide removal step S13 may be performed when an amount of carbon dioxide existing in the natural gas after the dehydration step S11 is larger than 2% or equal to or smaller than 10%. When an amount of carbon dioxide is 2% or less, the natural gas exists in a liquid state under PLNG temperature and pressure conditions which will be described below. Therefore, even though the carbon dioxide removal step S13 is not performed, the production and transportation of PLNG are not affected. When an amount of carbon dioxide is larger than 2% and equal to or smaller than 10%, the natural gas is frozen as a solid state. Therefore, the carbon dioxide removal step S13 is carried out in order for liquefaction.

After the liquefaction step S12, a storing step S14 may be performed to store the PLNG, which is produced in the liquefaction step S12, in a storage container having a dual structure. Hence, the PLNG is transported to a desired position. To this end, a transportation step S15 may be performed to transport the PLNG through an individual or packaged storage container by a vessel. Also, the PLNG may be transported by a vessel through an individual or packaged storage container having a reinforced tank strength.

The storage container used in the transportation step S15 may be constructed and made of a material such that it can withstand a pressure of 13 to 25 bar and a temperature of −120 to −95° C. In addition, the vessel for transporting the storage container may be an existing barge or container ship, instead of a separate vessel such as an LNG carrier. Therefore, expenses for transporting the storage container may be reduced.

In this case, the storage container may be loaded into and transported by the barge or container ship that is not modified or minimally modified. The storage container to be transported by the vessel may be delivered on the basis of the individual storage container according to a request of a consumption place.

Meanwhile, the PLNG stored in the storage container delivered to a consumer after the transportation step S15 undergoes a regasification step S16 at a final consumption place and is supplied as a gaseous natural gas. A regasification facility for performing the regasification step S16 may be configured with a high pressure pump and a vaporizer. In the case of an individual consumption place such as a power plant or a factory, a self regasification facility may be installed.

Figure 2:
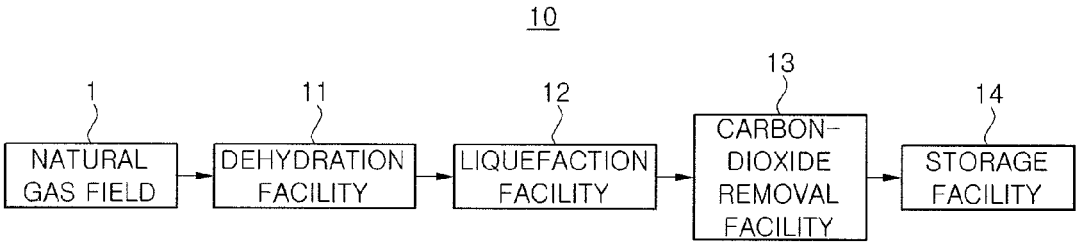
FIG. 2 is a configuration diagram showing a PLNG production system according to the present invention.

FIG. 2 is a configuration diagram showing a PLNG production system according to the present invention.

As shown in FIG. 2, a PLNG production system 10 according to the present invention may include a dehydration facility 11 for dehydrating natural gas supplied from a natural gas field 1, and a liquefaction facility 12 for liquefying the dehydrated natural gas to a pressure of 13 to 25 bar and a temperature of −120 to −95° C. and producing PLNG.

The dehydration facility 11 performs a dehydration process to remove water such as water vapor from the natural gas supplied from the natural gas field 1, thereby preventing the freezing of the natural gas at an operating temperature and pressure of the production system. At this time, the natural gas supplied from the natural gas field 1 to the dehydration facility 11 does not undergo an acid gas removal process. Therefore, the LNG producing process may be simplified and the investment costs and maintenance expenses may be reduced.

The liquefaction facility 12 produces the PLNG by liquefying the dehydrated natural gas at a pressure of 13 to 25 bar and a temperature of −120 to −95° C. For example, the liquefaction facility 12 may produce PLNG having a pressure of 17 bar and a temperature of −115° C. To this end, the liquefaction facility 12 may include a compressor and a cooler for compressing and cooling a low-temperature liquid. The natural gas supplied from the dehydration facility 11 is supplied to the liquefaction facility 12 and undergoes a liquefaction step, without an NGL fractionation process. Due to the skip of the NGL (liquefied hydrocarbon) fractionation process, the manufacturing costs and maintenance expenses of the system may be reduced, and thus, the production costs of the LNG may be reduced.

When an amount of carbon dioxide contained in the natural gas supplied from the dehydration facility 11 is 10% or less, the PLNG production system 10 according to the present invention may further include a carbon-dioxide removal facility 13 for freezing the carbon dioxide and removing the carbon dioxide from the natural gas.

The carbon-dioxide removal facility 13 may remove the carbon dioxide from the natural gas only when an amount of the carbon dioxide contained in the natural gas supplied from the dehydration facility 11 is larger than 2% or equal to or smaller than 10%. That is, when an amount of the carbon dioxide contained in the natural gas is 2% or less, the natural gas exists in a liquid state at the temperature and pressure conditions of the PLNG. Thus, it is unnecessary to remove the carbon dioxide. When an amount of the carbon dioxide contained in the natural gas is larger than 2% and equal to or smaller than 10%, the natural gas is frozen as a solid state. Thus, it is necessary to remove the carbon dioxide at the carbon-dioxide removal facility 13.

The PLNG produced from the liquefaction facility 12 is stored in the storage container having a dual structure at a storage facility 14 and is transported to a desired consumption place by a storage container transportation.

Figure 3:
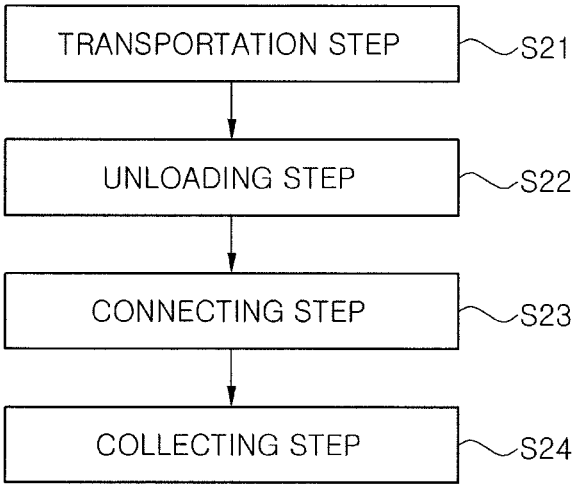
FIG. 3 is a flow diagram showing a PLNG distributing method according to the present invention.

FIG. 3 is a flow diagram showing a PLNG distributing method according to the present invention.

As shown in FIG. 3, the PLNG distributing method according to the present invention pressurizes and cools natural gas to produce PLNG, stores the PLNG in a storage container, loads the storage container, transports the storage container to a consumption place, unloads the storage container at the consumption place, and connects the storage container to a regasification system at the consumption place. To this end, the PLNG distributing method according to the present invention may include a transporting step S21, an unloading step S22, and a connecting step S23.

Figure 4:
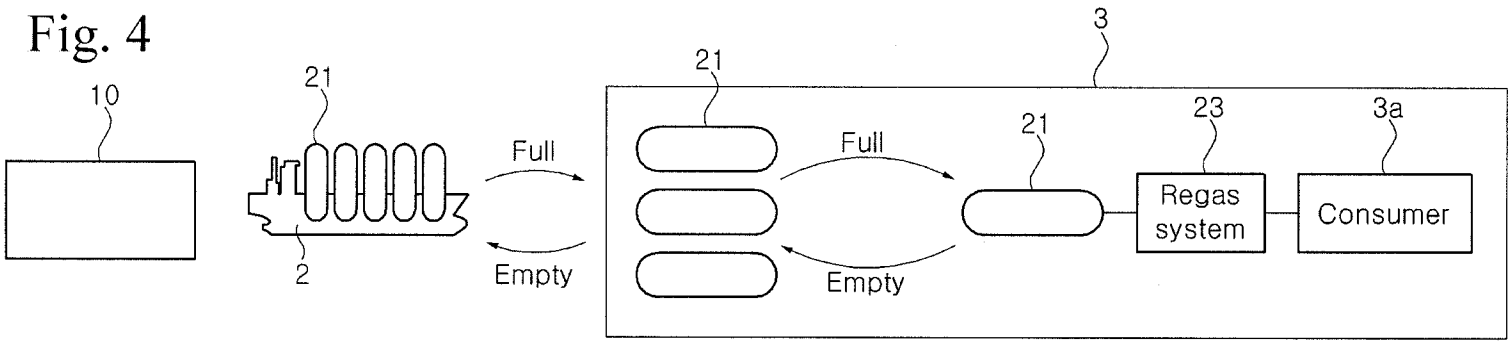
FIG. 4 is a configuration diagram explaining the PLNG distributing method according to the present invention.

As shown in FIG. 4, in the transporting step S21, PLNG produced by liquefying natural gas at a pressure of 13 to 25 bar and a temperature of −120 to −95° C. is stored in a transportable storage container 21, is loaded into a vessel 2, and is transported to a consumption place. The PLNG may be produced by the above-described PLNG producing method. The storage container 21 for storing the produced PLNG may be constructed and made of a material such that it can withstand a pressure of 13 to 25 bar and a temperature of −120 to −95° C. The storage container 21 may have a dual structure. A plurality of storage containers 21 may be loaded into the vessel 2.

In the transporting step S21, the storage container may be transported by a land vehicle, such as a trailer or a train, when the consumption place 3 is located in an inland region.

In the unloading step S22, when the vessel 2 arrives at the consumption place 3, the storage container 21 storing the PLNG is unloaded at the consumption place 3 by an unloading facility. The storage container 21 may be unloaded on the basis of the individual storage container.

Figure 5:
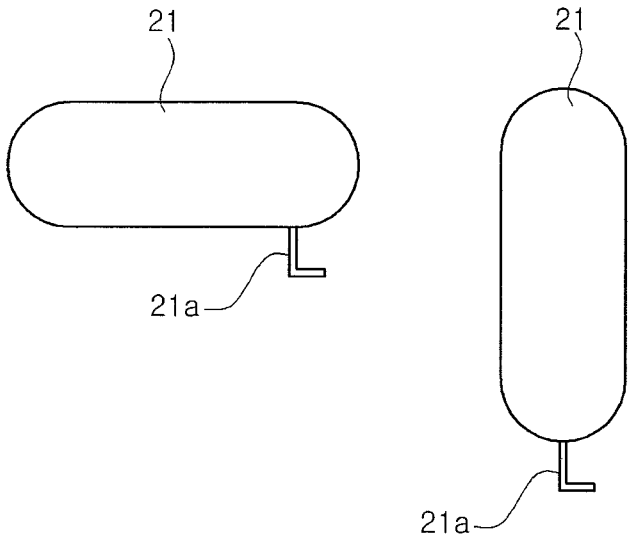
FIG. 5 is a side view showing a pressure container used for the PLNG distributing method according to the present invention.

In the connecting step S23, the storage container 21 is connected to the regasification system 23 at the consumption place 3 so that the PLNG stored in the storage container 21 can be vaporized. The natural gas generated by vaporizing the PLNG stored in the storage container 21 can be supplied to the consumer 3*a*. Meanwhile, as shown in FIG. 5, the storage container 21 is provided with a nozzle 21*a* for inflow and outflow of the PLNG and connection to a vaporization line of the regasification system 23. The nozzle 21*a* may be provided at various positions in various structures, depending on a posture in which the storage container 21 is loaded into the vessel 2 and a posture in which the nozzle 21*a* is connected to the regasification system 23. The nozzle 21*a* may have a connector for connection to a connector of a PLNG storage facility and a connector of the regasification system 23.

The PLNG distributing method according to the present invention may further include a collecting step S24 of collecting the empty storage container 21 from the consumption place 3.

In the collecting step S24, the empty storage container 21 is collected to the place where the PLNG production system 10 is located, by using the land vehicle or a vessel 2. This may contribute to reduction in the distribution costs and the natural gas supply costs.

Figure 6:
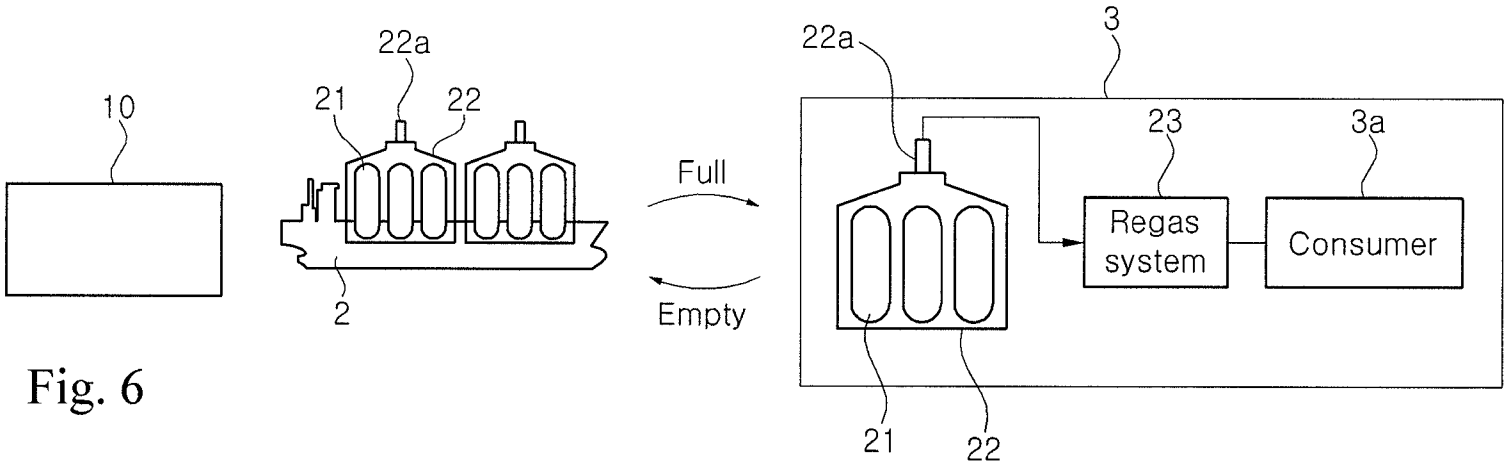
FIG. 6 is a configuration diagram explaining another example of the PLNG distributing method according to the present invention.

As shown in FIG. 6, in the transporting step S21, a container assembly 22 may be transported. The container assembly 22 is provided by combining a plurality of storage containers 21 as one package. The container assembly 22 may be provided with an integral nozzle 22*a* that is connected to integrate the nozzles (21*a* in FIG. 5), which are provided in the respective storage containers 21 in order for the inflow and outflow of the PLNG. Therefore, by grouping the storage containers 21 into the container assembly 22 and using the storage containers 21 as a single container by the integral nozzle 22*a*, it is possible to reduce time and effort necessary for the loading in the transporting step S21, the unloading in the unloading step S22, the connection to the regasification system 23 in the connecting step S23, and the collection in the collecting step S24.

The container assembly 22 is constructed by a plurality of storage containers 21. Thus, it is efficient to unload the container assembly 22 at a place where a large amount of natural gas is needed, like a single consumption place such as a power plant or an industrial complex.

In addition, according to the PLNG distributing method according to the present invention, a separate storage tank is not needed at the consumption place. Furthermore, the regasification system simply needs to be provided, and it is possible to unload the storage container 21 or the container assembly 22 and to collect the empty storage container 21 or the container assembly 22, while making the rounds from the place, where the PLNG production system is located, to the individual consumption places 3 by the vessel or the land vehicle parallel with the vessel. In particular, in the case of Southeast Asia where a plurality of small and medium consumption places are dispersed in many islands, it is possible to minimize the construction of infrastructures, such separate storage facilities and pipelines, at the respective consumption places.

Figure 7:
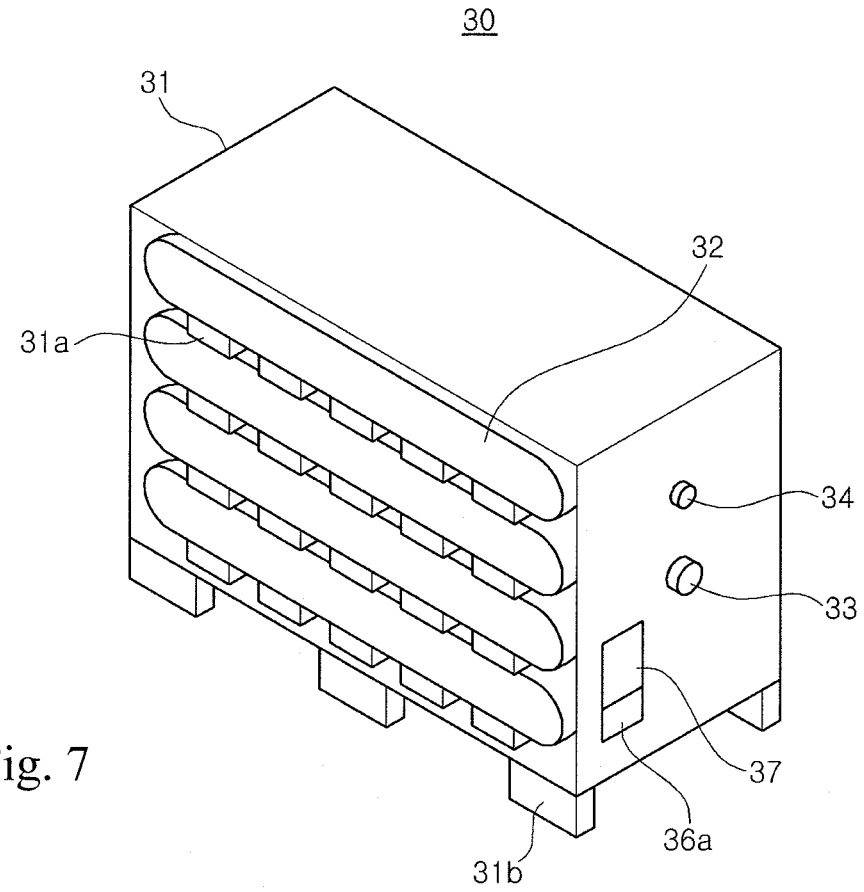
FIG. 7 is a perspective view showing an LNG storage tank according to the present invention.

FIG. 7 is a perspective view showing an LNG storage tank according to the present invention.

As shown in FIG. 7, the LNG storage tank 30 according to the present invention includes a plurality of storage containers 32 installed inside a main body 31 to store LNG. The LNG storage tank 30 allows the LNG to be loaded into and unloaded from the respective storage containers 32 through an unloading/loading line 33, to which the respective storage containers 32 are connected and in which loading/unloading valves 33*a* and 33*b* are installed.

The main body 31 is installed such that the plurality of storage containers 32 are arranged inside. The main body 31 may include spacers 31*a* installed between the storage containers 32 such that the storage containers 32 maintain the arrangement state while being kept spaced apart from one another.

In addition, the main body 31 may include a heat insulation layer for blocking heat transfer, or a dual structure for heat insulation. The main body 31 may have various structures, including a hexahedral structure like in this embodiment. In addition, the main body 31 may include a plurality of supports 31*b*, such that the main body 31 is spaced apart from the ground to block heat transfer to the ground, and the main body 31 is installed on the ground in a stable posture.

Figure 8:
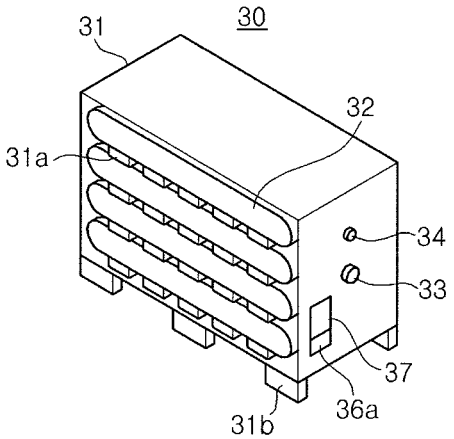
FIG. 8 is a perspective view showing various types of the LNG storage tank according to the present invention.
Figure 8:
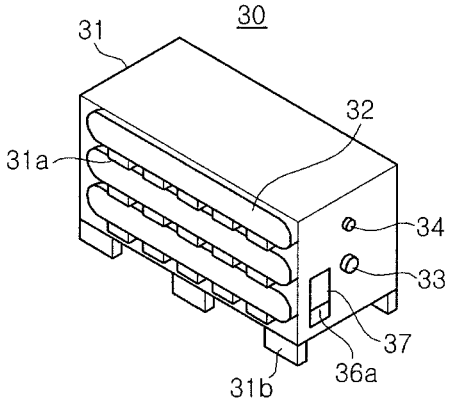
Figure 8:
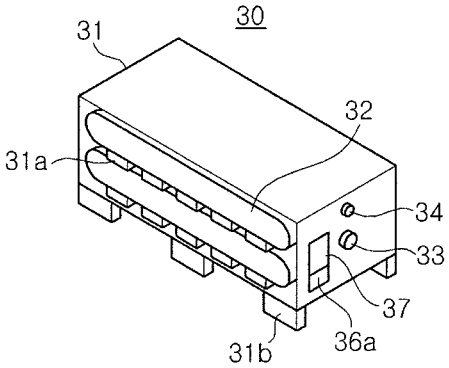

As shown in FIGS. 8(*a*), 8(*b*) and 8(*c*), the main body 31 may have a small size, a medium size, and a large size. Thus, the number and size of the storage containers 32 accommodated in the main body 31 may be standardized. However, the present invention is not limited the above examples. The main body 31 may be manufactured to accommodate various numbers of the storage containers 32 and may be manufactured in various sizes.

The storage containers 32 may be constructed and made of a material such that it can withstand a pressure of 13 to 25 bar and a temperature of −120 to −95° C., together with the loading/unloading line 33, so as to store the LNG. In order to withstand the above pressure and temperature condition, a heat insulation member is installed in the storage containers 32 and the loading/unloading line 33, and the storage containers 32 and the loading/unloading line 33 have a dual structure. Therefore, it is possible to store and transport the PLNG having a pressure of 13 to 25 bar and a temperature of −120 to −95° C., for example, a pressure of 17 bar and a temperature of −115° C.

Figure 9:
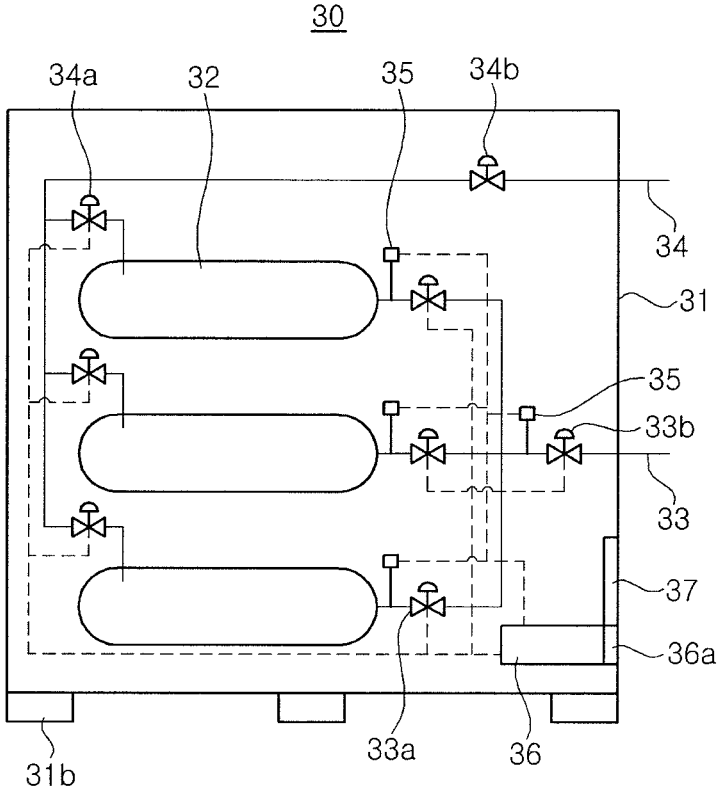
FIG. 9 is a configuration diagram showing one example of the LNG storage tank according to the present invention.

As shown in FIG. 9, the loading/unloading line 33 is connected to the respective storage containers 32 and extends to the outside of the main body 31. In the loading/unloading line 33, the loading/unloading valves 33*a* and 33*b* are installed to enable and disable the loading/unloading of the LNG into/from the storage containers 32. Therefore, after the main body 31 is installed at the consumption place and then the loading/unloading line 33 is connected to the regasification system or the supply line of the consumption place, the LNG or natural gas can be supplied immediately.

The loading/unloading valves 33*a* and 33*b* may include first individual valves 33*a* and a first integral valve 33*b*. The first individual valves 33*a* are individually installed to enable and disable the loading/unloading of the LNG into/from the storage containers 32. The first integral valve 33*b* is installed to integrally enable and disable the loading/unloading of the LNG into/from the entire storage containers 32. If all the first individual valves 33*a* as the loading/unloading valves are opened, the respective storage containers 32 may be packaged as a single container and used as a single tank. In addition, only the first individual valves 33*a* or only the first integral valve 33*b* may be installed as the loading/unloading valve.

The LNG storage tank 30 according to the present invention may further include a boil-off gas (BOG) line 34 in order to exhaust BOG that is naturally generated from the storage containers 32. The BOG line 34 is connected to some or all of the storage containers 32 and extends to the outside of the main body 31. The BOG line 34 is provided with BOG valves 34*a* and 34*b* that are opened and closed to exhaust the BOG generated within the storage containers 32. The BOG line 34 may be constructed and made of a material such that it can withstand a pressure of 13 to 25 bar and a temperature of −120 to −95° C.

In addition, the BOG valves 34*a* and 34*b* may include second individual valves 34*a* and a second integral valve 34*b*. The second individual valves 34*a* are individually installed to enable and disable the exhaust of the BOG from the respective storage containers 32. The second integral valve 34*b* is installed to integrally enable and disable the exhaust of the BOG from the entire storage containers 32. Only the second individual valves 34*a* or only the second integral valve 34*b* may be installed as the BOG valve. As described above, if all the second individual valves 34*a* are opened, the respective storage containers 32 may be packaged as a single container and used as a single tank. In addition, only the second individual valves 34*a* or only the second integral valve 34*b* may be installed.

The LNG storage tank 30 according to the present invention may further include pressure sensing units 35 and a controlling unit 36. The pressure sensing units 35 sense an individual or entire internal pressure of the storage containers 32 and output a sense signal. The controlling unit 36 receives the sense signal output from the pressure sensing units 35, and displays the individual or entire internal pressure of the storage containers 32 on a displaying unit 37 installed on the outside of the main body 31. In order to measure the individual or entire internal pressure of the storage containers 32, the pressure sensing units 35 may be installed at the front ends of the storage containers 32 on the loading/unloading line 33, or may be installed on an integral path that is moving so as to load/unload the LNG through the loading/unloading line 33. In addition, the controlling unit 36 may control the loading/unloading valves 33*a* and 33*b* and the BOG valves 34*a* and 34*b* according to a manipulation signal output from a manipulating unit 36*a*, which is installed in the main body 31 or installed to enable a wired/wireless communication at a remote place.

Figure 10:
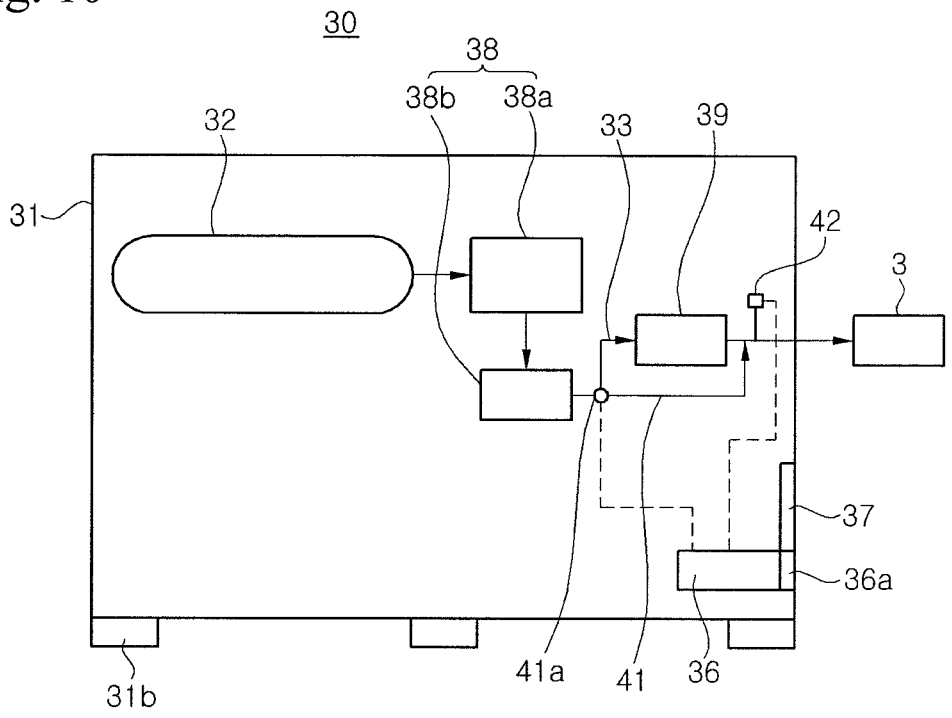
FIG. 10 is a configuration diagram showing another example of the LNG storage tank according to the present invention.

As shown in FIG. 10, the LNG storage tank 30 according to the present invention may include a heating unit 38 and a heating value adjusting unit 39 so as to vaporize the LNG unloaded from the storage containers 32 and to adjust a heating value required at a consumption place. The heating unit 38 is installed to vaporize the LNG unloaded from some or all of the storage containers 32. The heating value adjusting unit 39 is installed to adjust a heating value of the natural gas passing through the heating unit 38. The heating unit 38 and the heating value adjusting unit 39 may be installed on a line where any one or a plurality of the storage containers 32 are integrated in the loading/unloading line 33, or may be installed on a separate line that is connected to the storage containers 32 and the loading/unloading line 33 and passes the LNG by a valve.

The heating unit 38 may include a plate-fin type heat exchanger 38*a* and an electric heater 38*b*. The plate-fin type heat exchanger 38*a* is installed to primarily heat the LNG by heat exchange with air. The electric heater 38*b* is installed to secondarily heat the LNG that is vaporized by passing the heat exchanger 38*a*.

A bypass line 41 may be further provided in the line where the heating value adjusting unit 39 is installed, for example, the loading/unloading line 33. The bypass line 41 is connected to bypass the heating value adjusting unit 39 by a bypass valve 41*a*. Therefore, when it is necessary to adjust the heating value of the natural gas, the natural gas is supplied to the heating value adjusting unit 39 by the operation of the bypass valve 41*a*. In this manner, the natural gas having the heating value required at the consumption place is supplied. When it is unnecessary to adjust the heating value of the natural gas, the natural gas bypasses the heating value adjusting unit 39 through the bypass line 41 by the operation of the bypass valve 41*a*. The bypass valve 41*a* may be a three-way valve or a plurality of two-way valves.

In addition, the LNG storage tank 30 according to the present invention may further include a temperature sensing unit 42 and a controlling unit 36 so as to make the unloaded natural gas have a temperature required at the consumption place. The temperature sensing unit 42 senses a temperature of the unloaded natural gas. The controlling unit 36 receives a signal from the temperature sensing unit 42, and controls the electric heater 38*b* to make the natural gas reach a set temperature range. In addition, the controlling unit 36 may display the temperature of the unloaded natural gas on the displaying unit 37 installed on the outside of the main body 31.

The temperature sensing unit 42 may be installed at an outlet side of the loading/unloading line 33. In addition, the controlling unit 36 may control the bypass valve 41*a* according to the manipulation signal output from the manipulating unit 36*a* as described above.

As such, the LNG storage tank 30 according to the present invention may be divided into the storage containers 32, which can store the LNG and process the BOG, and the storage containers 32, which can store the LNG, process the BOG, and adjust the vaporization facility and the heating value, depending on functions. The LNG storage tank 30 according to the present invention can easily transport the LNG or the natural gas according to a consumer's request at the consumption place.

FIG. 11 is a sectional view showing an LNG storage container according to a first embodiment of the present invention.

As shown in FIG. 11, the LNG storage container 50 according to the first embodiment of the present invention may include an inner shell 51, an outer shell 52, and a heat insulation layer part 53. The inner shell 51 is made of a metal that withstands a low temperature of LNG stored inside. The outer shell 52 encloses the outside of the inner shell 51 and is made of a steel material that withstands an internal pressure of the inner shell 51. The heat insulation layer part 53 reduces a heat transfer between the inner shell 51 and the outer shell 52.

The inner shell 51 forms an LNG storage space. The inner shell 51 may be made of a metal that withstands a low temperature of the LNG. For example, the inner shell 51 may be made of a metal having excellent low temperature characteristic, such as aluminum, stainless steel, and 5-9% nickel steel. Like in this embodiment, the inner shell 51 may be formed in a tubular type. Also, the inner shell 51 may have various shapes, including a polyhedron.

The outer shell 52 encloses the outside of the inner shell 51 such that a space is formed between the outer shell 52 and the inner shell 51. The outer shell 52 is made of a steel material that withstands the internal pressure of the inner shell 51. The outer shell 52 shares the internal pressure applied to the inner shell 51. Therefore, an amount of a material used for the inner shell 51 may be reduced, leading to a reduction in the production costs of the LNG storage container 50.

Due to a connection passage to be described below, the pressure of the inner shell 51 becomes equal or similar to the pressure of the heat insulation layer part 53. Therefore, the outer shell 52 can withstand the pressure of the PLNG. Even though the inner shell 51 is manufactured to withstand a temperature of −120 to −95° C., the PLNG having the above pressure (13 to 25 bar) and temperature condition, for example, a pressure of 17 bar and a temperature of −115° C., can be stored by the inner shell 51 and the outer shell 52. The storage container 50 may be designed to satisfy the above pressure and temperature condition in such a state that the outer shell 52 and the heat insulation layer part 53 are assembled.

Since the pressures received by the inner shell and the outer shell can become substantially equal in the normal state by the connection passage, there is almost no difference. However, when the pressure of the storage container is rapidly lowered in the abnormal state (full vent), the pressure difference between the inside and outside of the inner shell can be 0.5 bar. Therefore, the inner shell can be made to withstand a pressure of about 0.5 bar.

Meanwhile, the inner shell 51 may be made to have a thickness t1 smaller than a thickness t2 of the outer shell 52. Therefore, when manufacturing the inner shell 51, the use of expensive metal having excellent low temperature characteristic may be reduced.

The heat insulation layer part 53 is installed in a space between the inner shell 51 and the outer shell 52 and is made of a heat insulator that reduces a heat transfer. In addition, the heat insulation layer part 53 may be constructed or made of a material such that a pressure equal to the internal pressure of the inner shell 51 is applied thereto. The pressure equal to the internal pressure of the inner shell 51 refers to not a strictly equal pressure but a similar pressure.

The heat insulation layer part 53 and the inside of the inner shell 51 may be connected together by the connection passage 54 in order for pressure balance between the inside and the outside of the inner shell 51. When the pressure is balanced between the inside of the inner shell 51 and the outside of the inner shell 51 (the inside of the outer shell 52) by the connection passage 54, the outer shell 52 supports a considerable portion of the pressure, leading to a reduction in the thickness of the inner shell 51.

As shown in FIG. 12, the connection passage 54 may be formed at a side contacting the heat insulation layer part 53 in a connecting part 55 provided at an inlet/outlet port 51*a* of the inner shell 51. Therefore, the internal pressure of the inner shell 51 is moved toward the heat insulation layer part 53 through the connection passage 54, and thus, the pressure between the inside and the outside of the inner shell 51 is balanced.

Figure 13:
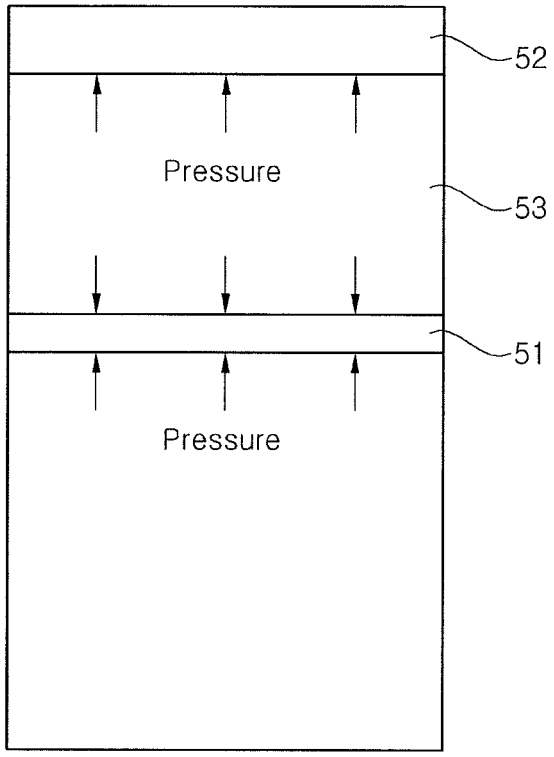
FIG. 13 is a sectional view explaining the operation of the LNG storage container according to the first embodiment of the present invention.

As shown in FIG. 13, the heat insulation layer part 53 is installed with a thickness to reduce a heat transfer between the inner shell 51 made of a metal having excellent low temperature characteristic and the outer shell 52 made of a steel material having excellent strength and to maintain an appropriate boil off rate (BOR). Due to the installation of the heat insulation layer part 53, the PLNG as well as the LNG can be stored. Due to the pressure balance between the inside and the outside of the inner shell 51, the thickness t1 of the inner shell 51 is reduced. Therefore, the use of the expensive metal having excellent low temperature characteristic may be reduced. In addition, a structural defect caused by the internal pressure of the inner shell 51 may be prevented, and the storage container 50 having excellent durability may be provided.

Meanwhile, the connecting part 55 may be integrally connected to the inlet/outlet port 51*a* of the inner shell 51 in order for the supply and exhaust of the LNG to/from the inner shell 51. Thus, the connecting part 55 may protrude outside the outer shell 52. An external member such as a valve may be connected to the connecting part 55.

Figure 14:
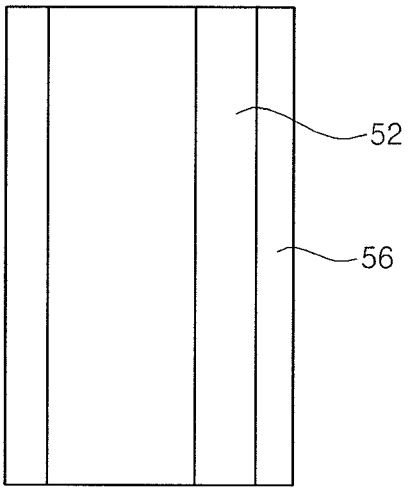
FIG. 14 is a partial sectional view showing an LNG storage container according to a second embodiment of the present invention.

As shown in FIG. 14, an LNG storage container according to a second embodiment of the present invention may include an external heat insulation layer 56 installed in order for a heat insulation on the outside of the outer shell 52. The external heat insulation layer 56 may be attached to the outer shell 52 such that it encloses the outside of the outer shell 52. Also, the external heat insulation layer 56 may keep enclosing the outer shell 52 by its molded or formed shape. Hence, a heat transfer from the exterior is prevented. Therefore, under a high temperature environment such as tropical regions, the generation of BOG from the LNG or PLNG stored in the storage containers is reduced.

As shown in FIG. 15, an LNG storage container according to a third embodiment of the present invention may include a heating member 57 installed on the outside of the outer shell 52. The heating member 57 may be a heat medium circulation line that supplies heat to the outer shell 52 by the circulating supply of heat medium. The heating member 57 may include a heater that generates heat by power supplied from a battery, an electric condenser or a power supply unit attached to the storage container 50. The heating member 57 may include a flexible plate-type heating element or a heating wire wound around the outer surface of the outer shell 52 as in the case of this embodiment.

Therefore, under a low temperature environment such as polar regions, the LNG or PLNG stored in the storage container is not affected by external cold air. Hence, the outer shell 52 may be made of a general steel sheet, reducing the manufacturing costs thereof.

FIG. 16 is a sectional view showing an LNG storage container according to a fourth embodiment of the present invention. As shown in FIG. 16, the LNG storage container 60 according to the fourth embodiment of the present invention may include an inner shell 61, an outer shell 62, a support 63, and a heat insulation layer part 64. The inner shell 61 stores LNG inside. The outer shell 62 encloses the outside of the inner shell 61. The support 63 is provided between the inner shell 61 and the outer shell 62 to support the inner shell 61 and the outer shell 62. The heat insulation layer part 64 reduces a heat transfer. Meanwhile, in order for the supply and exhaust of the LNG to/from the inner shell 61, a connecting part (not shown) may be integrally formed in an inlet port of the inner shell 61 and protrude to the outside of the outer shell 62. The connection part may be connected to an external member such as a valve or the like.

The inner shell 61 forms an LNG storage space. The inner shell 61 may be made of a metal that withstands a low temperature of the LNG. For example, the inner shell 61 may be made of a metal having excellent low temperature characteristic, such as aluminum, stainless steel, and 5-9% nickel steel. Like in this embodiment, the inner shell 61 may be formed in a tubular type. Also, the inner shell 61 may have various shapes, including a polyhedron.

The outer shell 62 encloses the outside of the inner shell 61 such that a space is formed between the inner shell 61 and the outer shell 62. The outer shell 62 may be made of a steel material that withstands internal pressure. The outer shell 62 shares the internal pressure applied to the inner shell 61. Therefore, an amount of a material used for the inner shell 61 is reduced, leading to a reduction in the manufacturing cost thereof.

Due to a connection passage, the pressure of the inner shell 61 becomes equal or similar to the pressure of the heat insulation layer part 64. Therefore, the outer shell 62 can withstand the pressure of the PLNG. Even though the inner shell 61 is manufactured to withstand a temperature of −120 to −95° C., the PLNG having the above pressure (13 to 25 bar) and temperature condition, for example, a pressure of 17 bar and a temperature of −115° C., can be stored by the inner shell 61 and the outer shell 62. The storage container 60 may be designed to satisfy the above pressure and temperature condition in such a state that the outer shell 62, the support 63, and the heat insulation layer part 64 are assembled.

Since the pressures received by the inner shell and the outer shell can become substantially equal in the normal state by the connection passage, there is almost no difference. However, when the pressure of the storage container is rapidly lowered in the abnormal state (full vent), the pressure difference between the inside and outside of the inner shell can be 0.5 bar. Therefore, the inner shell can be made to withstand a pressure of about 0.5 bar.

Figure 17:
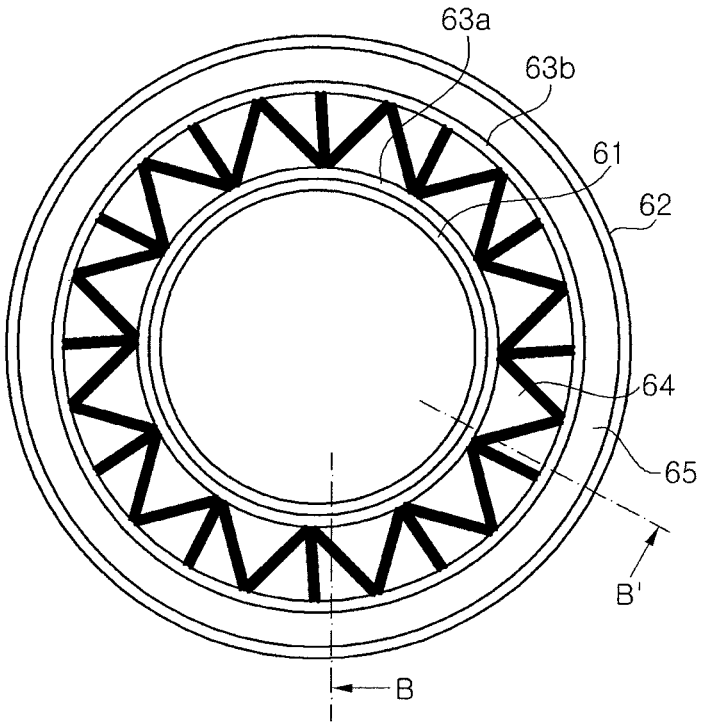
FIG. 17 is a sectional view taken along line A-A' of FIG. 16.

The support 63 is installed in the space between the inner shell 61 and the outer shell 62 to support the inner shell 61 and the outer shell 62. Therefore, the inner shell 61 and the outer shell 62 are structurally reinforced and are made a metal withstanding a low temperature of LNG (for example, low-temperature steel). As shown in FIG. 17, a single support 63 may be installed along lateral circumferences of the inner shell 61 and the outer shell 62, or a plurality of supports 63 may be installed to be spaced apart in a vertical direction on the lateral sides of the inner shell 61 and the outer shell 62 as in this embodiment.

Figure 18:
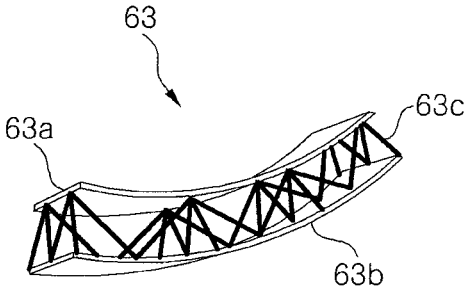
FIG. 18 is a sectional view taken along line B-B' of FIG. 17.

As shown in FIG. 18, the support 63 may include a first flange 63*a*, a second flange 63*b*, and a first web 63*c*. The first flange 63*a* and the second flange 63*b* are supported on the outer surface of the inner shell 61 and the inner surface of the outer shell 62. The first web 63*c* is provided between the first flange 63*a* and the second flange 63*b*. The first flange 63*a* and the second flange 63*b* may have a ring shape or may include curvature members formed by dividing a ring shape into a plurality of parts.

In addition, the support 63 may be fixedly supported by welding on the outer surface of the inner shell 61 and the inner surface of the outer shell 62, without using separate members such as a flange. In this case, a glass fiber may be inserted into the support 63 in order to prevent heat from being transferred to the exterior through the support 63.

The first web 63*c* may include a plurality of gratings, both of which are fixed to the first and second flanges 63*a* and 63*b*. Some of the gratings may be fixed to mainly receive a compressive force between the first flange 63*a* and the second flange 63*b*, and the others may be fixed to form a truss structure. The shape and fixing position of the gratings may be changed or adjusted. This may be equally applied to a case that the first web 63*c* is fixedly supported to the inner shell 61 and the outer shell 62 by welding.

A heat insulation member 65 may be installed between the inner surface of the outer shell 62 and the second flange 63*b* in order for blocking a heat transfer. The heat insulation member 65 may include a glass fiber and prevent the temperature of the inner shell 61 from being transferred to the outer shell 62 by the support 63.

In addition, in the case that the support 63 is fixedly supported by welding, the heat insulation member 65 such a glass fiber may be disposed at an end portion of the support 63 contacting the outer shell 62 and be fixed by welding. Alternatively, a separate heat insulation member may be disposed between the outside of the support 63 and the inside of the outer shell 62. In this manner, it is possible to prevent the temperature of the inner shell 61 from being transferred to the outer shell 62 by the support 63.

The LNG storage container 60 according to the present invention may further include a lower support 66 installed in a lower space between the inner shell 61 and the outer shell 62 in order to support the inner shell 61 and the outer shell 62. The lower support 66 may include a third flange, a fourth flange, and a second web. The third flange and the fourth flange are supported on the outer surface of the inner shell 61 and the inner surface of the outer shell 62. The second web is provided between the third flange and the fourth flange. The second web may include a plurality of gratings, both ends of which are fixed to the third flange and the fourth flange. Detailed shapes of these components are just different according to the installation positions, and these components of the lower support are substantially identical to those of the support 63. In addition, a heat insulation member (not shown) may be installed between the inner surface of the outer shell 62 and the fourth flange in order for blocking a heat transfer. The heat insulation member may be a glass fiber.

The heat insulation layer part 64 is installed in a space between the inner shell 61 and the outer shell 62 and is made of a heat insulator that reduces a heat transfer. In addition, the heat insulation layer part 64 may be constructed or made of a material such that a pressure equal to the internal pressure of the inner shell 61 is applied thereto. The pressure equal to the internal pressure of the inner shell 61 refers to not a strictly equal pressure but a similar pressure. In addition, the heat insulation layer part 64 and the inside of the inner shell 61 may be connected together by the connection passage (54 in FIG. 12) in order for pressure balance between the inside and the outside of the inner shell 61, like in the previous embodiment shown in FIG. 12. Since the connection passage 54 has been described in detail in the previous embodiment, further description thereof will be omitted.

In addition, the heat insulation layer part 64 may be made of a grain-type insulator (e.g., perlite) that can pass through the support 63, in particular, the web 63*c* having the grating structure. Therefore, the grain-type heat insulation layer part 64 can be freely mixed uniformly and filled. Since no gap is formed between the inner shell 61 and the outer shell 62, the heat insulation performance may be improved.

Furthermore, upon filling, grains of the heat insulation layer part 64 are freely moved by the support 63 and the lower support 66 having the grating support structure, thereby preventing non-uniformity of the heat insulation layer part 64.

Figure 19:
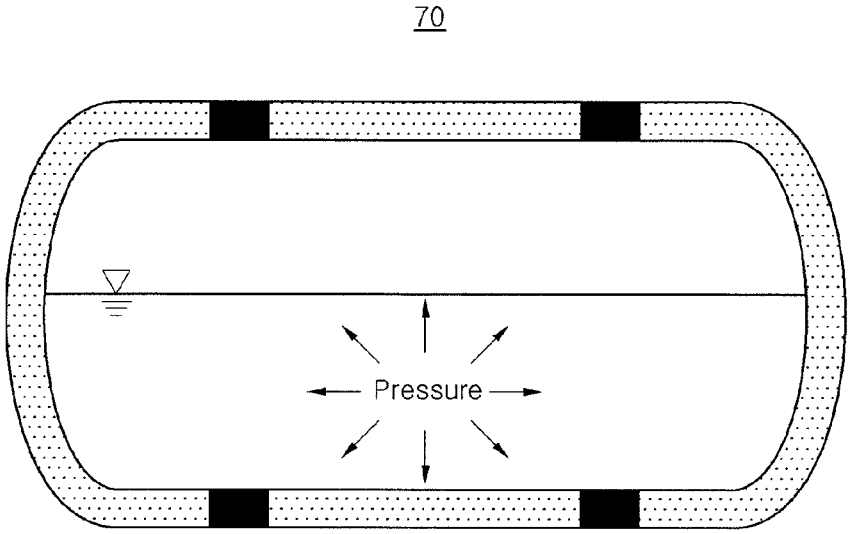
FIG. 19 is a sectional view showing an LNG storage container according to a fifth embodiment of the present invention.

As shown in FIG. 19, an LNG storage container 70 according to a fifth embodiment of the present invention may be installed in a transverse direction. In this case, the lower support (66 in FIG. 16) in the previous embodiment may be omitted.

Figure 20:
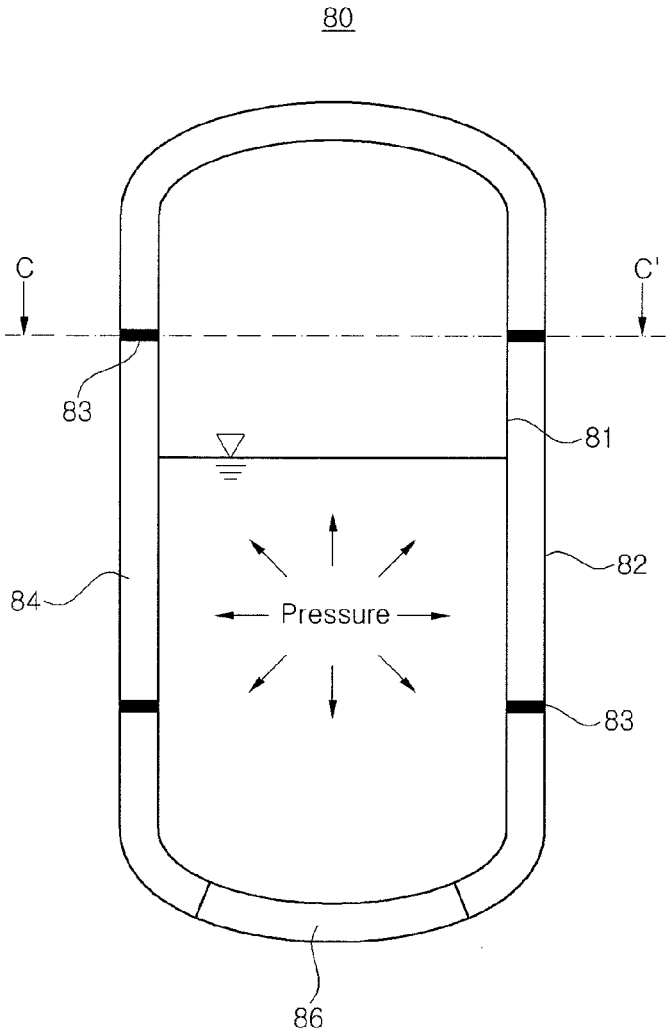
FIG. 20 is a sectional view showing an LNG storage container according to a sixth embodiment of the present invention.

FIG. 20 is a sectional view showing an LNG storage container according to a sixth embodiment of the present invention.

As shown in FIG. 20, the LNG storage container 80 according to the sixth embodiment of the present invention may include an inner shell 81, an outer shell 82, and a heat insulation layer part 84. The inner shell 81 stores LNG inside, and the outer shell 82 encloses the outside of the inner shell 81. The heat insulation layer part 84 reduces a heat transfer between the inner shell 81 and the outer shell 82. The outer surface of the inner shell 81 and the inner surface of the outer shell 82 are connected together by a metal core 83. Meanwhile, a connecting part (not shown) may be integrally connected to an inlet/outlet port of the inner shell 81 in order for the supply and exhaust of the LNG to/from the inner shell 81. Thus, the connecting part may protrude outside the outer shell 82. An external member such as a valve may be connected to the connecting part.

The inner shell 81 forms an LNG storage space. The inner shell 81 may be made of a metal that withstands a low temperature of the LNG. For example, the inner shell 81 may be made of a metal having excellent low temperature characteristic, such as aluminum, stainless steel, and 5-9% nickel steel. Like in this embodiment, the inner shell 81 may be formed in a tubular type. Also, the inner shell 81 may have various shapes, including a polyhedron.

The outer shell 82 encloses the outside of the inner shell 81 such that a space is formed between the outer shell 82 and the inner shell 81. The outer shell 82 is made of a steel material that withstands the internal pressure of the inner shell 81. The outer shell 82 shares the internal pressure applied to the inner shell 81. Therefore, an amount of a material used for the inner shell 81 may be reduced, leading to a reduction in the production costs of the LNG storage container 80.

Due to a connection passage, the pressure of the inner shell 81 becomes equal or similar to the pressure of the heat insulation layer part 84. Therefore, the outer shell 82 can withstand the pressure of the PLNG. Even though the inner shell 81 is manufactured to withstand a temperature of −120 to −95° C., the PLNG having the above pressure (13 to 25 bar) and temperature condition, for example, a pressure of 17 bar and a temperature of −115° C., can be stored by the inner shell 81 and the outer shell 82. The storage container 80 may be designed to satisfy the above pressure and temperature condition in such a state that the outer shell 82, the metal core 83, and the heat insulation layer part 84 are assembled.

Since the pressures received by the inner shell and the outer shell can become substantially equal in the normal state by the connection passage, there is almost no difference. However, when the pressure of the storage container is rapidly lowered in the abnormal state (full vent), the pressure difference between the inside and outside of the inner shell can be 0.5 bar. Therefore, the inner shell can be made to withstand a pressure of about 0.5 bar.

The metal core 83 may be connected to the outer surface of the inner shell 81 and the inner surface of the outer shell 82 such that the inner shell 81 and the outer shell 82 are supported each other. The metal core 83 may be installed along the lateral circumferences of the inner shell 81 and the outer shell 82, or a plurality of supports 63 may be installed to be spaced apart in a vertical direction on the lateral sides of the inner shell 81 and the outer shell 82 as in the case of this embodiment. In addition, the metal core 83 may be a wire such as a steel wire. For example, the metal core 83 may be connected to a plurality of rings provided on the outer surface of the inner shell 81 and the inner surface of the outer shell 82. The metal core 83 may be coupled or welded on a plurality of support points 83*a*. Also, the metal core 83 may connect the inner shell 81 and the outer shell 82 by various methods.

Figure 21:
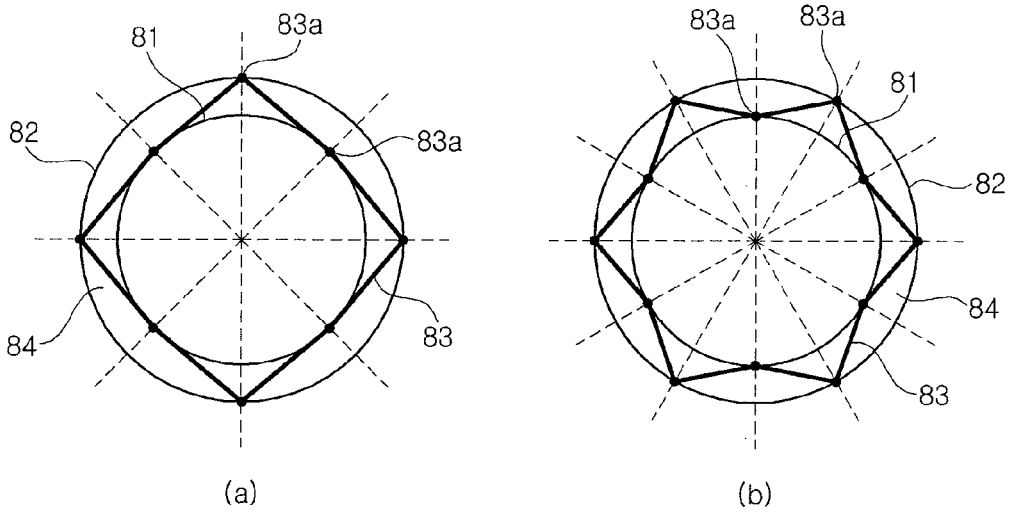
FIG. 21 is a sectional view taken along line C-C' of FIG. 20.

As shown in FIG. 21, the metal core 83 may be installed by repeatedly connecting one support point 83*a* of the inner shell 81 to two adjacent support points 83*a* of the outer shell 82 and repeatedly connecting one support point 83*a* of the outer shell 82 to two adjacent support points 83*a* of the inner shell 81. The metal core 83 may be arranged in a zigzag form along the circumferences of the inner shell 81 and the outer shell 82. As shown in FIGS. 21 (*a*) and (*b*), the number of times or counts of connections of the metal core 83 may be changed.

The LNG storage container 80 according to the present invention may further include a lower support 86 installed in a lower space between the inner shell 81 and the outer shell 82 in order to support the inner shell 81 and the outer shell 82. The lower support 86 may include flanges and a web. The flanges are supported on the outer surface of the inner shell 81 and the inner surface of the outer shell 82. The web is provided between the flanges. The web may include a plurality of gratings, both of which are fixed to the flanges. Since these components are substantially identical to the lower support 66 of the LNG storage container 60 according to the fourth embodiment of the present invention, a detailed description thereof will be omitted.

The heat insulation layer part 84 is installed in a space between the inner shell 81 and the outer shell 82 and is made of a heat insulator that reduces a heat transfer. In addition, the heat insulation layer part 84 may be constructed or made of a material such that a pressure equal to the internal pressure of the inner shell 81 is applied thereto. The pressure equal to the internal pressure of the inner shell 81 refers to not a strictly equal pressure but a similar pressure. The heat insulation layer part 84 and the inner shell 81 may be connected together by the connection passage (54 in FIG. 12) in order for pressure balance between the inside and the outside of the inner shell 81, like in the previous embodiment shown in FIG. 12. Since the connection passage 54 has been described in detail in the previous embodiment, further description thereof will be omitted.

The heat insulation layer part 84 may be made of a grain-type insulator that can pass through the metal core 83. Therefore, the grain-type heat insulation layer part 84 can be freely mixed uniformly and filled. Since no gap is formed between the inner shell 81 and the outer shell 82, the non-uniformity of the heat insulation layer part 84 may be prevented and the heat insulation performance may be improved.

Figure 22:
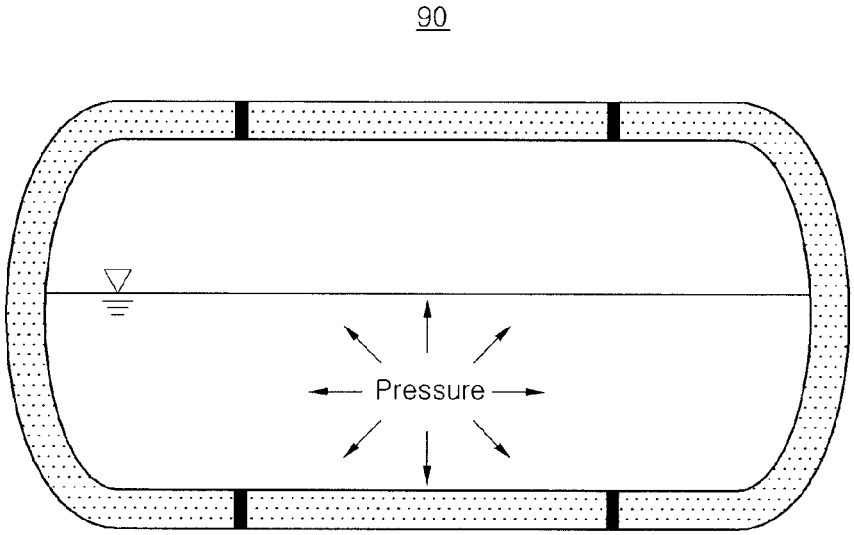
FIG. 22 is a sectional view showing an LNG storage container according to a seventh embodiment of the present invention.

As shown in FIG. 22, the LNG storage container 90 according to the present invention may be installed in a transverse direction. In this case, the lower support (86 in FIG. 20) may be omitted.

Figure 23:
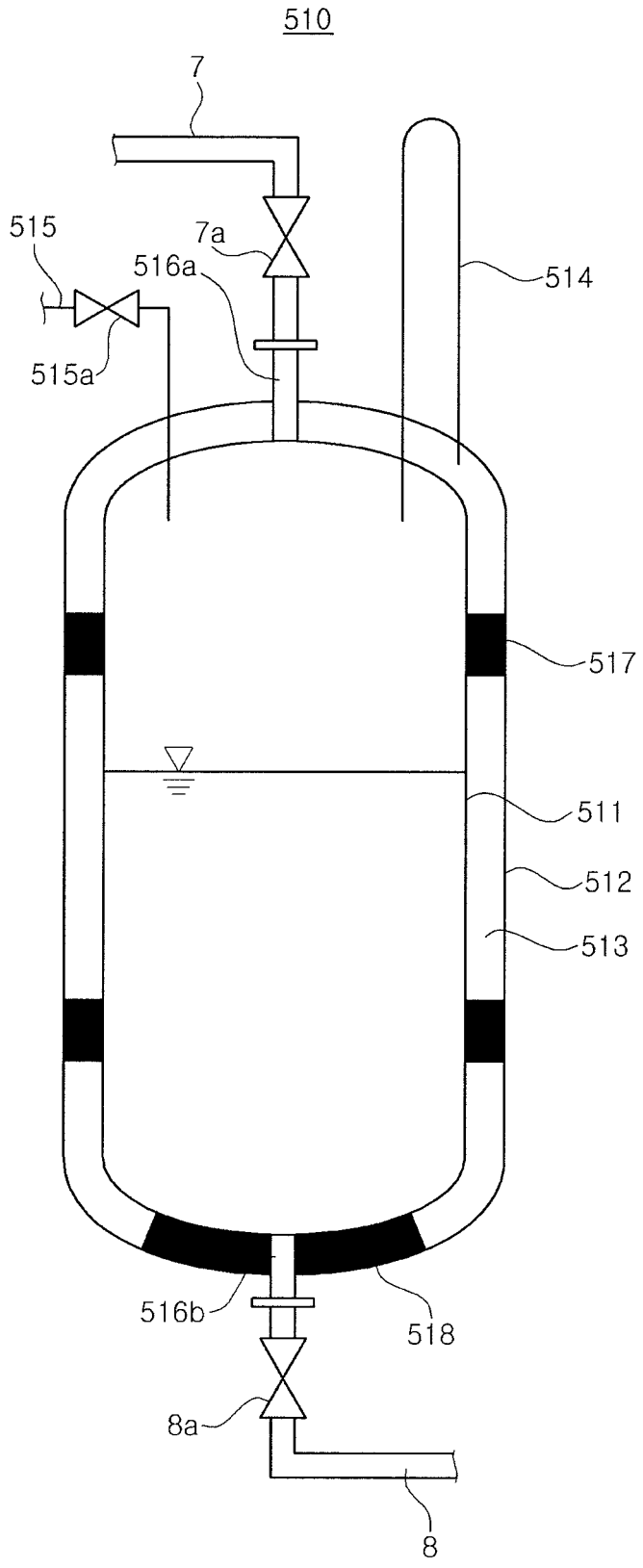
FIG. 23 is a sectional view showing an LNG storage container according to an eighth embodiment of the present invention.

FIG. 23 is a sectional view showing an LNG storage container according to an eighth embodiment of the present invention.

As shown in FIG. 23, the LNG storage container 510 according to the eighth embodiment of the present invention may include an inner shell 511 and an outer shell 512. The inner shell 511 stores LNG inside, and the outer shell 512 encloses the outside of the inner shell 511. The inner space of the inner shell 511 and the space between the inner shell 511 and the outer shell 512 are connected together by an equalizing line 514. In addition, a heat insulation layer part 513 may be installed between the inner shell 511 and the outer shell 512.

The inner shell 511 forms an LNG storage space. The inner shell 511 may be made of a metal that withstands a low temperature of the LNG. For example, the inner shell 511 may be made of a metal having excellent low temperature characteristic, such as aluminum, stainless steel, and 5-9% nickel steel. Like in this embodiment, the inner shell 511 may be formed in a tubular type. Also, the inner shell 511 may have various shapes, including a polyhedron.

Due to a connection passage (or an equalizing line to be described later), the pressure of the inner shell 511 becomes equal or similar to the pressure of the heat insulation layer part 513. Therefore, the outer shell 512 can withstand the pressure of the PLNG. Even though the inner shell 511 is manufactured to withstand a temperature of −120 to −95° C., the PLNG having the above pressure (13 to 25 bar) and temperature condition, for example, a pressure of 17 bar and a temperature of −115° C., can be stored by the inner shell 511 and the outer shell 512. The storage container 510 may be designed to satisfy the above pressure and temperature condition in such a state that the outer shell 512 and the heat insulation layer part 513 are assembled.

Since the pressures received by the inner shell and the outer shell can become substantially equal in the normal state by the connection passage (or the equalizing line), there is almost no difference. However, when the pressure of the storage container is rapidly lowered in the abnormal state (full vent), the pressure difference between the inside and outside of the inner shell can be 0.5 bar. Therefore, the inner shell can be made to withstand a pressure of about 0.5 bar.

A first exhaust line 515 may be connected to the upper inner space of the inner shell 511 and extend to the exterior. A first exhaust valve 515*a* is installed in the first exhaust line 515 to open and close a gas flow. Therefore, the first exhaust line 515 may exhaust gas from the inner space of the inner shell 511 to the exterior by opening the first exhaust valve 515*a*.

In addition, first and second connecting parts 516*a* and 516*b* may be connected to the upper inner space and the lower inner space of the inner shell 511, pass through the outer shell 512, and protrude to the exterior. Therefore, LNG may be loaded into the inside of the inner shell 511 through a loading line 7 connected to the first connecting part 516*a*, and LNG may be unloaded from the inside of the inner shell 511 through an unloading line 8 connected to the second connecting part 516*b*. Meanwhile, valves 7*a* and 8*b* may be installed in the loading line 7 and the unloading line 8, respectively.

The outer shell 512 encloses the outside of the inner shell 511 such that a space is formed between the outer shell 512 and the inner shell 511. The outer shell 512 is made of a steel material that withstands the internal pressure of the inner shell 511. The outer shell 512 shares the internal pressure applied to the inner shell 511. Therefore, an amount of a material used for the inner shell 511 may be reduced, leading to a reduction in the production costs of the LNG storage container 510.

Meanwhile, the inner shell 511 may be formed to have a thickness smaller than that of the outer shell 512. Hence, when manufacturing the storage container 510, the use of an expensive metal having excellent low temperature characteristic may be reduced.

The heat insulation layer part 513 is installed in a space between the inner shell 511 and the outer shell 512 and is made of a heat insulator that reduces a heat transfer. In addition, the heat insulation layer part 513 may be constructed or made of a material such that a pressure equal to the internal pressure of the inner shell 511 is applied thereto.

The equalizing line 514 connects the inner space of the inner shell 511 and the space between the inner shell 511 and the outer shell 512. As a result, the inner space and the outer space of the inner shell 511 are connected together. Hence, a difference between the internal pressure of the inner shell 511 and the pressure between the inner shell 511 and the outer shell 512 is minimized, thereby achieving the pressure balance. By minimizing the pressure difference between the inside and the outside of the inner shell 511, the pressure imposed on the inner shell 511 is reduced. Therefore, the thickness of the inner shell 511 may be reduced, and the use of an expensive metal having excellent low temperature characteristic may be reduced. Also, a structural defect caused by the internal pressure of the inner shell 511 may be prevented, and the storage container 510 having excellent durability may be provided.

As shown in FIG. 23, a portion of the equalizing line 514 may be exposed to the outside of the outer shell 512. In this configuration, the equalizing line 514 is formed to be high in a height direction with respect to the LNG stored in the storage container. Therefore, it is possible to prevent to the LNG stored in the inner shell 511 from overflowing into the outer space of the inner shell 511.

Therefore, when the storage container is loaded on the LNG carrier, it is possible to prevent the LNG from overflowing into the heat insulation layer part in the rolling of the carrier or the sloshing of the LNG.

As shown in FIG. 23, one end of the equalizing line 514 communicates with the inside of the inner shell 511, and the other end of the equalizing line 514 communicates with the space between the inner shell 511 and the outer shell 512. It is preferable that the other end of the equalizing line 514 is located at a ½ position of the width (h) of the space.

When the low-temperature natural gas, which may flow through the equalizing line 514, leaks into the heat insulation layer part, the influence of the natural gas on the outer shell 512 is minimized to thereby prevent brittle fracture of the outer shell 512. Also, the LNG leaks to the space at regular distances from the outer shell 512. Therefore, since the LNG leaks within the heat insulation layer part, it is somewhat possible to prevent the leaking LNG from becoming BOG by evaporation.

The equalizing line 514 may be exposed to the outside of the outer shell 512. In order to prevent heat loss through the equalizing line 514, it is preferable to perform an insulation treatment for heat insulation on the inside and/or the outside of the equalizing line 514. Also, since the low-temperature natural gas may flow into the equalizing line 514, it is preferable to use a metal having excellent low temperature characteristic, just like the inner shell 511.

In a portion where the equalizing line 514 is exposed to the outside of the outer shell 512, the equalizing line 514 and the outer shell 512 may be fixed by welding. In the outer shell (512) side of the welded portion, a separate equalizing line flange 519 is formed and welded with the equalizing line 514. In this case, since the equalizing line flange 519 contacts the equalizing line 514, it is preferable to use a metal having excellent low temperature characteristic, just like the equalizing line 514. The equalizing line flange 519 is fixed to the outer shell (512) side by welding.

A support 517 may be installed in a space between the inner shell 511 and the outer shell 512 in order to support the inner shell 511 and the outer shell 512. The support 517 structurally reinforces the inner shell 511 and the outer shell 512. The support 517 may be made of a metal that withstands a low temperature of the LNG. A single support 517 may be installed along lateral circumferences of the inner shell 511 and the outer shell 512, or a plurality of supports 517 may be installed to be spaced apart in a vertical direction on the lateral sides of the inner shell 511 and the outer shell 512 as in the case of this embodiment.

In addition, a lower support 518 may be installed in a lower space between the inner shell 511 and the outer shell 512 in order to support the inner shell 511 and the outer shell 512.

Like the support 63 shown in FIG. 18, the support 517 and the lower support 518 may include flanges and a web. The flanges are supported on the outer surface of the inner shell 511 and the inner surface of the outer shell 512. The web is provided between the flanges. The web may include a plurality of gratings, both of which are fixed to the flanges. A heat insulation member such as a glass fiber may be installed between the outer shell 512 and the flanges in order for blocking a heat transfer. In addition, like the metal core 83 shown in FIG. 23, the support 517 may be connected to the outer surface of the inner shell 511 and the inner surface of the outer shell 512 such that the inner shell 511 and the outer shell 512 are supported each other.

Figure 24:
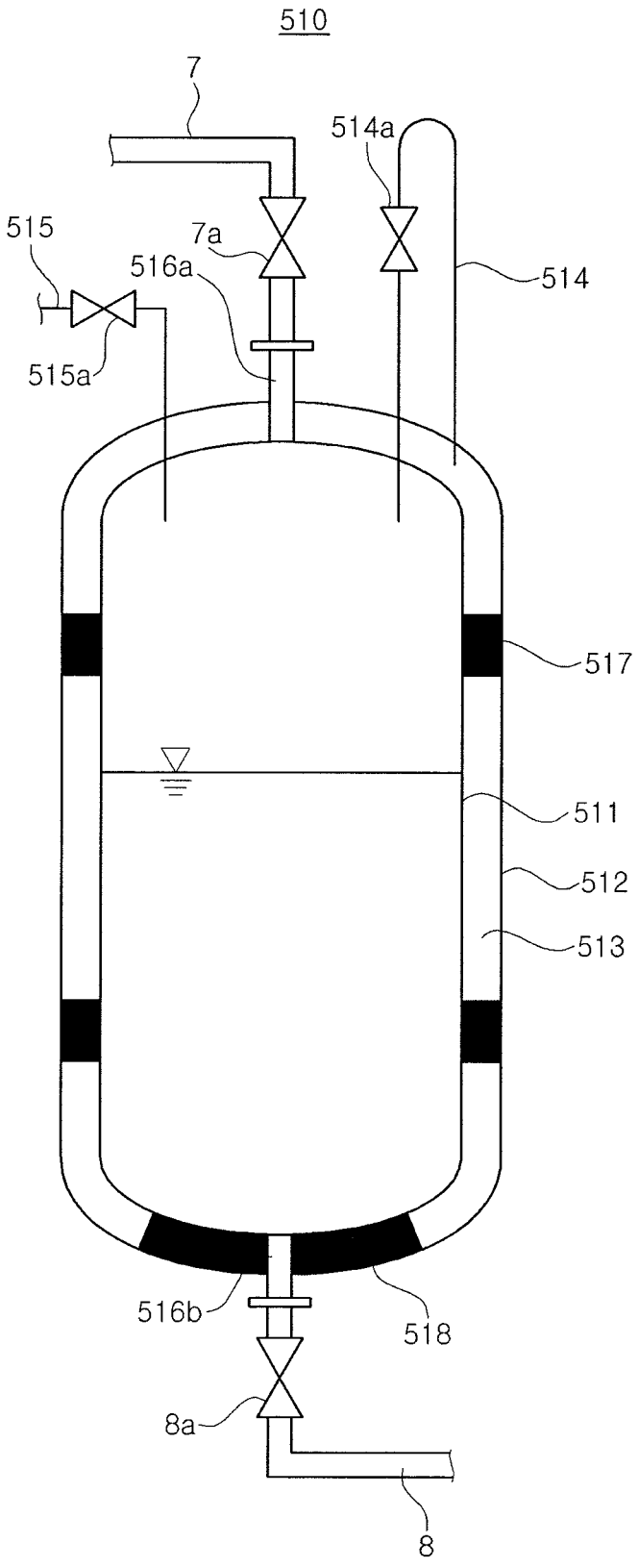
FIG. 24 is a configuration diagram showing an LNG storage container according to a ninth embodiment of the present invention.

As shown in FIG. 24, an LNG storage container according to a ninth embodiment of the present invention may include an on/off valve 514*a* for opening/closing a flow of a liquid, e.g., natural gas or BOG, to the equalizing line 514. Therefore, the liquid flow through the equalizing line 514 may be blocked by the on/off valve 514*a*, depending on a change in the position or posture of the storage container.

Figure 25:
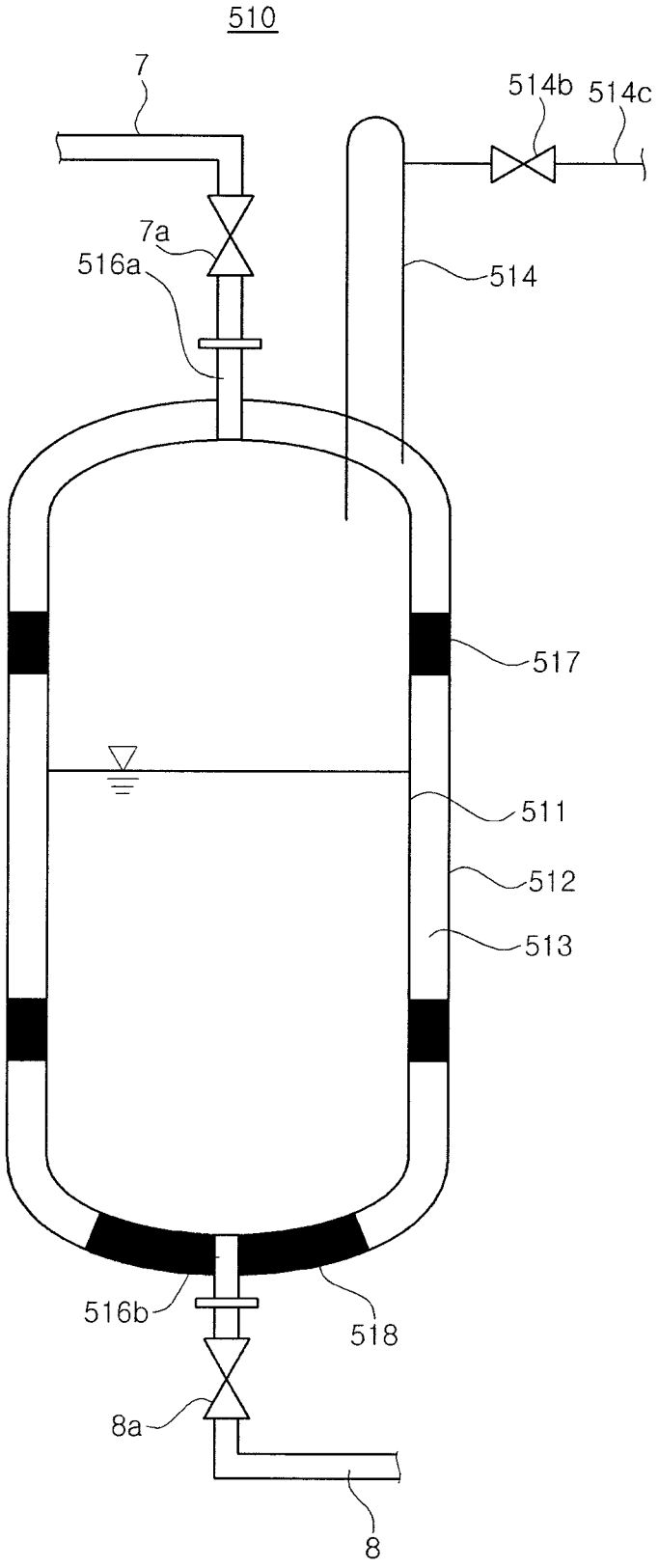
FIG. 25 is a configuration diagram showing an LNG storage container according to a tenth embodiment of the present invention.

As shown in FIG. 25, an LNG storage container according to a tenth embodiment of the present invention may include a second exhaust line 514*c* connected to the equalizing line 514. A second exhaust valve 514*b* may be installed in the second exhaust line 514*c*. Therefore, gas inside the inner shell 511 may be exhausted to the exterior through the equalizing line 514 and the second exhaust line 514*c* by opening the second exhaust valve 514*b*. As a result, it is possible to avoid a complex process for connecting the exhaust line to the inner shell 511. Also, the structural stability may be maintained, and the exhaust line may be easily installed.

Figure 26:
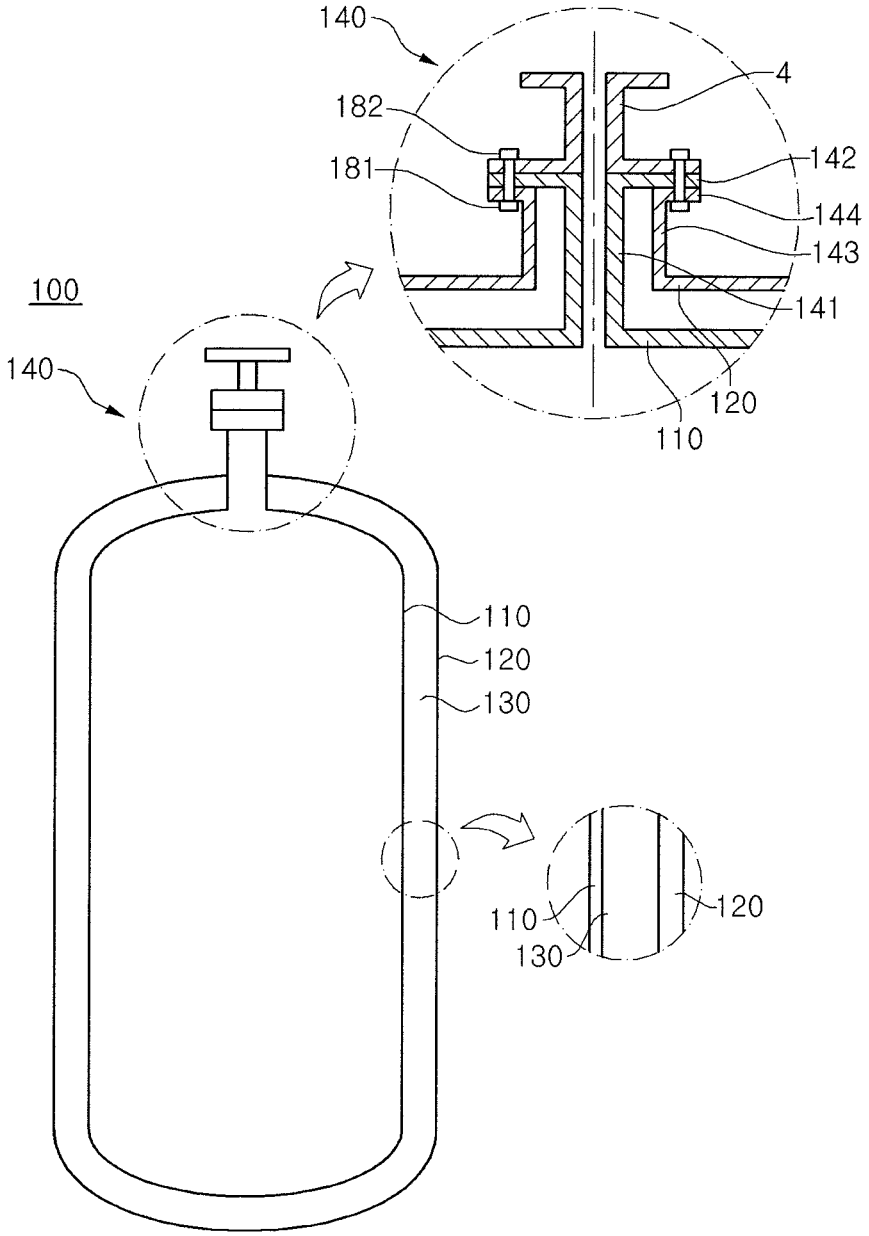
FIG. 26 is a sectional view showing an LNG storage container according to an eleventh embodiment of the present invention.

FIG. 26 is a sectional view showing an LNG storage container according to an eleventh embodiment of the present invention.

As shown in FIG. 26, the LNG storage container 100 according to the eleventh embodiment of the present invention may include an inner shell 110, an outer shell 120, and a heat insulation layer part 130. The inner shell 110 may be made of a metal that withstands a low temperature of the LNG. The outer shell 120 may enclose the outside of the inner shell 110. The heat insulation layer part 130 may be installed between the inner shell 110 and the outer shell 120 in order to reduce a heat transfer. A connecting part 140 may be provided at the inner shell 110 and the outer shell 120. The connecting part 140 may include a first flange 142 and a second flange 144. The first flange 142 is provided for flange connection in such a state that it is in contact with a valve 4 at an end of an injection part 141 extending outward from the inner shell 110. The second flange 144 is provided for flange connection to the valve 4 at an end of an extension part 143 extending from the outer shell 120 to enclose the injection part 141.

The inner shell 110 forms an LNG storage space. The inner shell 110 may be made of a metal that withstands a low temperature of the LNG. For example, the inner shell 110 may be made of a metal having excellent low temperature characteristic, such as aluminum, stainless steel, and 5-9% nickel steel. Like in this embodiment, the inner shell 110 may be formed in a tubular type. Also, the inner shell 110 may have various shapes, including a polyhedron.

The outer shell 120 encloses the outside of the inner shell 110 such that a space is formed between the outer shell 120 and the inner shell 110. The outer shell 120 is made of a steel material that withstands the internal pressure of the inner shell 110. The outer shell 120 shares the internal pressure applied to the inner shell 110. Therefore, an amount of a material used for the inner shell 110 may be reduced, leading to a reduction in the production costs of the LNG storage container 100.

Due to a connection passage, the pressure of the inner shell 110 becomes equal or similar to the pressure of the heat insulation layer part 130. Therefore, the outer shell 120 can withstand the pressure of the PLNG. Even though the inner shell 110 is manufactured to withstand a temperature of −120 to −95° C., the PLNG having the above pressure (13 to 25 bar) and temperature condition, for example, a pressure of 17 bar and a temperature of −115° C., can be stored by the inner shell 110 and the outer shell 120. The storage container 100 may be designed to satisfy the above pressure and temperature condition in such a state that the outer shell 120 and the heat insulation layer part 130 are assembled.

Meanwhile, the inner shell 110 may be made to have a thickness smaller than that of the outer shell 120. Therefore, when manufacturing the inner shell 110, the use of expensive metal having excellent low temperature characteristic may be reduced.

The heat insulation layer part 130 is installed in a space between the inner shell 110 and the outer shell 120 and is made of a heat insulator that reduces a heat transfer. In addition, the heat insulation layer part 130 may be constructed or made of a material such that a pressure equal to the internal pressure of the inner shell 110 is applied thereto. The pressure equal to the internal pressure of the inner shell 110 refers to not a strictly equal pressure but a similar pressure.

The heat insulation layer part 130 and the inside of the inner shell 110 may be connected together by a connection passage (not shown) in order for pressure balance between the inside and the outside of the inner shell 110. The connection passage may include various embodiments that can provide a passage, such as a hole or a pipe. For example, the connection passage may include a hole formed in the injection part 141 of the connecting part 140. The internal pressure of the inner shell 110 and the internal pressure of the heat insulation layer part 130 are balanced while the internal pressure of the inner shell 110 moves toward the heat insulation layer part 130 through the connection passage.

Since the pressures received by the inner shell and the outer shell can become substantially equal in the normal state by the connection passage, there is almost no difference. However, when the pressure of the storage container is rapidly lowered in the abnormal state (full vent), the pressure difference between the inside and outside of the inner shell can be 0.5 bar. Therefore, the inner shell can be made to withstand a pressure of about 0.5 bar.

When the first flange 142 directly contacts the valve 4, the connecting part 140 is flange-connected by a bolt 181 and a nut 182, such that the injection part 141 is connected to the passage of the valve 4. Since the injection part 141 and the first flange 142 directly contact the LNG, the connecting part 140 may be made of the same material as the inner shell 110. For example, the connecting part 140 may be made of a metal having excellent low temperature characteristic, such as aluminum, stainless steel, or 5-9% nickel steel.

In addition, like in this embodiment, the connecting part 140 may enclose the outside of the injection part 141, while being spaced apart. The second flange 144 may be flange-connected to the valve 4 by the bolt 181 and the nut 182, with the first flange 142 being interposed therebetween. The extension part 143 and the second flange 144 may be made of a steel material.

Figure 27:
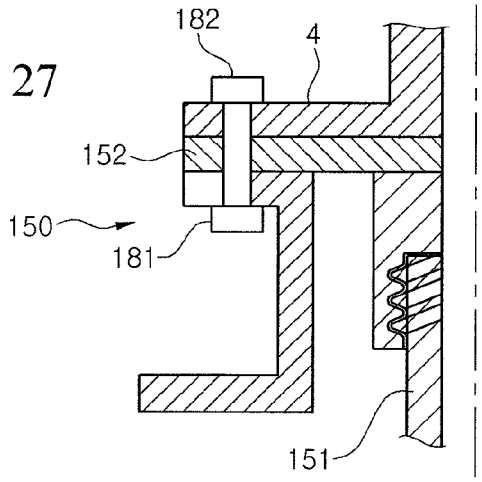
FIG. 27 is a sectional view showing another example of a connecting part of the LNG storage container according to the eleventh embodiment of the present invention.

As shown in FIG. 27, since the first flange 152 is screwed with the injection part 151, the connecting part 150 may form one body with the injection part 151.

Figure 28:
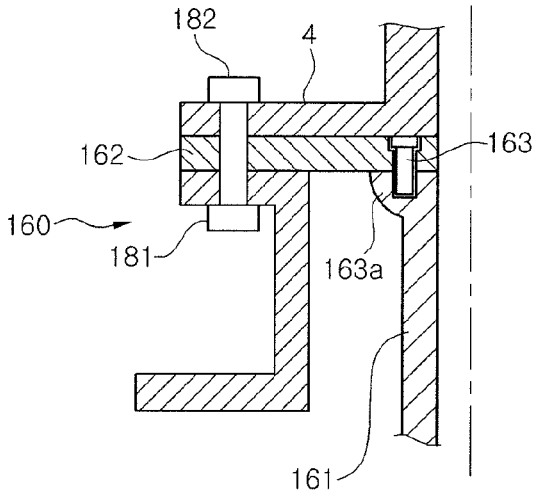
FIG. 28 is a sectional view showing another example of a connecting part of the LNG storage container according to the eleventh embodiment of the present invention.
Figure 28:
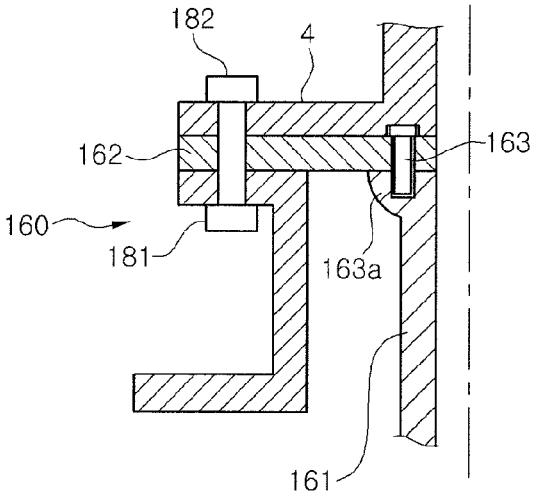

As shown in FIG. 28, the connecting part 160 may fix the first flange 162 to the injection part 161 by a coupling member 163 such as a bolt or a screw. The coupling member 163 may pass through the first flange 162 and be coupled in plurality to a coupling part 163*a*, which is formed at an end of the injection part 161, along a circumferential direction.

In the case that a bolt is used as the coupling member 163, as shown in FIG. 28(*a*), the coupling part 163*a* and the first flange 162 are female threaded, and the first flange 162 and the injection part 161*a* are coupled by a separate male threaded bolt. At this time, in order to avoid interference with adjacent members, a head of the male threaded bolt may be processed such that the bolt head is received in the first flange 162.

If the bolt head is formed to protrude outward from the first flange 162, as shown in FIG. 28(*b*), the interference between the bolt head and the adjacent members may be avoided by processing the valve 4 in a bolt head shape capable of receiving the bolt head and then coupling the valve 4 to the first flange 162.

Figure 29:
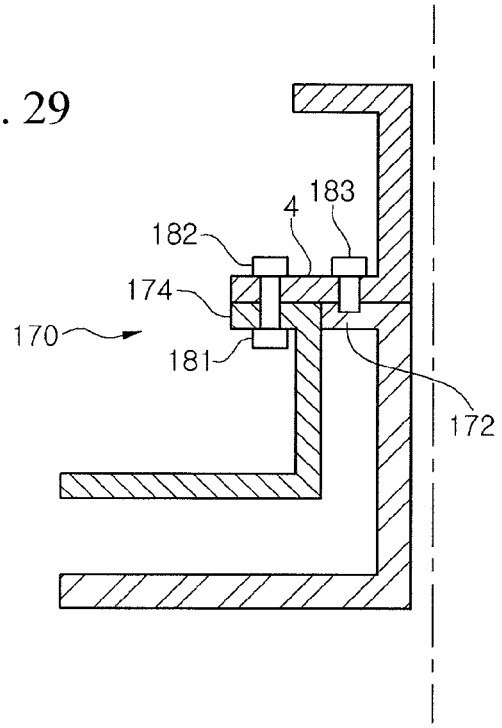
FIG. 29 is a sectional view showing another example of a connecting part of the LNG storage container according to the eleventh embodiment of the present invention.

As shown in FIG. 29, the connecting part 170 may be flange-connected by the bolt 181 and the nut 182 in such a state that the second flange 174 is positioned at an edge of the first flange 172 and connected with the valve 4. In this case, the first flange 172 may be connected to the valve 4 by only the bolt 183.

Figure 30:
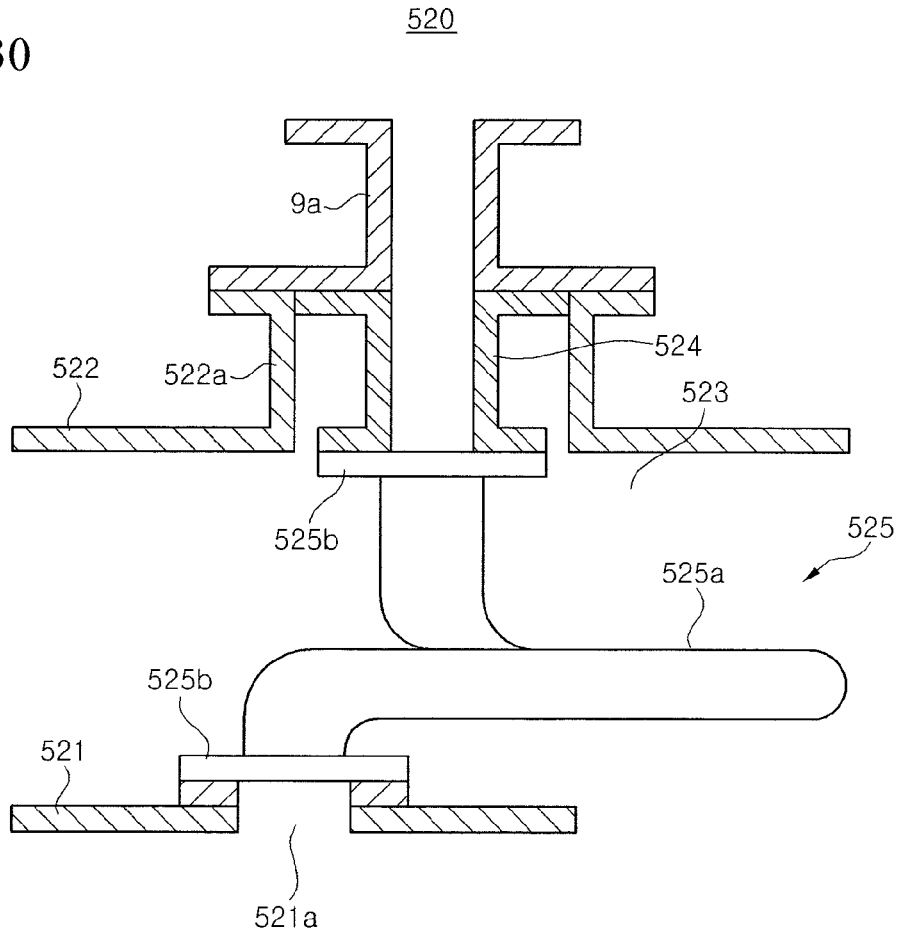
FIG. 30 is an enlarged view showing a main part of an LNG storage container according to a twelfth embodiment of the present invention.

FIG. 30 is an enlarged view showing a main part of an LNG storage container according to a twelfth embodiment of the present invention.

As shown in FIG. 30, the LNG storage container 520 according to the twelfth embodiment of the present invention may include an inner shell 521, an outer shell 522, a connecting part 524, a buffer part 525, and a heat insulation layer part 523. The inner shell 521 stores LNG inside, and the outer shell 522 encloses the outside of the inner shell 521. The connecting part 522 is connected to an external injection part 9*a* and protrudes toward the heat insulation layer part 523. The buffer part 524 buffers a thermal contraction between the connecting part 524 and the inner shell 521. The heat insulation layer part 523 is installed in a space between the inner shell 521 and the outer shell 522.

The inner shell 521 forms an LNG storage space. The inner shell 521 may be made of a metal that withstands a low temperature of the LNG. For example, the inner shell 521 may be made of a metal having excellent low temperature characteristic, such as aluminum, stainless steel, and 5-9% nickel steel. Like in this embodiment, the inner shell 521 may be formed in a tubular type. Also, the inner shell 521 may have various shapes, including a polyhedron.

The outer shell 522 encloses the outside of the inner shell 521 such that a space is formed between the outer shell 522 and the inner shell 521. The outer shell 522 is made of a steel material that withstands the internal pressure of the inner shell 521. The outer shell 522 shares the internal pressure applied to the inner shell 521. Therefore, an amount of a material used for the inner shell 521 may be reduced, leading to a reduction in the production costs of the LNG storage container 520.

Due to a connection passage, the pressure of the inner shell 521 becomes equal or similar to the pressure of the heat insulation layer part 523. Therefore, the outer shell 522 can withstand the pressure of the PLNG. Even though the inner shell 521 is manufactured to withstand a temperature of −120 to −95° C., the PLNG having the above pressure (13 to 25 bar) and temperature condition, for example, a pressure of 17 bar and a temperature of −115° C., can be stored by the inner shell 521 and the outer shell 522. The storage container 520 may be designed to satisfy the above pressure and temperature condition in such a state that the outer shell 522 and the heat insulation layer part 523 are assembled.

Since the pressures received by the inner shell and the outer shell can become substantially equal in the normal state by the connection passage, there is almost no difference. However, when the pressure of the storage container is rapidly lowered in the abnormal state (full vent), the pressure difference between the inside and outside of the inner shell can be 0.5 bar. Therefore, the inner shell can be made to withstand a pressure of about 0.5 bar.

Meanwhile, the inner shell 521 may be formed to have a thickness smaller than that of the outer shell 522. Hence, when manufacturing the storage container 520, the use of an expensive metal having excellent low temperature characteristic may be reduced.

The heat insulation layer part 523 is installed in a space between the inner shell 521 and the outer shell 522 and is made of a heat insulator that reduces a heat transfer. In addition, the heat insulation layer part 523 may be constructed or made of a material such that a pressure equal to the internal pressure of the inner shell 521 is applied thereto.

The connecting part 524 is provided to protrude from the inner shell 521. The connecting part 524 may be connected to an injection port 521*a*, through which the LNG is injected into the inner shell 521, and protrude outward. The connecting part 524 may be connected to an external injection part 9*a* for injecting the LNG into the inner shell 521. The connecting part 524 may be connected to the inner shell 521 through the buffer part 525. In this case, the outer shell 522 may include an extension part 522*a* that is provided at one side and encloses the connecting part 524. For example, an end of the extension part 522*a* may be connected to the external injection part 9*a* together with the connecting part 524.

The buffer part 525 is provided between the inner shell 521 and the connecting part 524 in order to buffer a thermal contraction. The buffer part 525 buffers a thermal contraction caused by heat generated from the inner shell 521, preventing load concentration on the connecting part 524.

In addition, like in this embodiment, the buffer part 525 may be provided in a pipe shape that forms joint parts 525*b*, both ends of which are connected to the injection port 521*a* and the connecting part 524 by a flange joint or the like. Furthermore, the buffer unit 525 may be integrally formed between the inner shell 521 and the connecting part 524.

Figure 31:
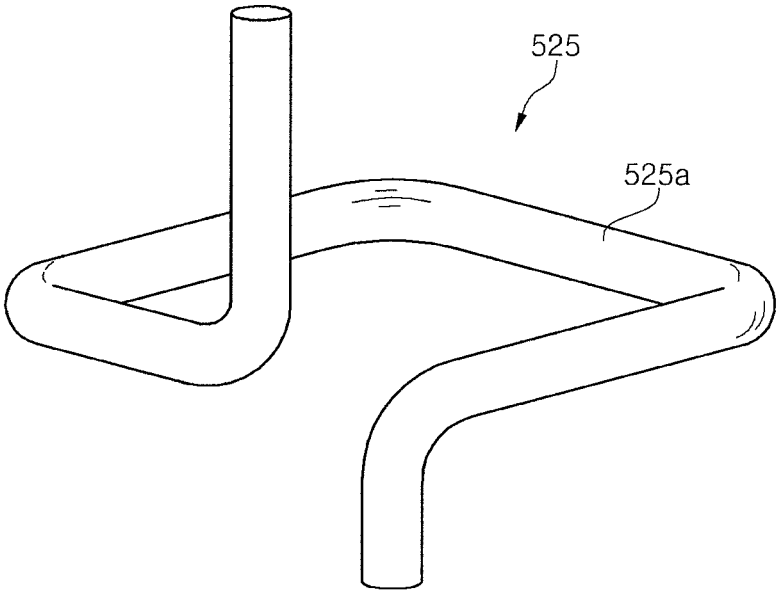
FIG. 31 is a perspective view showing a buffer part provided in the LNG storage container according to the twelfth embodiment of the present invention.

As shown in FIG. 31, the buffer part 525 may have a loop 525*a*. Like in this embodiment, the buffer part 525 may have a single loop 525*a* whose plane shape is polygonal, for example, rectangular.

Figure 32:
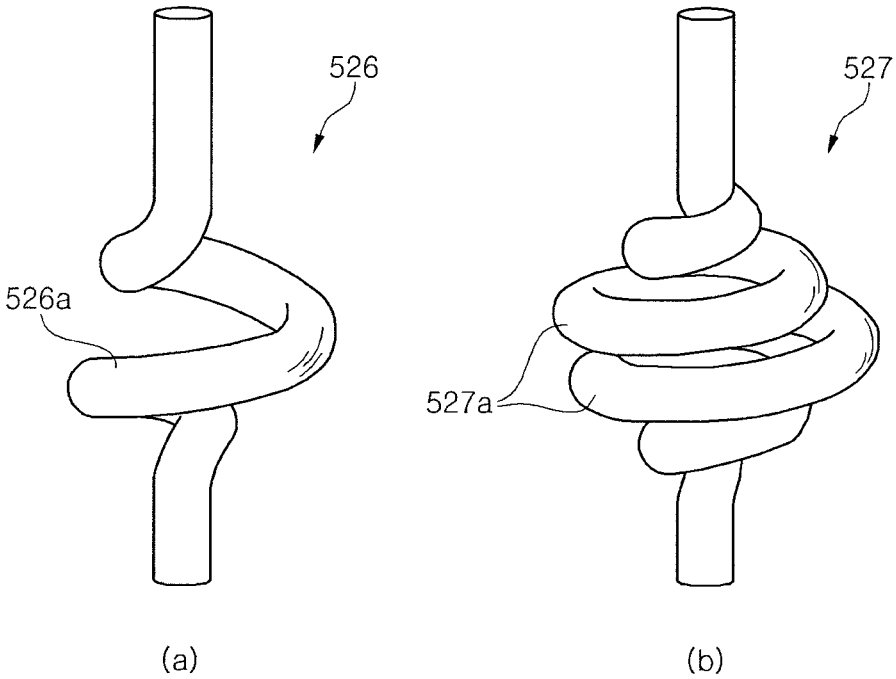
FIG. 32 is a perspective view showing another example of a buffer part provided in the LNG storage container according to the twelfth embodiment of the present invention.

As shown in FIG. 32(*a*), the buffer part 526 may have a single loop 526*a* whose plane shape is circular. As shown in FIG. 32(*b*), the buffer part 527 may have a coil shape with a plurality of loops 527*a*. The coil may have a rhombic shape whose width is gradually reduced from the center toward both ends thereof. Therefore, the loops 526*a* and 527*a* may reduce shocks caused by the thermal contraction of the inner shell 521.

Figure 33:
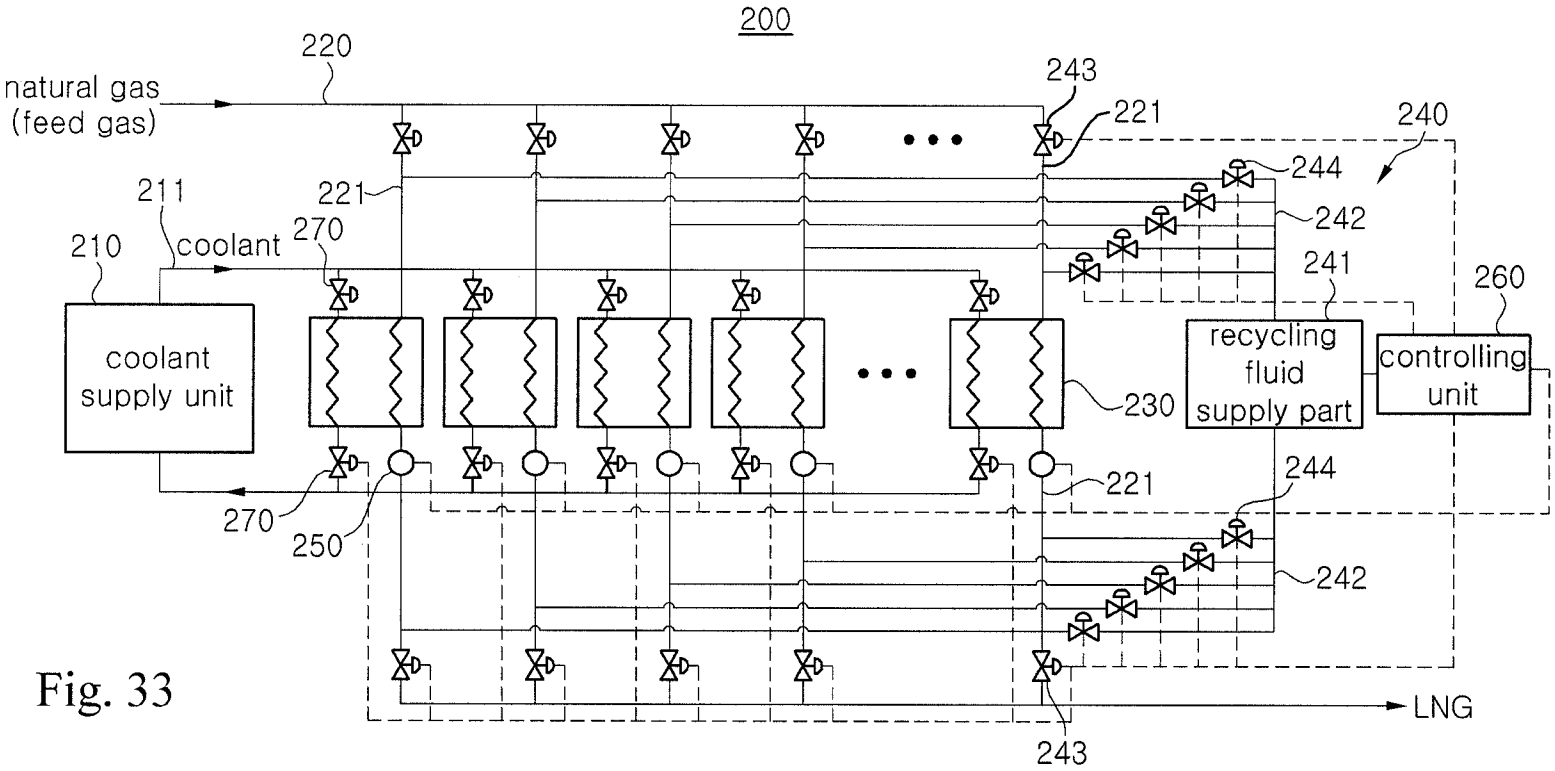
FIG. 33 is a configuration diagram showing an LNG production apparatus according to the present invention.

FIG. 33 is a configuration diagram showing an LNG production apparatus according to the present invention.

In the LNG production apparatus 200 according to the present invention, heat exchangers 230 are installed in a plurality of first branch lines 221 branched from a dehydrated natural gas supply line 220. The heat exchangers 230 cools the natural gas supplied through the first branch lines 221 by using a coolant supplied from a coolant supply unit 210. A recycling unit 240 supplies a recycling fluid, instead of natural gas, so as to remove carbon dioxide frozen at the heat exchangers 230.

The LNG production apparatus 200 according to the present invention may be used to produce LNG and PLNG pressurized at a predetermined pressure, for example, PLNG cooled at a pressure of 13 to 25 bar and a temperature of −120 to −95° C.

The coolant supply unit 210 supplies the heat exchangers 230 with a coolant for a heat exchange with the natural gas, so that the natural gas is liquefied at the heat exchangers 230.

The heat exchangers 230 are installed in the plurality of first branch lines 221 branched from the natural gas supply line 220 and are connected in parallel. The heat exchangers 230 cools the natural gas supplied from the supply line 220 by a heat exchange with the coolant supplied from the coolant supply unit 210. By making the total capacity exceed the LNG production, one or more of the heat exchangers 230 may be kept in a standby state when producing the LNG.

The number and capacity of the heat exchangers 230 may be determined, considering the LNG production of the entire plants. For example, when the heat exchanger 230 manages 20% of the total LNG production, ten heat exchangers are provided. In this case, five heat exchangers may be driven and the others may be kept in a standby state. This configuration may stop driving the heat exchangers where carbon dioxide is frozen, and may drive the heat exchangers having been in the standby state during the removal of the frozen carbon dioxide. Therefore, the total LNG production of the entire plants may be maintained constantly.

The recycling unit 240 selectively supplies the heat exchangers 230 with the recycling fluid for removing the frozen carbon dioxide, instead of the natural gas. In addition, the recycling unit 240 may include a recycling fluid supply part 241, recycling fluid lines 242, first valves 243, and second valves 244. The recycling fluid supply part 241 supplies the recycling fluid. The recycling lines 242 extend from the recycling fluid supply unit 241 and are connected to front ends and rear ends of the heat exchangers 230 on the first branch lines 221. The first valves 243 are installed at front ends and rear ends of positions connected to the recycling fluid lines 242 on the first branch lines 221. The second valves 244 are installed at front ends and rear ends of the heat exchangers 230 on the recycling fluid lines 242.

The recycling fluid supply part 241 may use high temperature air as the recycling fluid. By supplying the high temperature air to the heat exchangers 230 using a pressure or pumping force, the frozen carbon dioxide may be changed to a liquid or gaseous state and removed.

The LNG production apparatus 200 according to the present invention may further include sensing units 250 and a controlling unit 260. The sensing units 250 are installed to check the freezing of carbon dioxide at the heat exchangers 230 so as to control the supply of the recycling fluid to the heat exchangers 230. The control unit 260 receives sense signals from the sensing units 250 and controls the first and second valves 243 and 244 and the recycling fluid supply part 241.

The controlling unit 260 checks the heat exchangers 230 where the freezing of the carbon dioxide occurs, based on the sense signals output from the sensing units 250. In order to supply the recycling fluid to the heat exchangers 230, the controlling unit 260 closes the first valve 243 to cut off the supply of the natural gas to the heat exchangers 230. Then, the controlling unit 260 drives the recycling fluid supply part 241 and opens the second valve 244 to supply the recycling fluid to the heat exchangers 230. The carbon dioxide frozen at the heat exchangers 230 are liquefied or vaporized by the recycling fluid and then removed. Meanwhile, the controlling unit 260 may supply the recycling fluid to the heat exchangers 230 until a set time is up by a counting operation of a timer.

Like in this embodiment, the sensing units 250 may include flow meters that are installed at rear ends of the heat exchangers 230 on the first branch lines 221 and measure flow rate of LNG. Therefore, if a flow rate value measured by the sensing unit 250 is equal to or less than a set value, it may be determined that the freezing of carbon dioxide occurs in the corresponding heat exchanger 230.

In addition, the sensing units 250 may further include carbon dioxide meters. The carbon dioxide meters are installed on the first branch lines 221 and measure contents of carbon dioxide contained in gas at the front and rear ends of the heat exchangers 230. If a difference between the contents of carbon dioxide contained in the gas, which are measured at the front and rear ends of the heat exchanger 230, is equal to or larger than a set amount, it may be determined that the freezing of carbon dioxide occurs in the heat exchanger 230.

The LNG production apparatus 200 according to the present invention may further include third valves 270 installed at front and rear ends of the heat exchangers 230 on a coolant line 211 through which the coolant is supplied from the coolant supply unit 210 to the heat exchangers 230 so as to stop the operation of the heat exchangers 230 where the freezing of carbon dioxide occurs. The third valves 270 may be controlled by the controlling unit 260. For example, when it is determined through the sensing unit 260 that the freezing of carbon dioxide occurs in a certain heat exchanger, the controlling unit 260 stops the operation of the corresponding heat exchanger 230 by closing the third valves 270 disposed at the front and rear ends of the corresponding heat exchanger 230.

Figure 34:
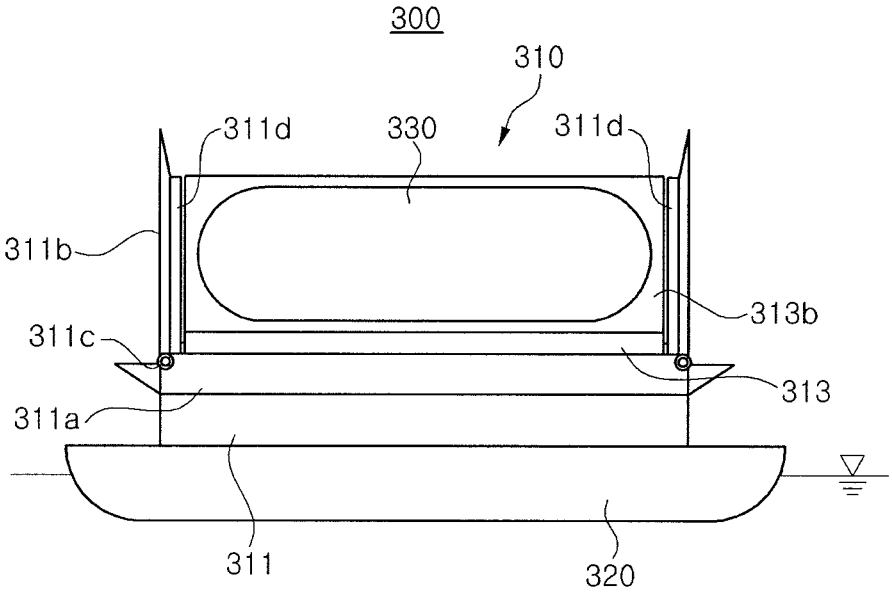
FIG. 34 is a side view showing a floating structure having a storage tank carrying apparatus according to the present invention.
Figure 35:
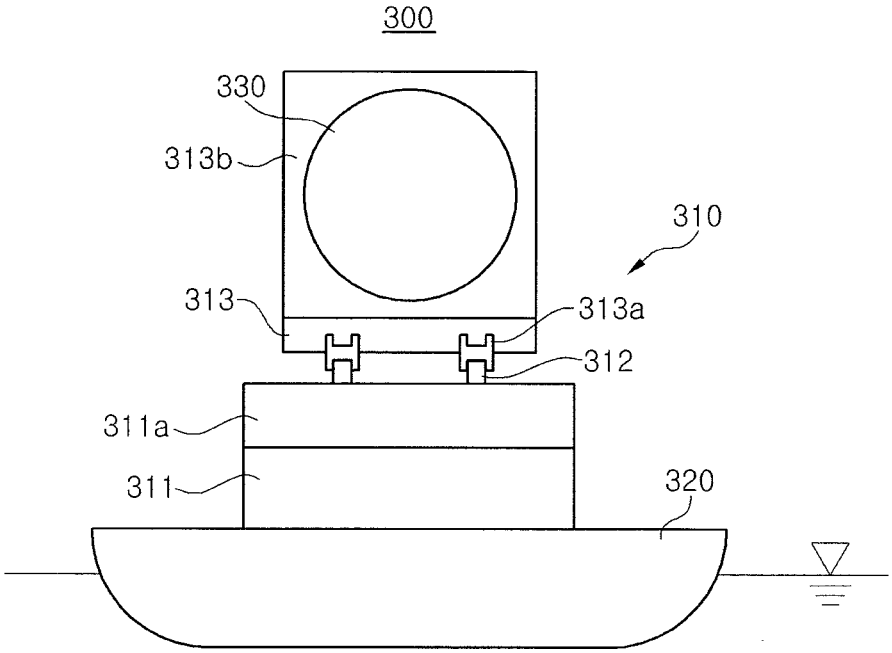
FIG. 35 is a front view showing the floating structure having the storage tank carrying apparatus according to the present invention.

FIGS. 34 and 35 are a side view and a front view, respectively, showing a floating structure having a storage tank carrying apparatus according to the present invention.

As shown in FIGS. 34 and 35, the floating structure 300 according to the present invention includes a storage tank carrying apparatus 310 and a floater 320. The floater is installed to float on the sea by buoyancy. The storage tank carrying apparatus 310 is installed on the floater 320. The floater 320 may be a barge type structure or a self-propelled vessel.

The storage tank carrying apparatus 310 according to the present invention includes a loading table 311*a* and a rail 312. The loading table 331*a* is lifted up and down by an elevating unit 311. The rail 312 is provided on the loading table 331*a* along a moving direction of a storage tank 330. The storage tank 330 is loaded into a cart 313. The cart 313 is installed to be movable along the rail 312.

In this manner, shock applied to the storage tank 330 may be reduced as compared to a case of carrying the storage tank by using a crane. In addition, if a plurality of storage tanks are connected, a large quantity of cargos may be transported over long distance. Therefore, it may be more efficient in terms of costs than other transportation means. Furthermore, it may be more effective to the transportation of a relatively heavy storage tank because it is not a method of lifting and moving the storage tank.

Although it is shown that the storage tank carrying apparatus 310 is installed on the floater 320, the present invention is not limited thereto. The storage tank carrying apparatus 310 may be fixed on the ground or may be installed on various transportation apparatuses.

The storage tank 330 may store LNG or PLNG pressurized at a predetermined pressure. The storage tank 330 may also store various cargos. Meanwhile, the PLNG may be natural gas liquefied at a pressure of 13 to 25 bar and a temperature of −120 to −95° C. In order to store such PLNG, the storage tank 330 may have a structure and be formed of a material that sufficiently withstands a low temperature and a high pressure.

In addition, the storage tank 330 may be manufactured in a dual structure such that it can store LNG or PLNG. As described above, a connection passage may be provided between the dual structure of the storage tank and the inside of the storage tank in order that the internal pressure of the dual structure is balanced with the internal pressure of the storage tank 330.

Since the pressures received by the inner shell and the outer shell can become substantially equal in the normal state by the connection passage, there is almost no difference. However, when the pressure of the storage container is rapidly lowered in the abnormal state (full vent), the pressure difference between the inside and outside of the inner shell can be 0.5 bar. Therefore, the inner shell can be made to withstand a pressure of about 0.5 bar.

Figure 36:
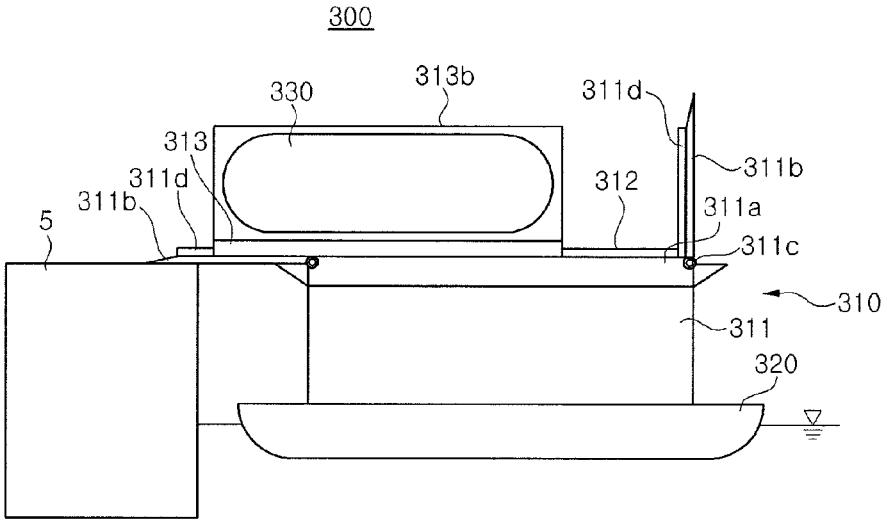
FIG. 36 is a side view explaining the operation of the floating structure having the storage tank carrying apparatus according to the present invention.

As shown in FIG. 36, the elevating unit 311 elevates the loading table 311*a* in a vertical direction. For example, the elevating unit 311 may elevate the loading table 311*a* from the floater 320 up to the top of a quay 5. A movable foothold 311*b* may be installed at one side or both sides of the loading table 311*a*. The movable foothold 311*b* provides a moving path of the cart 313 by being opened through the downward rotation around a hinge coupling part 311*c* disposed under the movable foothold 311*b*.

When the movable foothold 311*b* is folded upward, it restricts the movement of the cart 313. When the loading table 311*a* is elevated to the same height as the quay 5 by the elevating unit 311, the movable foothold 311*b* assists the connection between the quay 5 and the loading table 311*a*. Therefore, the cart 313 may be safely moved to the land. In addition, an auxiliary rail 311*d* connected to the rail 312 may be installed on a plane facing upward when the movable foothold 311*b* is unfolded downward.

In addition, the elevating unit 311 may use various structures and actuators in order for elevating the loading table 311*a*. For example, the loading table 311 may be movable vertically by a plurality of vertically expandable connecting members, which are slidably connected to a lower portion of the loading table 311*a*, or by a plurality of link members, which are linked to a lower portion of the loading table 311*a* and are vertically expandable according to a rotating direction. Also, the loading table 311*a* may be elevated by actuator such as a motor which provides a driving force for straight movement or a cylinder which is operated by a hydraulic pressure.

The rail 312 is installed on the loading table 311*a* according to a moving direction of the storage tank 330. A pair of rails 312 may be provided. The rails 312 may be arranged in parallel such that they have the same width as rails (not shown) of a train placed on the quay 5. Therefore, the cart 313 elevated up to the top of the quay 5 by the elevating unit 311 is moved along the rail 312 and is transferred to the rail of the quay 5. In this manner, the cart 313 may be moved over long distance by a land transportation means such as a train.

A plurality of wheels 313*a* which are movable along the rail 312 may be provided at the bottom of the cart 313. The storage tank 330 is loaded on the cart 313. In order for connection to other carts, a connecting part may be provided at one side or both sides of the cart 313. In addition, since the storage tank 330 is mounted on the cart 313, a tank protection pad 313*b* made of a steel material may be installed on the top surface of the cart 313 in order to protect the storage tank 330 from corrosion and external shock.

The cart 313 may be moved along the rail 312, for example by the driving of the winch connected to the cart through a cable. Also, the cart 313 may be moved along the rail 312 for itself by a transfer driving unit (not shown) that transmits a rotational force to some or all of the wheels 313*a*.

Figure 37:
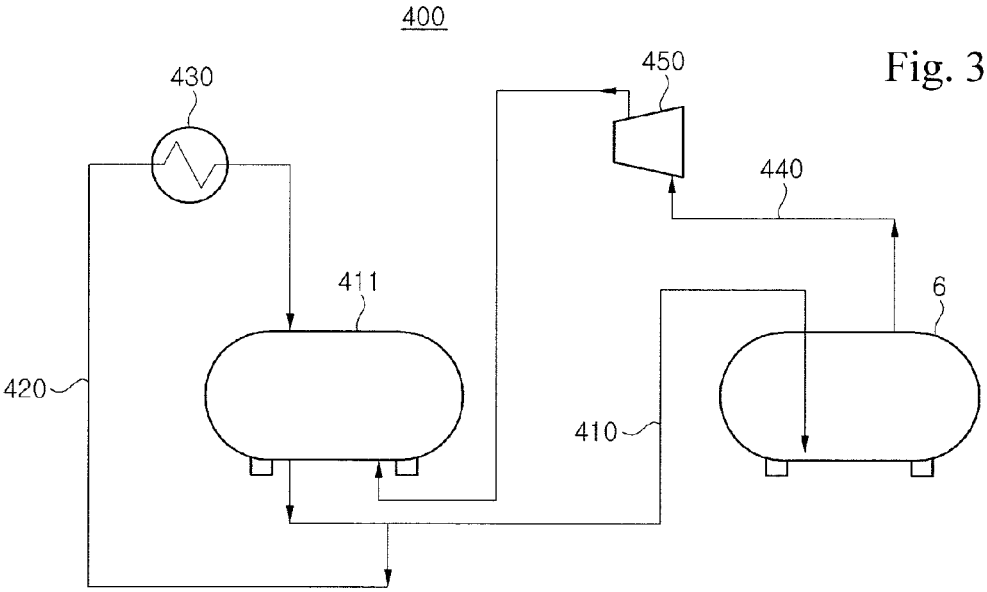
FIG. 37 is a configuration diagram showing a system for maintaining high pressure of a PLNG storage container according to the present invention.

FIG. 37 is a configuration diagram showing a system for maintaining high pressure of a PLNG storage container according to the present invention. As shown in FIG. 37, the system 400 for maintaining high pressure of a PLNG storage container according to the present invention may include an unloading line 410 that connects the storage container 411 to a storage tank 6 of a consumption place to thereby enabling the unloading of PLNG. The system 400 may further include a pressure compensation line 420 and a vaporizer 430 in order to vaporize some of the PLNG unloaded through the unloading line 410 and supply the vaporized PLNG to the storage container 411.

The unloading line 410 enables the unloading of the PLNG by connecting the storage container 411 to the storage tank 6 of the consumption place. Also, the unloading line 410 enables the unloading of the PLNG into the storage tank 6 by only the pressure of the PLNG stored in the storage container 411. By extending the unloading line 410 from the upper portion to the lower portion of the storage tank 6, the PLNG can be unloaded into the storage tank 6 by only the pressure of the PLNG stored in the storage container 411. Furthermore, the generation of BOG can be minimized.

If the unloading line 410 is connected to the lower portion of the storage tank 6 in order to further reduce an amount of BOG generated during the unloading, the PLNG is accumulated from the lower portion of the storage tank 6. In this case, the generation of BOG may be further reduced. However, the pressure may be insufficient to stably unload the PLNG into the storage tank 6 by only the pressure of the PLNG stored in the storage container 411. Therefore, it is necessary to additionally install a pump in the unloading line 410.

The pressure compensation line 420 is branched from the unloading line 410 and is connected to the storage container 411. A vaporizer 430 is installed in the pressure compensation line 420. In addition, the pressure consumption line 420 may be connected to the upper portion of the storage container 411. The reduction in the pressure of the storage container 411 is lowered by minimizing the liquefaction of the natural gas when the natural gas supplied to the storage container 411 through the pressure compensation line 420 contacts the PLNG stored in the storage container 411.

The vaporizer 430 vaporizes the PLNG supplied through the pressure compensation line 420 and supplies the vaporized PLNG to the storage container 411. Therefore, since the natural gas vaporized by the vaporizer 430 is supplied to the storage container 411 through the pressure compensation line 420, the internal pressure of the storage container 411 reduced during the initial unloading of the PLNG is increased. Therefore, the internal pressure of the storage container 411 is maintained at above a bubble point pressure of the LNG.

The system 400 for maintaining high pressure of the PLNG storage container according to the present invention may further include a BOG line 440 and a compressor 450 in order to collect BOG, which is generated in the storage tank of the consumption place, in the form of LNG.

The BOG line 440 is installed such that BOG generated from the storage tank 6 is supplied to the storage container 411. By connecting the BOG line 440 to the lower portion of the storage container 411, a temperature change is minimized and a collection rate of LNG is increased.

In addition, the compressor 450 is installed in the BOG line 440. The compressor 450 compresses the BOG supplied through the BOG line 440, and stores the compressed BOG in the storage container 411. Therefore, The BOG generated in the storage tank 6 during the unloading of the PLNG is supplied to the compressor 450 through the BOG line 440 and is pressurized at the compressor 450. Then, the pressurized BOG is condensed by injecting through the lower portion of the storage container 411. In this manner, the PLNG transportation efficiency can be improved.

Furthermore, in the system 400 for maintaining high pressure of the PLNG storage container according to the present invention, the vaporizer 430 and the compressor 450 can be complementary to each other. Therefore, if an amount of BOG generated in the storage tank 6 is insufficient to maintain the pressure of the storage container 411, the load of the vaporizer 430 is increased. If an amount of BOG is sufficient, the load of the vaporizer 430 is decreased.

Figure 38:
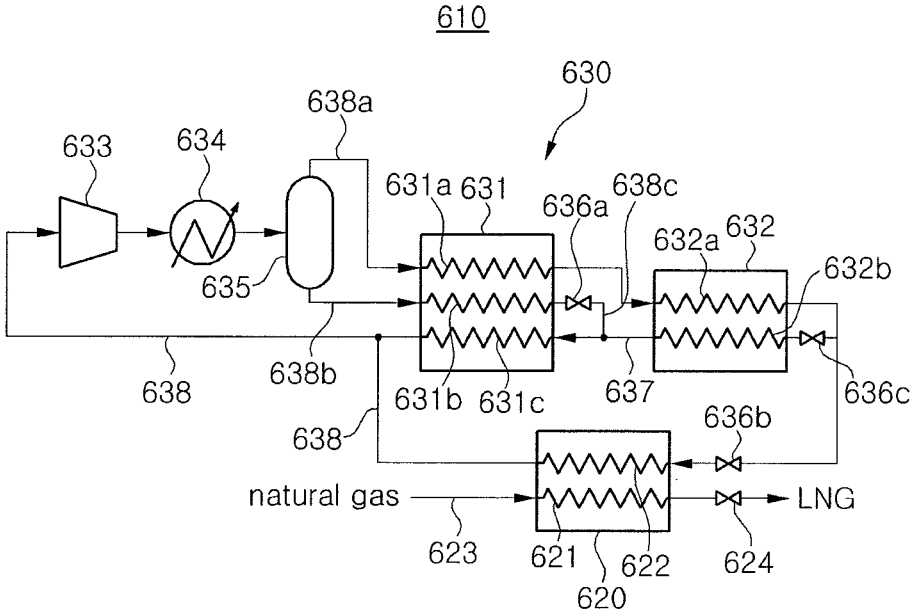
FIG. 38 is a configuration diagram showing a liquefaction apparatus having a separable heat exchanger according to a first embodiment of the present invention.

FIG. 38 is a configuration diagram showing a liquefaction apparatus having a separable heat exchanger according to a thirteenth embodiment of the present invention.

As shown in FIG. 38, a natural gas liquefaction apparatus 610 having a separable heat exchanger according to a thirteenth embodiment of the present invention liquefies natural gas through a heat exchange with a coolant by a liquefaction heat exchanger 620 made of a stainless steel, and cools a coolant by coolant heat exchangers 631 and 632 and supplies the coolant to the liquefaction heat exchanger 620.

The liquefaction heat exchanger 620 is supplied with the natural gas through the liquefaction line 623 and liquefies the natural gas through a heat exchange with a coolant. To this end, a liquefaction line 623 is connected to a first passage 621, and a coolant circulation line 638 is connected to a second passage 622. The natural gas and the coolant, which respectively pass through the first passage and the second passage, exchange heat with each other. The entire portions of the liquefaction heat exchanger 620 may be made of a stainless steel; however, the present invention is not limited thereto. Some parts or portions of the liquefaction heat exchanger 620, which contact the liquefied natural gas, like the first passage, or need to withstand a cryogenic temperature, may be made of a stainless steel. In the liquefaction line 623, an on/off valve 624 is installed at a rear end of the first passage 621.

Like in this embodiment, the coolant heat exchangers 631 and 632 may include a plurality of coolant heat exchangers, for example, first and second coolant heat exchangers 631 and 632. Also, the coolant heat exchangers 631 and 632 may be provided with a single coolant heat exchanger. The entire portions of the coolant heat exchangers 631 and 632 may be made of aluminum. Or, some parts or portions of the coolant heat exchangers 631 and 632, which need a heat transfer due to the contact with the coolant, may be made of aluminum. In addition, the coolant heat exchangers 631 and 632 may be included in a coolant cooling unit 630.

The coolant cooling unit 630 cools the coolant through the first and second coolant heat exchangers 631 and 632 and supplies the cooled coolant to the liquefaction heat exchanger 620. To this end, for example, the coolant exhausted from the liquefaction heat exchanger 620 is compressed and cooled by a compressor 633 and an after-cooler 634. The coolant having passed through the after-cooler 634 is separated into a gaseous coolant and a liquid coolant by a separator 635. The gaseous coolant is supplied to a first passage 631*a* of the first coolant heat exchanger 631 and a first passage 632*a* of the second coolant heat exchanger 632 by the gaseous line 638*a*. The liquid coolant is passed through a second passage 631*b* of the first coolant heat exchanger 631 by the liquid line 638*b* and is expanded to a low pressure by a first Joule-Thomson (J-T) valve 636*a* along a connection line 638*c*. Then, the liquid coolant is supplied to the compressor 633 through a third passage 631*c* of the first coolant heat exchanger 631, and is compressed by the compressor 633. Then, the subsequent processes are repeated.

In addition, the cooling unit 630 expands the high pressure coolant, which has passed through the first passage 632*a* of the second coolant heat exchanger 632, to a low pressure by a second J-T valve 636*b*, and supplies the coolant to the liquefaction heat exchanger 620. Also, the cooling unit 630 expands the coolant to a low pressure by a third J-T valve 636*c* through a coolant supply line 637, and supplies the compressor 633 with the coolant through the second passage 632*b* of the second coolant heat exchanger 632 and the third passage 631*c* of the first coolant heat exchanger 631.

The after-cooler 634 removes a compression heat of the coolant compressed by the compressor 633, and liquefies a part of the coolant. In addition, the first coolant heat exchanger 631 cools the unexpanded high-temperature coolant, which is supplied through the first and second passages 631*a* and 631*b*, by a heat exchange with the expanded low-temperature coolant, which is supplied through the third passage 631*c*. The second coolant heat exchanger 632 cools the unexpanded high-temperature coolant, which is supplied through the first passage 632*a*, by a heat exchange with the expanded low-temperature coolant, which is supplied through the second passage 632*b*.

Furthermore, the liquefaction heat exchanger 620 is supplied with the low-temperature coolant expanded through the first and second heat exchangers 631 and 632 and the second J-T valve 636*b*, and cools and liquefies the natural gas.

Figure 39:
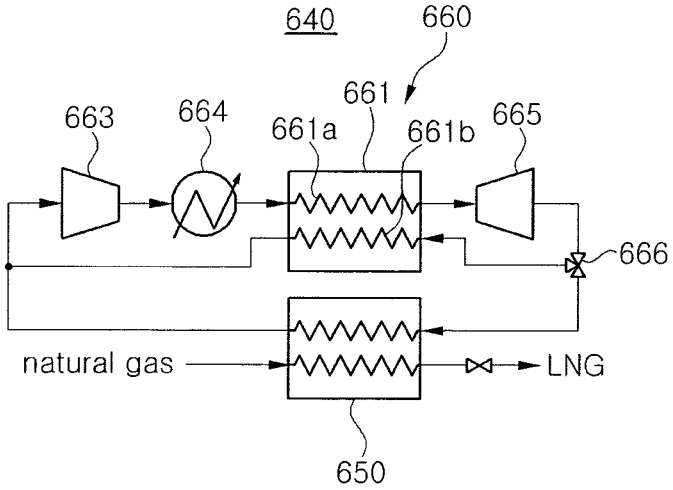
FIG. 39 is a configuration diagram showing a liquefaction apparatus having a separable heat exchanger according to a second embodiment of the present invention.

FIG. 39 is a configuration diagram showing a liquefaction apparatus having a separable heat exchanger according to a fourteenth embodiment of the present invention.

As shown in FIG. 39, like the natural gas liquefaction apparatus 610 according to the thirteenth embodiment of the present invention, a natural gas liquefaction apparatus 640 having a separable heat exchanger according to a fourteenth embodiment of the present invention includes a liquefaction heat exchanger 650 and a coolant cooling unit 660. The liquefaction heat exchanger 650 is supplied with natural gas and liquefies the natural gas through a heat exchange with a coolant. The liquefaction heat exchanger 650 is made of a stainless steel. The coolant cooling unit 660 cools the coolant by a coolant heat exchanger 661 and supplies the cooled coolant to the liquefaction heat exchanger 650. The coolant heat exchanger 661 is made of aluminum. Descriptions of the same configuration and parts as the natural gas liquefaction apparatus 610 according to the thirteenth embodiment of the present invention will be omitted, and a difference between the two liquefaction facilities will be described below.

The coolant cooling unit 660 compresses and cools the coolant, which is exhausted from the liquefaction heat exchanger 650, by a compressor 663 and an after-cooler 664, and supplies the coolant to a first passage 661*a* of the coolant heat exchanger 661. The coolant cooling unit 660 expands the coolant, which has passed through the first passage 661*a* of the coolant heat exchanger 661, by an expander 665, and supplies the coolant to the liquefaction heat exchanger 650 or supplies the coolant to the compressor 663 through the second passage 661*b* of the coolant heat exchanger 661, according to the manipulation of a flow distribution valve 666. Like in this embodiment, the flow distribution valve 666 may be a three-way valve. Also, the flow distribution valve 666 may be a plurality of two-way valves.

The coolant heat exchanger 661 cools the unexpanded high-temperature coolant, which is supplied through the first passage 661*a*, by a heat exchange with the expanded low-temperature coolant, which is supplied through the second passage 661*a*. In addition, the low-temperature coolant is distributed to the coolant heat exchanger 661 and the liquefaction heat exchanger 650 according to the manipulation of the flow distribution valve 666. The liquefaction heat exchanger 650 cools and liquefies the natural gas by the low-temperature coolant having passed through the coolant heat exchanger 661 and the expander 665.

Figure 40:
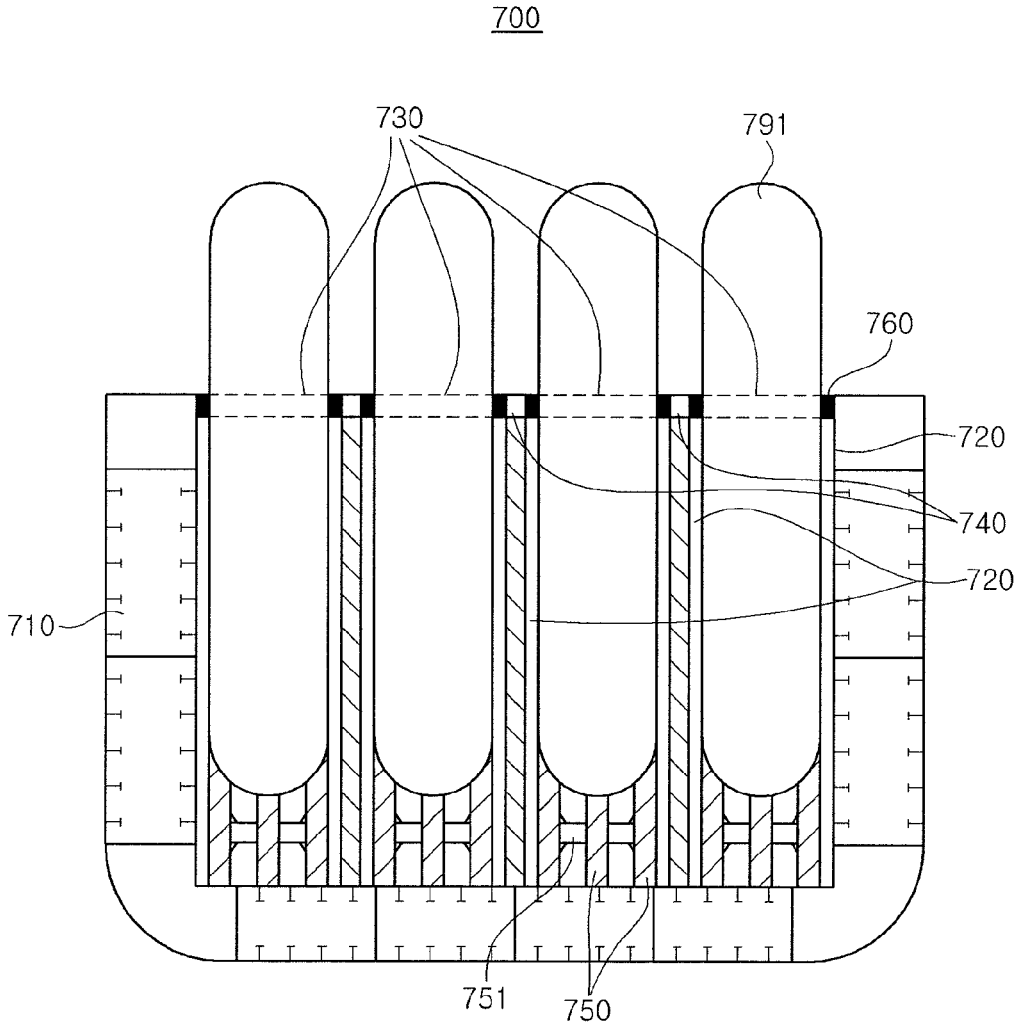
FIG. 40 is a front sectional view showing an LNG storage container carrier according to the present invention.
Figure 41:
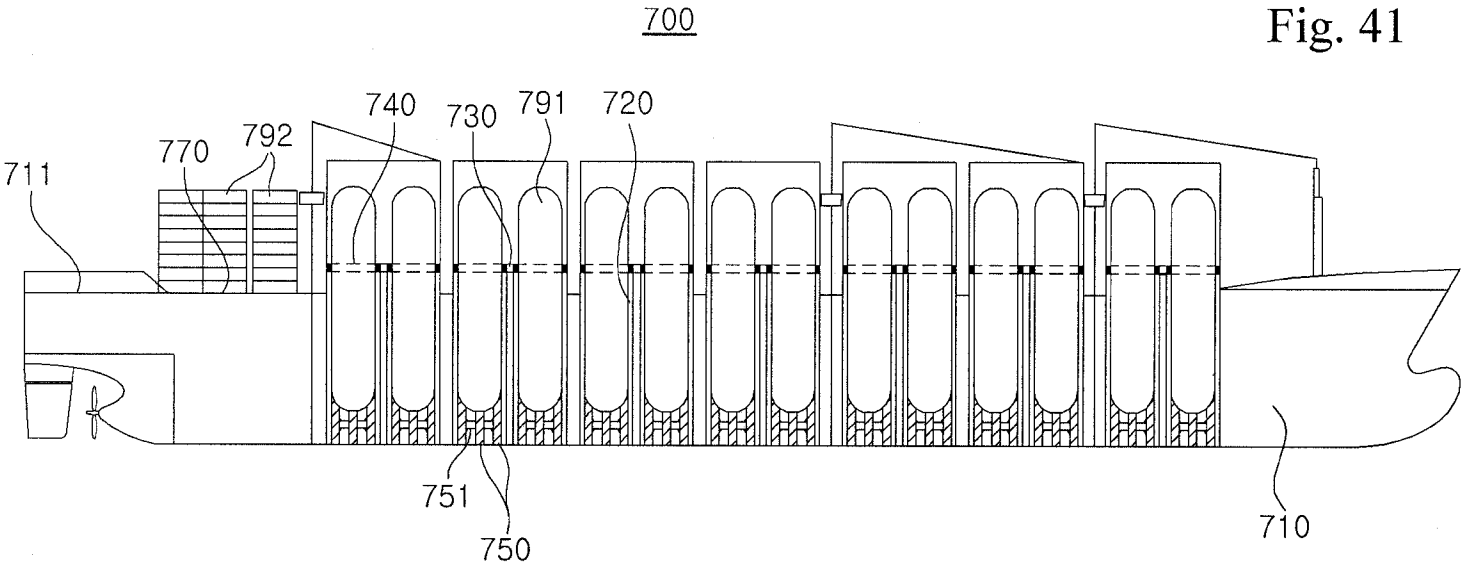
FIG. 41 is a side sectional view showing the LNG storage container carrier according to the present invention.

FIGS. 40 and 41 are a front sectional view and a side sectional view, respectively, showing an LNG storage tank carrier according to the present invention.

As shown in FIGS. 40 and 41, the LNG storage container carrier 700 according to the present invention is a vessel for transporting a storage container storing LNG. The LNG storage container carrier 700 includes a plurality of first and second upper supports 730 and 740. The first and second upper supports 730 and 740 are installed in a width direction and a length direction on cargo holds 720 provided in a hull 710, and partition the upper portions of the cargo holds 720 into a plurality of openings 721. Storage containers 791 inserted into the respective openings 721 are supported by the first and second supports 730 and 740.

Meanwhile, the storage containers 791 may store general LNG and LNG pressurized at a predetermined pressure, for example, PLNG having a pressure of 13 to 25 bar and a temperature of −120 to −95° C. To this end, a dual structure or a heat insulation member may be installed. The storage containers 791 may have various shapes, for example, a tubular shape or a cylindrical shape.

The cargo hold 720 may be provided in the hull 710 such that the upper portions thereof are opened. In this case, a hull of a container vessel may be used as the hull 710. Therefore, time and costs necessary for building the LNG storage container carrier 700 may be reduced.

Figure 42:
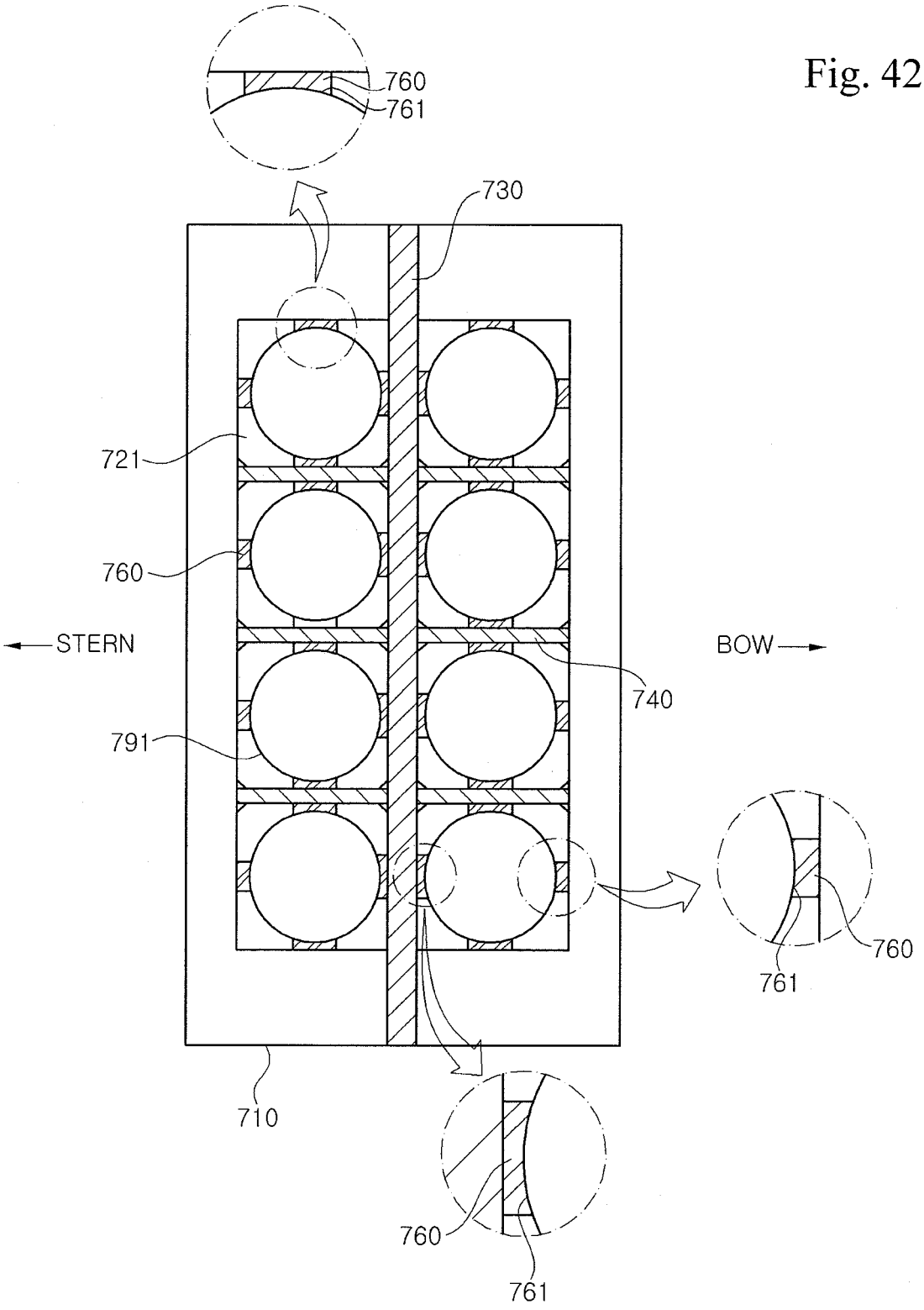
FIG. 42 is a plan view showing a main part of the LNG storage container carrier according to the present invention.

As shown in FIG. 42, the plurality of first and second upper supports 730 and 740 are installed on the cargo holds 720 in a width direction and a length direction, and partition the upper portions of the cargo holds 720 into the plurality of openings 721. The storage containers 791 are vertically inserted into the respective openings 721 and are supported. That is, the first upper supports 730 are installed on the cargo holds 720 in the width direction of the hull 710, while being spaced apart along the length direction of the hull 710. In addition, the second upper supports 740 are installed on the cargo holds 720 in the length direction of the hull 710, while being spaced apart along the width direction of the hull 710. Therefore, the first and second upper supports 730 and 740 form the plurality of openings 721 on the upper portions of the cargo holds 720 in a horizontal direction and a vertical direction. The first and second upper supports 730 and 740 may be fixed to the upper portions of the cargo holds 720 by welding or a coupling member such as a bolt.

In addition, a plurality of support blocks 760 for supporting the sides of the storage containers 791 may be installed in some or entire portions of the inner surfaces of the cargo holds 720 and the first and second upper supports 730 and 740. The support blocks 760 may be provided to support the front and rear and the left and right of the storage containers 791. The support blocks 760 may have support planes 761 with a curvature corresponding to a curvature of the outer surfaces of the storage containers 791, so as to stably support the storage containers 791.

A plurality of lower supports 750 may be installed under the cargo holds 720. The lower supports 750 support the bottoms of the storage containers 791 inserted into the openings 721. The lower supports 750 are vertically installed upwardly on the bottoms of the cargo holds 720. Reinforcement members 751 may be further installed to maintain the gaps between the lower supports 750. Meanwhile, the lower supports 750 and the reinforcement members 751 are paired at each storage container 791. A plurality of pairs of the lower supports 750 and the reinforcement members 751 may be installed on the bottoms of the cargo holds 720 in length and width directions, and support the lower portions of the storage containers 791.

In the case of a container vessel, the LNG storage container carrier 700 according to the present invention may use a stanchion or a lashing bridge, without modifications, in order to support the storage containers 791. In this case, the first and second upper supports 730 and 740 may be fixed and supported to the stanchion and the lashing bridge.

Therefore, if the conventional container vessel is modified slightly, it may be converted to enable the transportation of the storage containers 791. A container loading part 770 may be additionally provided on a deck 711 so as to transport container boxes 792 together with the storage containers 791.

Figure 43:
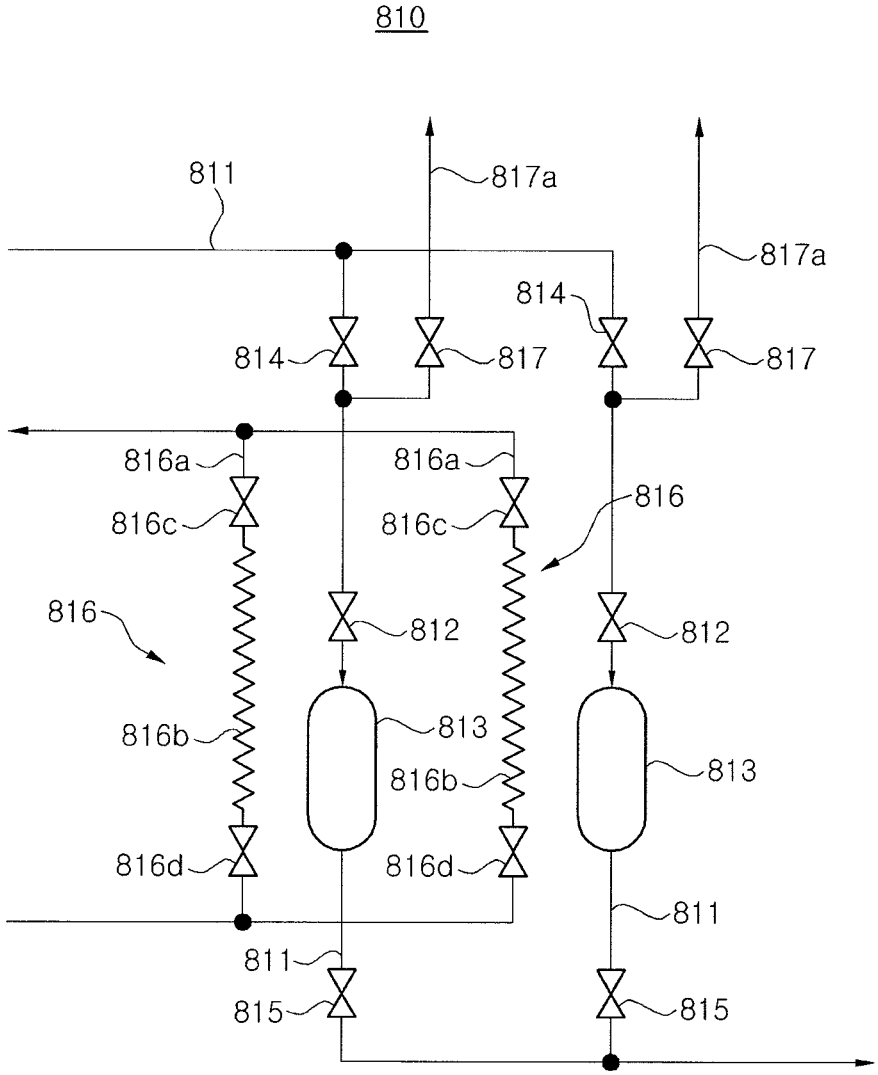
FIG. 43 is a configuration diagram showing a solidified carbon-dioxide removal system according to the present invention.

FIG. 43 is a configuration diagram showing a solidified carbon-dioxide removal system according to the present invention.

As shown in FIG. 43, the solidified carbon-dioxide removal system according to the present invention may include an expansion valve 812, a solidified carbon-dioxide filter 813, and a heating unit 816. The expansion valve 812 depressurizes high-pressure natural gas to a low pressure. The solidified carbon-dioxide filter 813 is installed at a rear end of the expansion valve 812 and filters frozen solidified carbon dioxide existing in the LNG. The heating unit 816 vaporizes the solidified carbon dioxide of the expansion valve 812 and the solidified carbon-dioxide filter 813. The solidified carbon dioxide is filtered from the liquefied natural gas by the solidified carbon-dioxide filter 813. Heat is supplied from the heating unit 816 in such a state that the supply of the natural gas to the expansion valve 812 and the solidified carbon-dioxide filter 813 is interrupted. Therefore, the solidified carbon dioxide may be gasified and removed.

The expansion valve 812 is installed in a supply line 811 through which the high-pressure natural gas is supplied. The expansion valve 812 liquefies the high-pressure natural gas by depressurizing the high-pressure natural gas supplied through the supply line 811.

The solidified carbon-dioxide filter 813 is installed at a rear end of the expansion valve 812 in the supply line 811. The solidified carbon-dioxide filter 813 filters the frozen solidified carbon dioxide from the LNG supplied from the expansion valve 812. To this end, a filter member for filtering carbon dioxide solid may be installed inside the solidified carbon-dioxide filter 813.

Furthermore, in the expansion valve 812 and the solidified carbon-dioxide filter 813, the supply of the high-pressure natural gas and the exhaust of the low-pressure LNG are opened and closed by first and second on/off valves 814 and 815. To this end, the first and second on/off valves 814 and 815 are installed at a front end of the expansion valve 812 and a rear end of the solidified carbon-dioxide filter 813 in the supply line 811, and open and close the natural gas flow. The first on/off valve 814 opens and closes the supply of the high-pressure natural gas to the expansion valve 812, and the second on/off valve 815 opens and closes the exhaust of the lower-pressure LNG discharged from the solidified carbon-dioxide filter 813.

The heating unit 816 supplies heat to vaporize the solidified carbon dioxide of the expansion valve 812 and the solidified carbon-dioxide filter 813. For example, the heating unit 816 may include a recycling heat exchanger 816*b* and fourth and fifth on/off valves 816*c* and 816*d*. The recycling heat exchanger 816*b* is installed in a heat medium line 816*a* through which a heat medium is circulated by a heat exchange with the expansion valve 812 and the solidified carbon-dioxide filter 813. The fourth and fifth on/off valves 816*c* and 816*d* are installed at a front end and a rear end of the recycling heat exchanger 816*b* in the heat medium line 816*a*.

A third on/off valve 817 is installed in an exhaust line 817*a* through which carbon dioxide recycled by the heating unit 816 is exhausted to the exterior.

The third on/off valve 817 is installed to open and close the exhaust of the carbon dioxide recycled by the heating unit 816 to the exhaust line 817*a*, which is branched from the supply line 811 between the first on/off valve 814 and the expansion valve 812.

In addition, the solidified carbon-dioxide removal system 810 according to the present invention may be provided in plurality. While some of the carbon-dioxide removal facilities 810 perform the filtering of the carbon dioxide, others may perform the recycling of the carbon dioxide, under the control of the first to third on/off valves 814, 815 and 817 and the heating unit 816. In this embodiment, two carbon-dioxide removal facilities 810 are provided. In this case, the two carbon-dioxide removal facilities 810 may alternately perform the filtering and recycling of the carbon dioxide. This operation will be described below with reference to the accompanying drawings.

Figure 44:
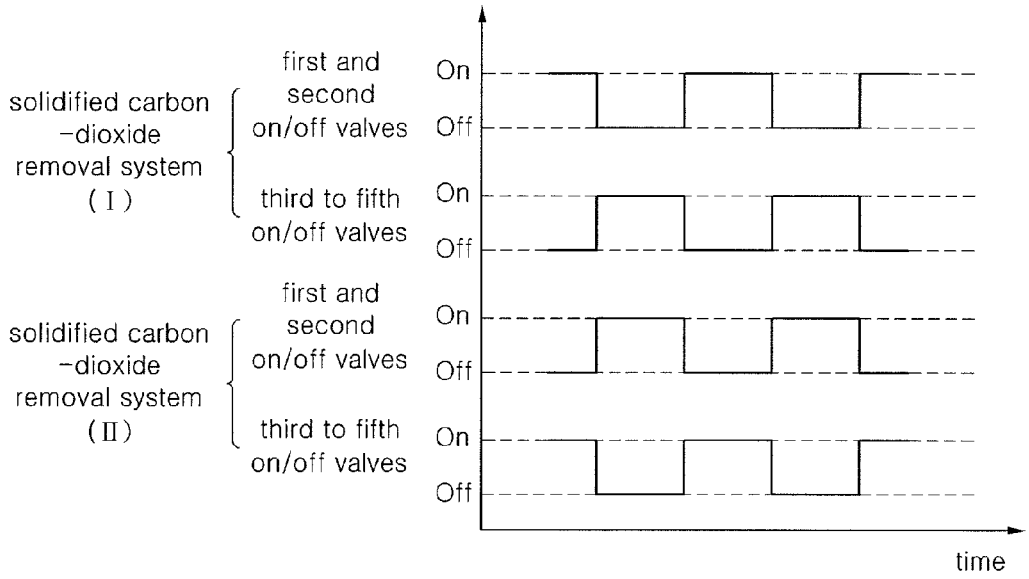
FIG. 44 is a view showing the operation of the solidified carbon-dioxide removal system according to the present invention.

As shown in FIG. 44, the following description will be focused on one of the solidified carbon-dioxide removal systems 810 according to the present invention. First, if the first and second on/off valves 814 and 815 are opened to supply high-pressure natural gas to the expansion valve 812 through the supply line 811 and expand the natural gas to a low pressure, the natural gas is cooled and the low-pressure LNG is supplied to the solidified carbon-dioxide filter 813. The solidified carbon dioxide included in the LNG by the cooling is filtered by the carbon-dioxide filter 813. If the solidified carbon dioxide is continuously accumulated in the solidified carbon-dioxide filter 813, the first and second on/off valves 814 and 815 are closed to stop supplying the high-pressure natural gas through the supply line 811. Then, the fourth and fifth on/off valves 816*c* and 816*d* are opened to circulate the heat medium to the recycling heat exchanger 816*b*. Therefore, heat is supplied to the expansion valve 812 and the solidified carbon-dioxide filter 813, and the solidified carbon dioxide is vaporized and recycled.

The third on/off valve 817 is opened to exhaust the recycled carbon dioxide to the exterior through the exhaust line 817*a*. Thus, the recycled carbon dioxide is removed.

In addition, in the case that the solidified carbon-dioxide removal system 810 according to the present invention is provided in plurality, for example, two carbon-dioxide removal facilities 810 are provided, one carbon-dioxide removal facility I performs the filtering of the solidified carbon dioxide from the natural gas, and the other II performs an opposite operation, under the control of the first to fifth on/off valves 814, 815, 817, 816*c* and 816*d*. In this manner, the solidified carbon dioxide is vaporized and recycled.

The solidified carbon-dioxide removal system 810 according to the present invention employs a low temperature method, among carbon dioxide removal methods, which solidifies carbon dioxide by freezing it and separates the carbon dioxide. Hence, it is possible to combine with a natural gas liquefaction process. In this case, a process of removing a pre-processed carbon dioxide is not needed, leading to a reduction of facilities. In addition, in the case that carbon dioxide is solidified when the natural gas rapidly supplied at high pressure is liquefied and it is expanded and depressurized to a low pressure by the expansion valve 812, the solidified carbon dioxide is filtered by a mechanical filter, that is, the solidified carbon-dioxide filter 813. In the case that the solidified carbon dioxide is continuously accumulated in the solidified carbon-dioxide filter 813, the solidified carbon-dioxide filters 813 are alternately used to recycle the carbon dioxide.

Figure 45:
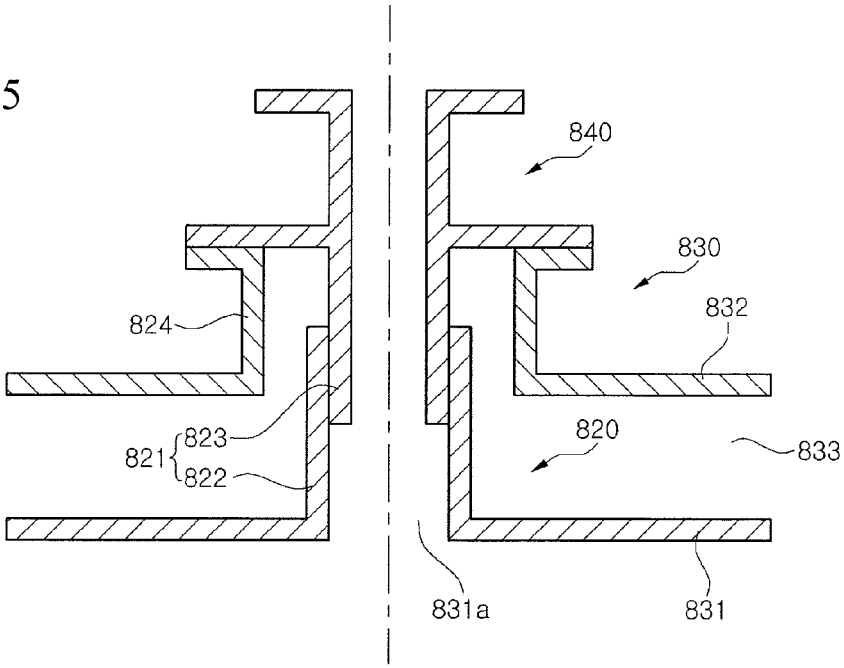
FIG. 45 is a sectional view showing the connection structure of the LNG storage container according to the present invention.

FIG. 45 is a sectional view showing the connection structure of the LNG storage container according to the present invention.

As shown in FIG. 45, the connection structure 820 of the LNG storage container according to the present invention is configured to connect the inner shell 831 of the LNG storage container 830 having a dual structure and the external injection 840. The inner shell 831 and the external injection part 840 are slidingly connected. To this end, a sliding connecting part 821 may be included in the connection structure 820.

The sliding connecting part 821 is provided at a connecting portion of the external injection part 840 and the inner shell 831. In order to buffer a thermal contraction or thermal expansion of the inner shell 831 or the outer shell 832, the sliding connecting part 821 may be provided such that the connecting portion of the external injection part 840 and the inner shell 831 are slidable along a direction in which a displacement occurs due to the thermal contraction or the thermal expansion.

Meanwhile, in the storage container 830, the inner shell 831 stores LNG inside, and the outer shell 832 encloses the outside of the inner shell 831. A heat insulation layer part 833 for reducing temperature influence may be installed in a space between the inner shell 831 and the outer shell 832.

The inner shell 831 may be made of a metal that withstands a low temperature of general LNG. For example, the inner shell 831 may be made of a metal having excellent low temperature characteristic, such as aluminum, stainless steel, and 5-9% nickel steel.

Like the previous embodiments, the outer shell 832 of the storage container 830 may be made of a steel material that withstands the internal pressure of the inner shell 831. The outer shell 832 may be constructed such that the same pressure is applied to the inside of the inner shell 831 and the space where the heat insulation layer part 833 is installed. For example, the internal pressure of the inner shell 831 and the pressure of the heat insulation layer part 833 may be equal or similar to each other by a connection passage connecting the inner shell 831 and the heat insulation layer part 833.

Therefore, the outer shell 832 can withstand the pressure of the PLNG stored in the inner shell 831. Even though the inner shell 831 is manufactured to withstand a temperature of −120 to −95° C., the PLNG having the above pressure (13 to 25 bar) and temperature condition, for example, a pressure of 17 bar and a temperature of −115° C., can be stored by the inner shell 831 and the outer shell 832.

Since the pressures received by the inner shell and the outer shell can become substantially equal in the normal state by the connection passage, there is almost no difference. However, when the pressure of the storage container is rapidly lowered in the abnormal state (full vent), the pressure difference between the inside and outside of the inner shell can be 0.5 bar. Therefore, the inner shell can be made to withstand a pressure of about 0.5 bar.

In addition, the storage container 830 may be designed to satisfy the above pressure and temperature condition in such a state that the outer shell 832 and the heat insulation layer part 833 are assembled.

In the sliding connecting part 821, the connecting part 822 extending outward from the injection port 831*a* formed in the inner shell 831 for the injection and exhaust of LNG may be fitted and slidingly connected to the connecting part 823 protruding from the external injection part 840.

Figure 46:
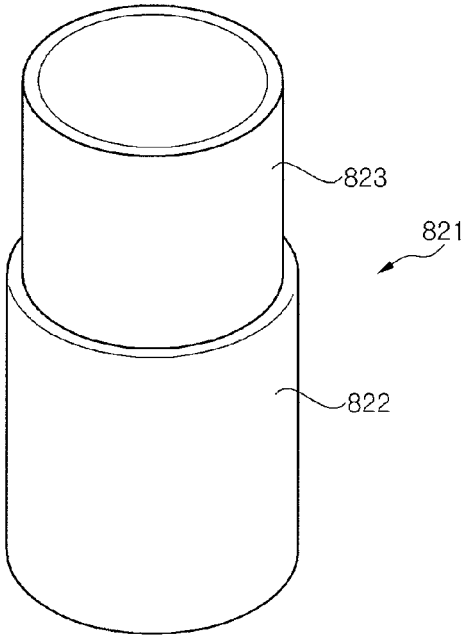
FIG. 46 is a perspective view showing the connection structure of the LNG storage container according to the present invention.

As shown in FIG. 46, the connecting part 822 and the connecting part 823 are formed in a circular pipe. One of the two connecting parts 822 and 823 is inserted into and slidingly connected to the other; however, the present invention is not limited thereto. The connecting parts 822 and 823 may be slidingly connected by forming their cross-sectional shapes corresponding to each other. The connecting parts 822 and 823 may have various cross-sectional shapes, for example, a rectangular shape.

The connection structure 820 of the LNG storage container according to the present invention may further include an extension part 824 extending from the outer shell 832 to enclose the sliding connecting part 821. Therefore, the extension part 824 may prevent the influence of the external environment, which has been caused by the external exposure of the sliding connecting part 821. In addition, since a flange is formed at an end of the extension part 824, the extension part 824 may be flange-connected to the external injection part 840. Therefore, the storage container 830 may be stably connected to the external injection part 840.

Meanwhile, like in this embodiment, the connecting part 823 provided in the external injection part 840 may be integrally formed with the external injection part 840. Unlike this case, the connecting part 823 may be provided separately from the external injection part 840 and be fixed to the extension part 824. At this time, the connecting part 823 may be flange-connected to the external injection part 840 or may be connected in various manners.

Figure 47:
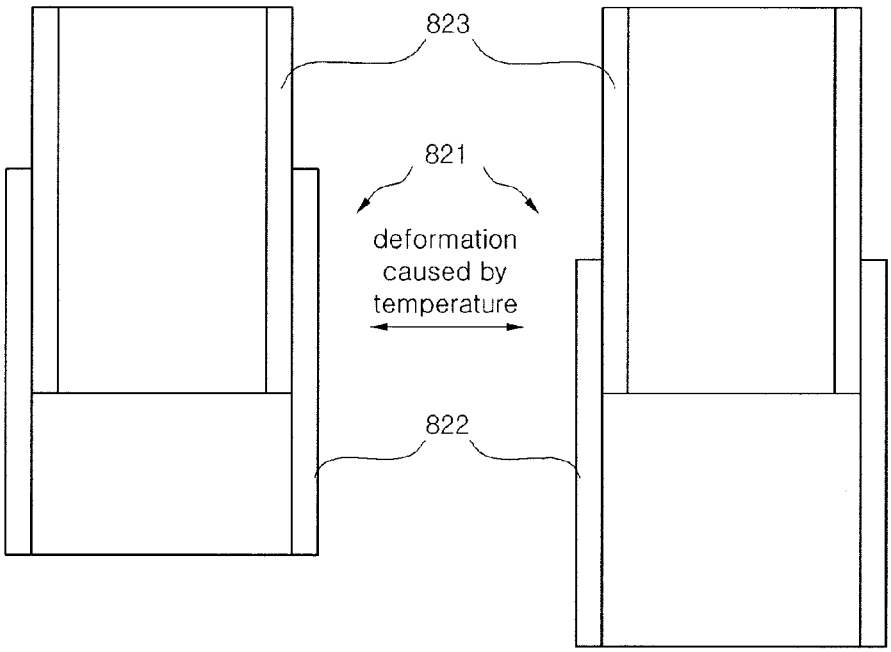
FIG. 47 is a sectional view explaining the operation of the connection structure of the LNG storage container according to the present invention.

As shown in FIG. 47, in the connection structure 820 of the LNG storage container according to the present invention, the connecting part 822 and the connecting part 823 are slidably moved, even though the load is concentrated on the connecting portion between the inner shell 831 and the external injection part 840 by the thermal contraction or the thermal expansion. Therefore, the thermal contraction or the thermal expansion is buffered, thereby preventing the load concentration on the inner shell 831 and the external injection part 840. As a result, damage caused by the thermal contraction or the thermal expansion may be prevented.

Furthermore, the natural gas inside the storage container 830 may be moved to the heat insulation layer part 833 through the gap (tolerance) of the sliding connecting part 821. Therefore, the pressure of the heat insulation layer part 833 may become equal or similar to the pressure of the inner shell 831. This can obtain an effect of substituting for the equalizing line as shown in FIGS. 23 to 25 for maintaining the equivalent pressure of the heat insulation layer part 833 and the inner shell 831.

According to the present invention, it is possible to efficiently store LNG or PLNG pressurized at a predetermined pressure and supply the LNG or PLNG to a consumption place, to reduce manufacturing costs by minimizing the use of a metal having excellent low temperature characteristic, to reduce a thickness of an inner container by minimizing a difference between the internal pressure and external pressure of the inner container, thereby manufacturing the container at low cost, to satisfy consumer's various demands, and to ensure diversity in kinds and sizes of container carriers.

Furthermore, it is possible to endure various utilizations according to characteristics of cargos, such as pre-processed natural gas, non-pre-processed natural gas, and refined natural gas. Due to the reduction of the liquefaction process, equipment costs and processing costs may be reduced. Sloshing load, which may occur during transportation of liquid goods, is reduced or negligible.

Moreover, the generation of BOG by high-temperature external air may be reduced, and the influence by low-temperature external air may be minimized, leading to a reduction in manufacturing costs.

Figure 48:
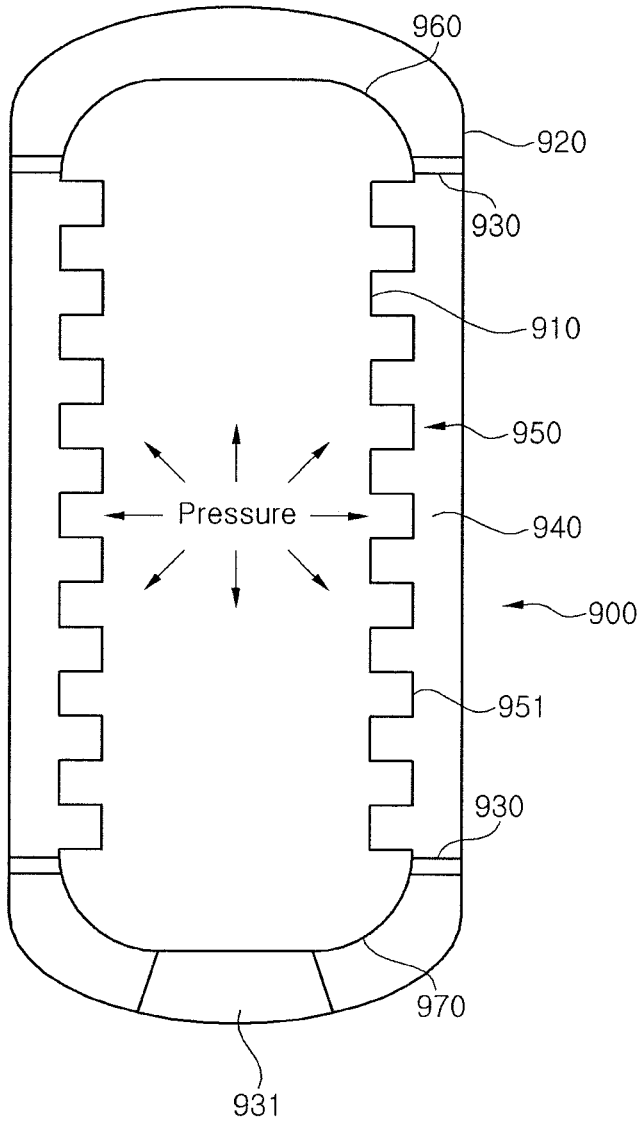
FIG. 48 is a diagram schematically showing the LNG storage container according to the present invention.
Figure 49:
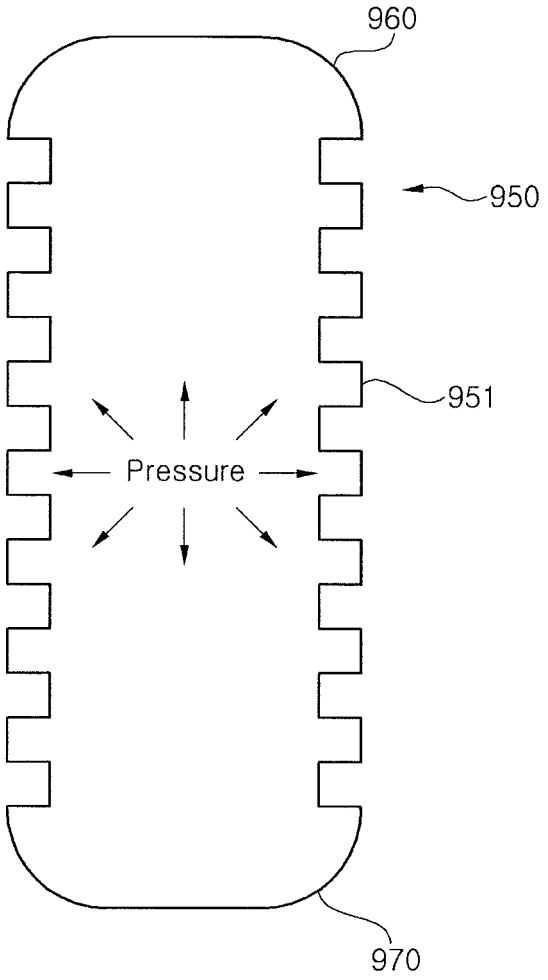
FIG. 49 is a diagram schematically showing a structure of an inner shell of the LNG storage container according to the present invention.
Figure 50:
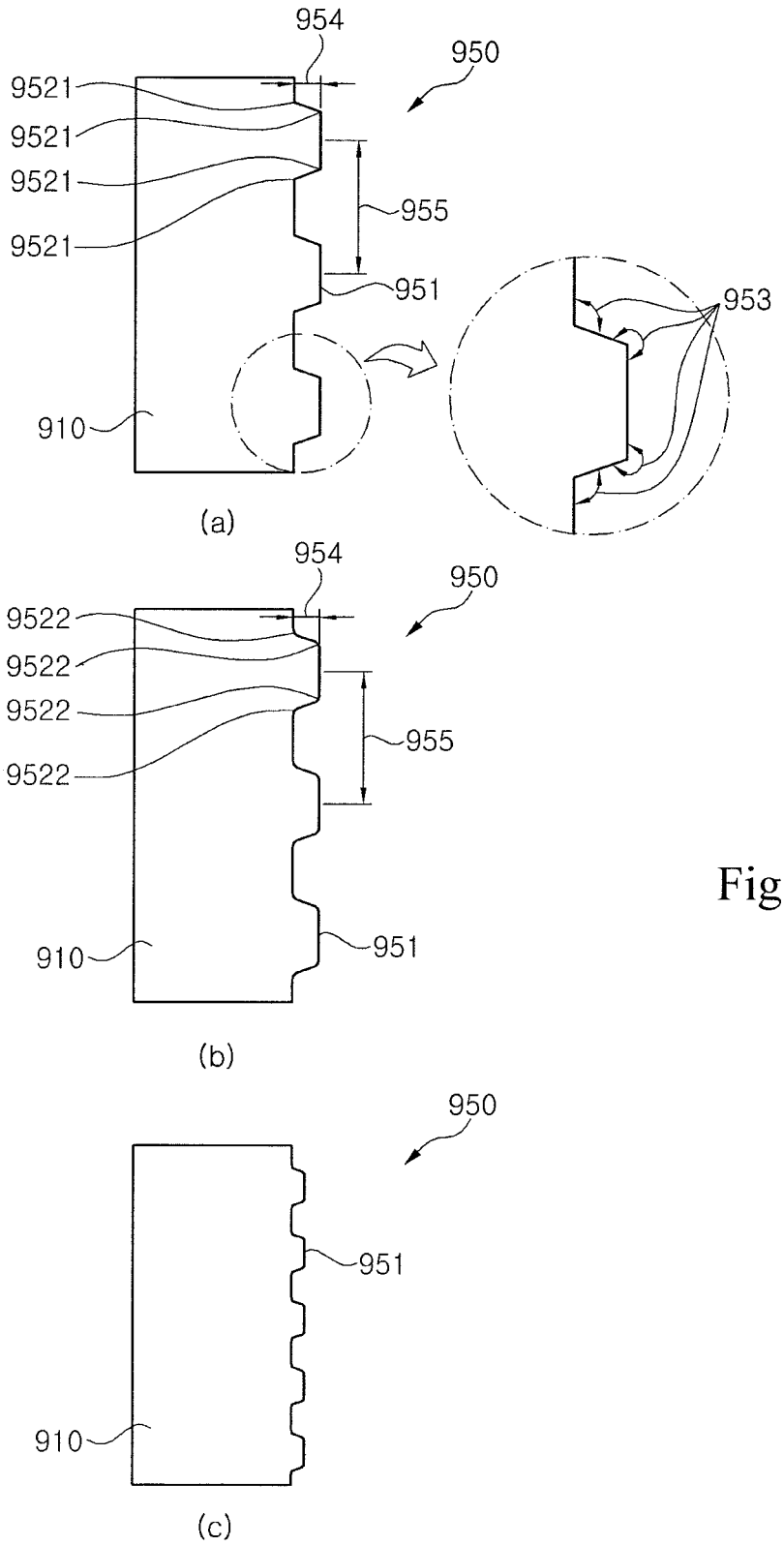
FIG. 50 is a diagram showing various structures of the inner shell of the LNG storage container according to the present invention.
Figure 51:
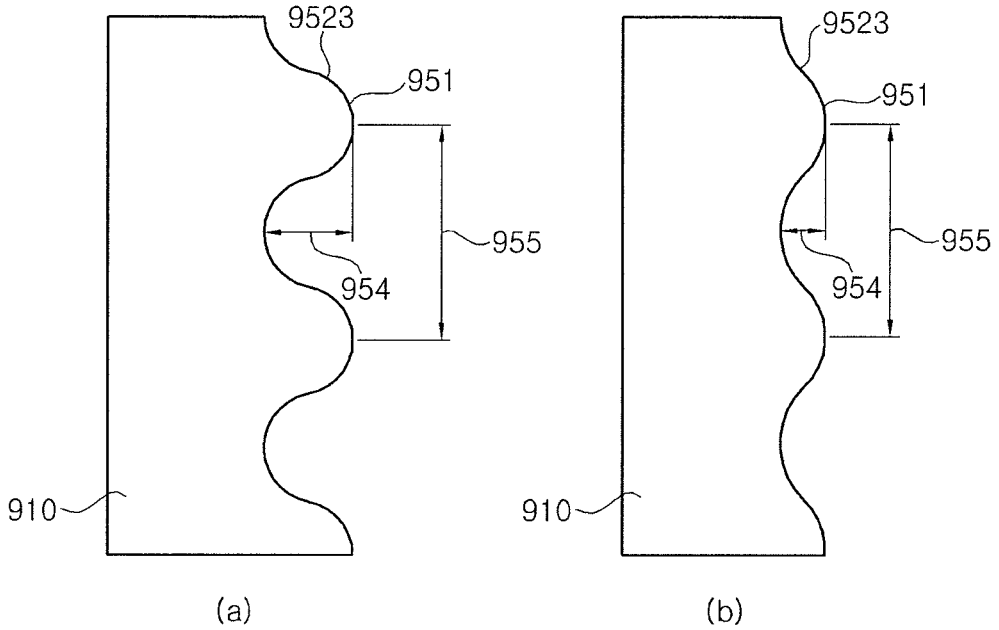
FIG. 51 is a diagram showing various structures of the inner shell of the LNG storage container according to the present invention.
Figure 52:
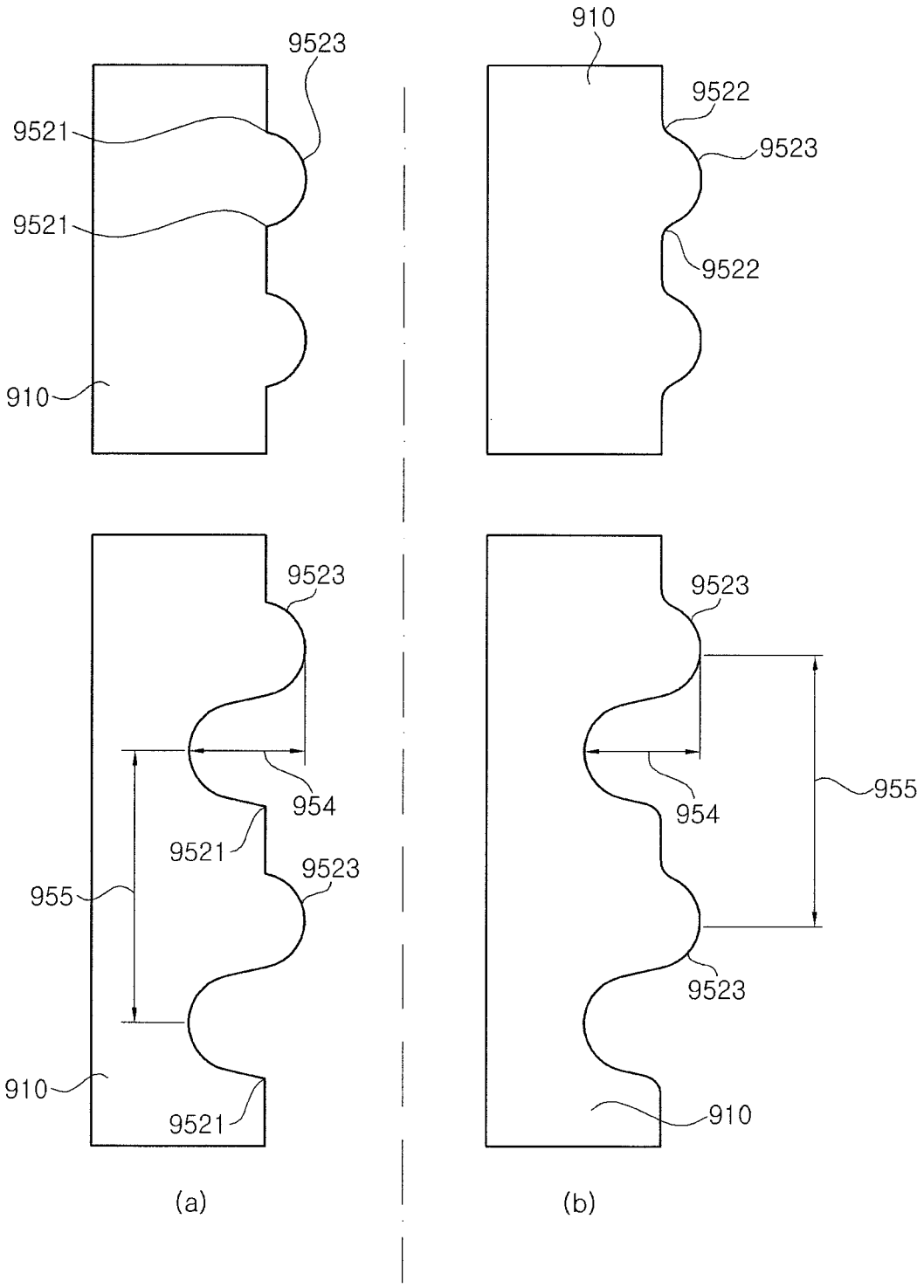
FIG. 52 is a diagram schematically showing the structure of the inner shell of the LNG storage container according to the present invention.

FIG. 48 is a diagram schematically showing an LNG storage container according to the present invention. FIG. 49 is a diagram schematically showing a structure of an inner shell of the LNG storage container according to the present invention. FIG. 50 is a diagram showing various structures of the inner shell of the LNG storage container according to the present invention. FIG. 51 is a diagram showing various structures of the inner shell of the LNG storage container according to the present invention. FIG. 52 is a diagram schematically showing the structure of the inner shell of the LNG storage container according to the present invention.

The LNG storage container 900 shown in FIGS. 48 to 52, which is one embodiment of the present invention, includes an inner shell 910, an outer shell 920, a support 930, and a heat insulation layer part 940.

In the storage container 900 of the present invention, the inner shell 910 stores LNG inside, and the outer shell 920 encloses the outside of the inner shell 910. The support 930 is installed between the inner shell 910 and the outer shell 920 to support the inner shell 910 and the outer shell 920, and the heat insulation layer part 940 reduces a heat transfer.

Meanwhile, a connecting part (not shown) is integrally connected to an inlet/outlet port of the inner shell 910 in order for the supply and exhaust of the LNG to/from the inner shell 910. Thus, the connecting part may protrude outside the outer shell 920. An external member such as a valve may be connected to the connecting part.

As shown in FIG. 48, the inner shell 910 may be formed in a cylindrical (or tubular) type having a corrugated structure 950. Also, the inner shell 910 may have various shapes, including a polyhedron.

The corrugated structure 950 formed in the inner shell 910 may have various curved portions 952 along the cross-sectional shape of the corrugation, and may have one or more corrugations 951 with the various curved portions 952.

One or more corrugations 951 may determine a curved angle 953, a corrugation depth 954, and a corrugation distance 955, such that the corrugations 951 have the same shape in the entirety of the single inner shell 910 (see (*a*), (*b*) and (*c*) in FIG. 50), or may determine the curved angle 953, the corrugation depth 954, and the corrugation distance 955, such that all or part of the corrugations 951 have different shapes.

The curved portions 952 may have various shapes, such as angled edge curved portions 9521, rounded edge curved portions 9522, and wave-shaped curved portions 9523.

The embodiment of FIG. 50(*a*) shows the inner shell 910 made to have four angled edge curved portions 9521 in the single corrugation 951. However, if the curved angle 953 of the angled edge curved portion 9521 is variously set, the inner shell 910 may have the corrugations with more various shapes.

The embodiments of FIGS. 50(*b*) and 50(*c*) show the inner shells 910 in which one or more corrugations 951 have different corrugation depths 954 and different corrugation distances 955. Thus, the inner shell 910 is made to have the rounded edge curved portions 9522 by rounding the edge portions, such that the respective corrugations do not have angled edges.

The embodiments of FIGS. 51(*a*) and 51(*b*) show the inner shells 910 in which one or more corrugations 951 have different corrugation depths 954 and different corrugation distances 955. However, the embodiments of FIGS. 51(*a*) and 51(*b*) show the inner shell 910 having the wave-shaped curved portions 9523 in which wave-shaped curved portions are formed in the respective corrugations 951.

Also, as shown in FIGS. 52(*a*) and 52(*b*), the curved portions 9521 and 9522 having the angled edges or the rounded edges and the curved portions 9523 having the wave shape may be formed with a single corrugation.

Although FIGS. 48 and 49 show that the corrugated structure 950 is formed in a lateral surface among the outer surfaces of the inner shell 910, the corrugated structure 950, if necessary, may be further formed in a top cover 960 or a bottom cover 970, as well as the lateral surface of the inner shell 910.

The inner shell 910 forms an LNG storage space inside. The inner shell 910 may be made of a metal that withstands a low temperature of the LNG. For example, the inner shell 910 may be made of a metal having excellent low temperature characteristic, such as aluminum, stainless steel, and 5-9% nickel steel.

The outer shell 920 encloses the outside of the inner shell 910 such that a space is formed between the outer shell 920 and the inner shell 910. The outer shell 920 may be made of a steel material that withstands the internal pressure of the inner shell 910. The outer shell 920 shares the internal pressure applied to the inner shell 910. Therefore, an amount of a material used for the inner shell 910 may be reduced, leading to a reduction in the production costs of the LNG storage container 900.

The heat insulation layer part 940 is installed in a space between the inner shell 910 and the outer shell 920, and is made of a heat insulator that reduces a heat transfer.

The heat insulation layer part 940 may be designed such that a pressure equal to the internal pressure of the inner shell 910 is applied thereto. The pressure equal to the internal pressure of the inner shell 910 refers to not a strictly equal pressure but a similar pressure.

As with the previous embodiments, the heat insulation layer part 940 and the inside of the inner shell 910 may be connected together by the connection passage 54 (shown in FIG. 12) or the equalizing line 514 (shown in FIG. 23) in order for pressure balance between the inside and the outside of the inner shell 910. Since the connection passage 54 or the equalizing line 514 has been described in detail in the previous embodiments, a description thereof will be omitted.

Due to the connection passage 54 or the equalizing line 514, the pressure of the inner shell 910 becomes equal or similar to the pressure of the heat insulation layer part 940.

Therefore, the outer shell 920 can withstand the pressure of the PLNG. Therefore, even though the inner shell 910 is manufactured to withstand a temperature of −120 to −95° C., the PLNG having the above pressure (13 to 25 bar) and temperature condition, for example, a pressure of 17 bar and a temperature of −115° C., can be stored by the inner shell 910 and the outer shell 920. The storage container 900 may be designed to satisfy the above pressure and temperature condition in such a state that the outer shell 920, the support 930, and the heat insulation layer part 940 are assembled.

There is almost no difference in the pressures applied to the inner shell 910 and the outer shell 920 because the pressures applied to the inner shell 910 and the outer shell 920 become substantially equal in the normal state by the connection passage 54 or the equalizing line 514. However, in the full vent that rapidly lowers the pressure of the storage container in the abnormal state, the pressure difference between the inside and the outside of the inner shell 910 may be about 0.5 bar. Therefore, the inner shell 910 may be manufactured to withstand a pressure of about 0.5 bar.

Since the support 930 can be installed to have the same function as described in the previous embodiments in the same manner as described in the previous embodiments, a detailed description thereof will be omitted. As with the previous embodiments, a lower support 931 may be additionally installed in a lower space between the inner shell 910 and the outer shell 920.

Figure 53:
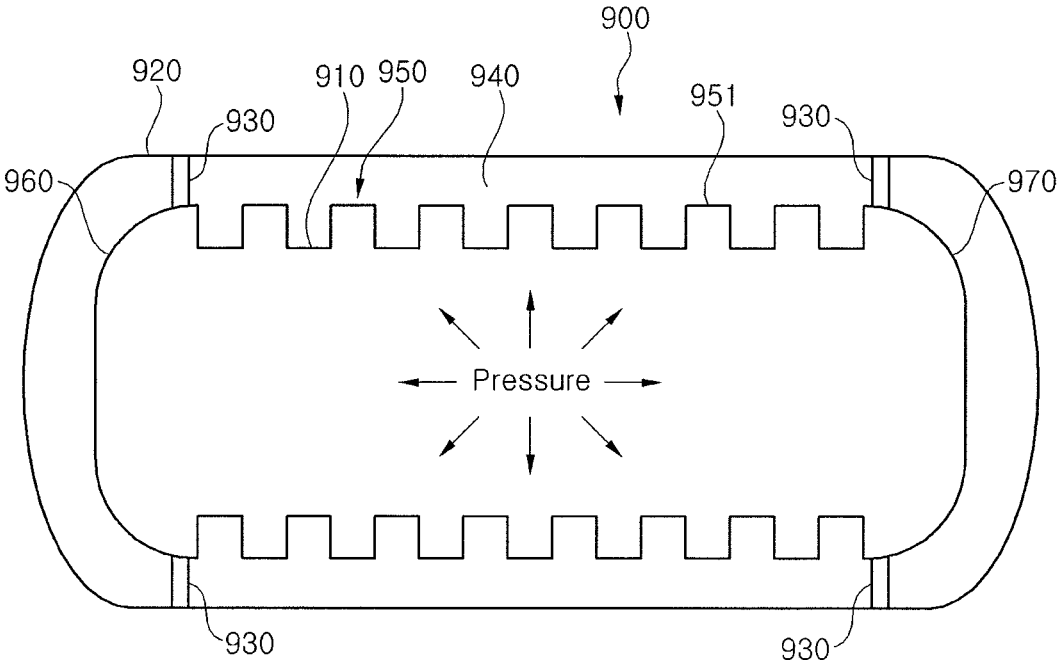
FIG. 53 is a diagram schematically showing the LNG storage container according to the present invention.

As shown in FIG. 53, the LNG storage container 900 according to the present invention may be installed in a transverse direction. In this case, the lower support 931 may be omitted.

According to a method for manufacturing the LNG storage container 900 shown in FIGS. 48 to 52, which is one embodiment of the present invention, the inner shell 910 having the corrugated structure is disposed inside the storage container, and the outer shell 920 is disposed outside the storage container. The support 930 supporting the inner shell 910 and the outer shell 920 is installed in the space between the inner shell 910 and the outer shell 920. The heat insulation layer part 940 reducing the heat transfer is installed in the space between the inner shell 910 and the outer shell 920.

In this case, the corrugated structure of the inner shell 910 may be made by forming a plurality of curved surfaces as many as desired by using a roller and then connecting the curved surfaces by welding.

Examples of the roller used for making the corrugated structure may include a general roller and any type of rollers capable of making the corrugated structure (corrugations or desired curved surfaces), such as a corrugated roller. The LNG storage container 900 is manufactured by forming a plurality of corrugations by using the roller and then bonding joint portions by welding.

Since the configurations and functions of the respective parts constituting the storage container manufactured in the above-described manner are substantially identical to those described above, a detailed description thereof will be omitted.

In the structures of the LNG storage containers of FIGS. 54 to 61 according to various embodiments of the present invention, LNG is stored in the inside of an inner shell 1010, and an outer shell 1020 is installed outside the inner shell 1010 to enclose the outside of the inner shell 1010, so that a space is formed between the outer shell 1020 and the inner shell 1010. A plurality of supports 1030 and a heat insulation layer part 1040 reducing a heat transfer are installed in the space between the inner shell 1010 and the outer shell 1020.

The inner shell 1010 forms an LNG storage space inside. The inner shell 1010 may be made of a metal that withstands a low temperature of the LNG. For example, the inner shell 1010 may be made of a metal having excellent low temperature characteristic, such as aluminum, stainless steel, and 5-9% nickel steel. Also, as can be seen from the drawings showing the various embodiments of the present invention, the inner shell 1010 may be formed in a tubular type, or may have various shapes, including a polyhedron.

It is preferable that the inner shell 1010 is made to withstand a temperature of −120 to −95° C.

The outer shell 1020 encloses the outside of the inner shell 1010 such that a space is formed between the outer shell 1020 and the inner shell 1010. The outer shell 1020 may be made of a steel material that withstands the pressure of the LNG stored in the inner shell 1010. Due to an equalizing line 1090 to be described below, the outer shell 1020 shares the internal pressure of the inner shell 1010. Therefore, an amount of a material used for the inner shell 1010 may be reduced, leading to a reduction in the production costs of the LNG storage container 1000.

It is preferable that the outer shell 1020 is made to withstand a pressure of 13 to 25 bar.

Due to the equalizing line 1090 to be described below, the internal pressure of the inner shell 1010 becomes equal to the pressure of the space defined by the inner shell 1010 and the outer shell 1020 (that is, the space where the heat insulation layer part 1040 is formed). Therefore, the outer shell 1020 can withstand the pressure of the LNG. The pressure equal to the internal pressure of the inner shell 1010 refers to not a strictly equal pressure but a similar pressure.

Therefore, only if the inner shell 1010 is made to withstand a temperature of −120 to −95° C., the LNG storage container 1000 can safely store the LNG regardless of whether or not the inner shell 1010 can withstand the pressure of the LNG stored therein.

That is, even when the LNG produced to have the constant pressure and temperature (for example, 17 bar and −115° C.) is stored in the inner shell 1010 of the storage container 1000, the LNG having the constant pressure and temperature can be safely stored in such a state that the outer shell 1020 and the heat insulation layer part 1040 are assembled.

Meanwhile, the inner shell 1010 may be made to have a thickness t1 thinner than a thickness t2 of the outer shell 1020. Therefore, when manufacturing the inner shell 1010, the use of expensive metal having excellent low temperature characteristic may be reduced.

The support 1030 can enable the inner shell 1010 to be supported to the outer shell 1020. If the support 1030 restricts the contraction and expansion according to a change in the temperature of the inner shell 1010, stress concentration occurs in the support 1030, and thus, it is highly likely that the support 1030 will be damaged. For this reason, it is necessary to manufacture the support 1030 such that stress concentration does not occur therein.

Figure 54:
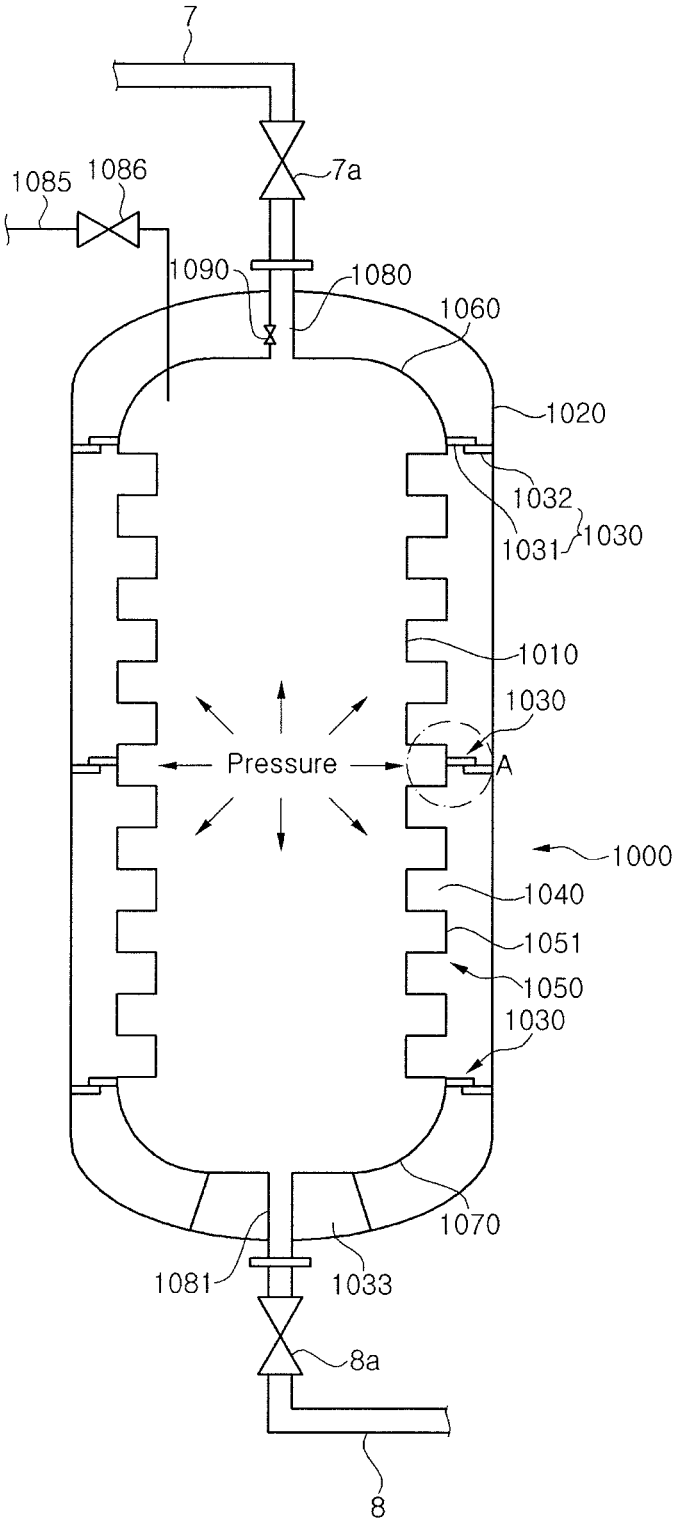
FIG. 54 is a longitudinal sectional view schematically showing the structure of the LNG storage container according to the present invention.
Figure 56:
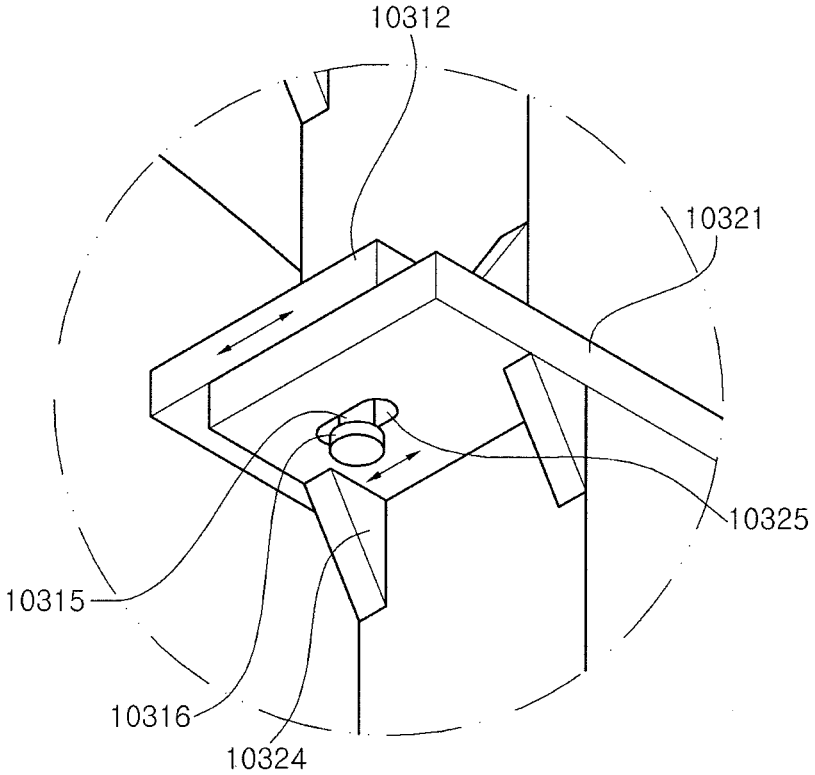
FIG. 56 is an enlarged view of FIG. 55.
Figure 56:
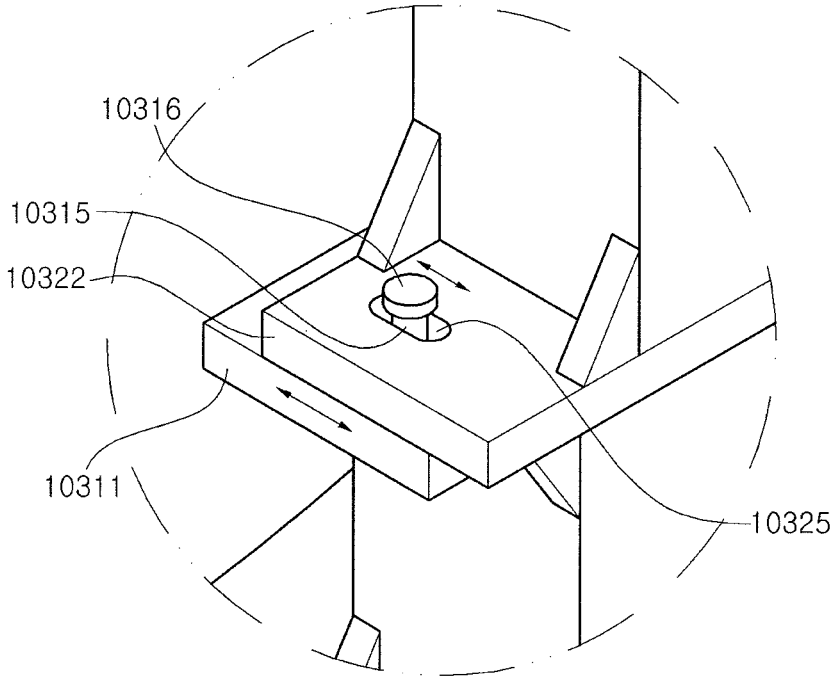

Therefore, the support 1030 is provided with an internal support 1031 connected to the inner shell 1010, and an external support 1032 connected to the outer shell 1020. As shown in FIG. 54, it is preferable that the internal support 1031 and the external support 1032 are slidably connected, with a contact surface being disposed therebetween.

In order for the internal support 1031 and the external support 1032 to be slidable, a sliding bar 10315 may be formed in one of the internal support 1031 and the external support 1032, and a sliding hole 10325 may be formed in the other thereof such that the sliding bar 10315 is inserted into and connected to the sliding hole 10325.

The sliding bar 10315 is formed to protrude outward from one of the internal support 1031 and the external support 1032, and the sliding hole 10325 is formed in the other thereof. In this case, the sliding hole 10325 is formed such that the sliding bar 10315 is inserted into the sliding hole 10325 and is slidable in a horizontal direction.

FIG. 55 is an enlarged view of a portion A of FIG. 54, and shows various types of the support 1030.

As shown in FIG. 55, it is preferable that the support 1030 is made in a structure that minimizes a cross-sectional area in order to minimize a heat transfer from the inner shell 1010 to the outer shell 1020 through the support 1030. To this end, as shown in FIG. 55(*a*), a lower flange 10312 of the internal support 1031 and an upper flange 10321 of the external support 1032 are formed such that the internal support 1031 and the external support 1032 are slidable.

At this time, in order to increase a structural stiffness, the internal support 1031 and the external support 1032 may be formed with I-shaped members in which the internal support 1031 and the external support 1032 are provided with upper flanges 10311 and 10321 and lower flanges 10312 and 10322 on both sides thereof, and the upper flanges 10311 and 10321 and the lower flanges 10312 and 10322 are connected by webs 10313 and 10323.

That is, the sliding bar 10315 may be formed to protrude outward from the flange of the internal support 1031, and the sliding hole 10325 may be formed in the flange of the external support 1032 such that the sliding bar 10315 is inserted and connected thereto. The sliding bar 10315 may be formed in the external support 1032, and the sliding hole 10325 may be formed in the internal support 1031.

It is preferable that the sliding bar 10315 protrudes to the outside of the support in a vertical direction.

Meanwhile, due to the extremely low temperature transferred from cryogenic LNG stored in the inner shell 1010, brittle fracture may occur in the internal support 1031 connected to the inner shell 1010. Therefore, it is preferable that the internal support 1031 is made of a metal that withstands a low temperature. For example, the internal support 1031 may be made of a metal having excellent low temperature characteristic, such as aluminum, stainless steel, and 5-9% nickel steel. Since the external support 1032 is not directly connected to the inner shell 1010, it is preferable that the external support 1032 is made of not an expensive metal for low temperature but a reinforced plastic, leading to a reduction in the production costs of the storage container 1000.

Since it is convenient to manufacture the sliding bar 10315 as a separate member and connect the sliding bar 10315 to the support by welding, it is preferable that the sliding bar 10315 and the support connecting the sliding bar 10315 are made of a weldable metal.

That is, the sliding bar 10315 is made of a metal and is connected to the metallic internal support 1031 by welding. At this time, as in the case of the internal support 1031, it is preferable that the sliding bar 10315 directly connected to the internal support 1031 is made of a metal for low temperature, so that brittle fracture cannot occur in the sliding bar 10315 due to the extremely low temperature transferred from the cryogenic LNG inside the inner shell 1010.

The end of the sliding bar 10315 has a sliding head 10316 larger than a width of the sliding hole 10325. Therefore, it is possible to prevent the sliding bar 10315 from being accidently released from the sliding hole 10325. Also, even when the upward thermal contraction and thermal expansion occur in the inner shell 1010, the internal support 1031 and the external support 1032 can restrict the inner shell 1010.

As shown in FIG. 55(*a*), the sliding hole 10325 may be formed in the upper flange 10321 of the external support 1032, such that the lower flange 10312 of the internal support 1031, where the sliding bar 10315 is formed, can slide along the upper flange 10321 of the external support 1032. Alternatively, as shown in FIG. 55(*b*), the sliding hole 10325 may be formed in the lower and upper flanges 10322 and 10321 of the external support 1032, such that the upper and lower flanges 10311 and 10312 of the internal support 1031, where the sliding bar 10315 is formed, can slide along the lower and upper flanges 10322 and 10321 of the external support 1032.

Figure 57:
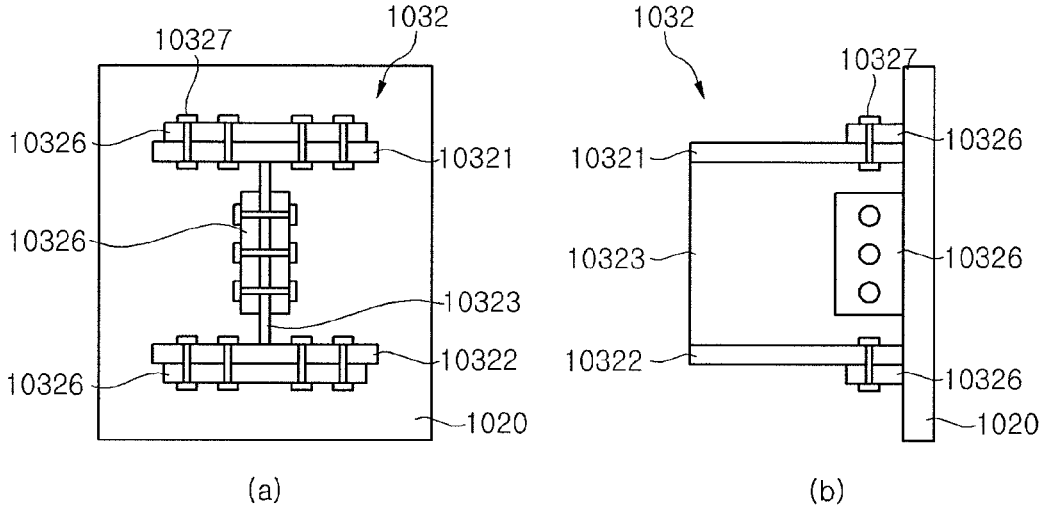
FIG. 57 is a diagram showing an external support.

As described above, it is preferable that the external support 1032 is made of a reinforced plastic, but the reinforced plastic cannot be welded. Therefore, as shown in FIG. 57, a separate connection plate 10326 and a connecting part 10327 may be additionally provided, in which the separate connection plate 10326 is made of a weldable metal for connecting the non-weldable external support 1032 to the external shell 1020 by welding, and the connecting part 10327 connects the connection plate 10326 to the external support 1032.

It is preferable that the connection plate 10326 and the connecting part 10327 are made a metal that withstands a low temperature.

Due to the connecting part 10327, the external support 1032 made of a non-weldable material is connected to the connection plate 10326 made of a metal that withstands a low temperature, and the connection plate 10326 is welded to the outer shell 1020. Consequently, the external support 1032 is connected to the outer shell 1020.

The connecting part 10327 may be a bolt and a nut made of a metal that withstands a low temperature. The connection plate 10326 and the flanges 10321 and 10322 may be connected together by the bolt and the nut.

As shown in FIGS. 55(*a*) and 55(*c*), the support 1030 may be provided with one or more internal supports 1031 and external supports 1032. The support 1030 may be configured by alternately arranging the internal support 1031 and the external support 1032, in order to absorb well the thermal contraction and thermal expansion of the inner shell 1010.

In this case, it is preferable that the external support 1032 is disposed at the lowermost of the support 1030. Since the support disposed at the lowermost is subject to the greatest load, the life time is shortened by the large load if the internal support 1031 made of an expensive metal for low temperature is disposed at the lowermost. In order to prevent this problem, the external support 1032 made of an inexpensive material is disposed at the lowermost.

As shown in FIG. 55(*b*), the support 1030 according to the present invention may alternately form the external support 1032 and the internal support 1031, such that the external support 1032 is disposed at the lowermost and the internal support 1031 is disposed on the external support 1032.

The sliding bar 10315 is formed in the flange of the internal support 1031 that slides with the flange of the external support 1032, and the sliding hole 10325 is formed in the flange of the external support 1032 that slides with the flange of the internal support 1031.

A plurality of supports 1030 may be installed along the lateral circumferences of the inner shell 1010 and the outer shell 1020, or may be installed at predetermined intervals in a vertical direction of the inner shell 1010.

Due to this configuration, the thermal contraction and thermal expansion in a radial direction of the inner shell 1010 are supported to the outer shell 1020 and freely achieved. Also, the thermal contraction and thermal expansion in a vertical direction are restricted because the sliding head 10316 formed in the internal support 1031 is latched to the sliding hole 10325 of the external support 1032. Therefore, the inner shell 1010 can be supported more firmly.

At this time, since the thermal contraction and thermal expansion in the vertical direction can absorb the thermal change caused by the shape of the corrugated structure to be described later, excessive restriction in the vertical direction does not occur. Therefore, the structural stability of the sliding head 10316 and the sliding hole 10325 is ensured.

Meanwhile, as shown in FIG. 54, a lower support 1033 may be further provided in a lower space between the inner shell 1010 and the outer shell 1020 in order for the outer shell 1020 to support the inner shell 1010 more stably. As in the LNG storage container shown in FIG. 61 according to the embodiment of the present invention, when the storage container 1000 is installed in a transverse direction, the sliding bar 10315 and the sliding hole 10325 formed in the internal support 1031 and the external support 1032 have difficulty in stably supporting the inner shell 1010. Therefore, it is preferable to install the lower support 1033.

The heat insulation layer part 1040 is installed in the space between the inner shell 1010 and the outer shell 1020, and is made of a heat insulator that reduces a heat transfer. Also, the heat insulation layer part 1040 may be designed in structural or material such that a pressure equal to the internal pressure of the inner shell 1010 is applied thereto. The pressure equal to the internal pressure of the inner shell 1010 refers to not a strictly equal pressure but a similar pressure.

Therefore, the space between the inner shell 1010 and the outer shell 1020, where the heat insulation layer part 1040 is provided, and the inner space of the inner shell 1010 may be connected together by the equalizing line 1090 in order for pressure balance.

Due to the equalizing line 1090, the pressure in the inside of the inner shell 1010 is balanced with the pressure in the outside of the inner shell 1010 (the inside of the outer shell 1020). Since the outer shell 1020 supports a considerable portion of the pressure, the thickness of the inner shell 1010 can be reduced.

The equalizing line 1090 may be formed in a side contacting the inner space of the outer shell 1020 in a first connecting part 1080 provided in the loading line 7 of the inner shell 1010.

Figure 58:
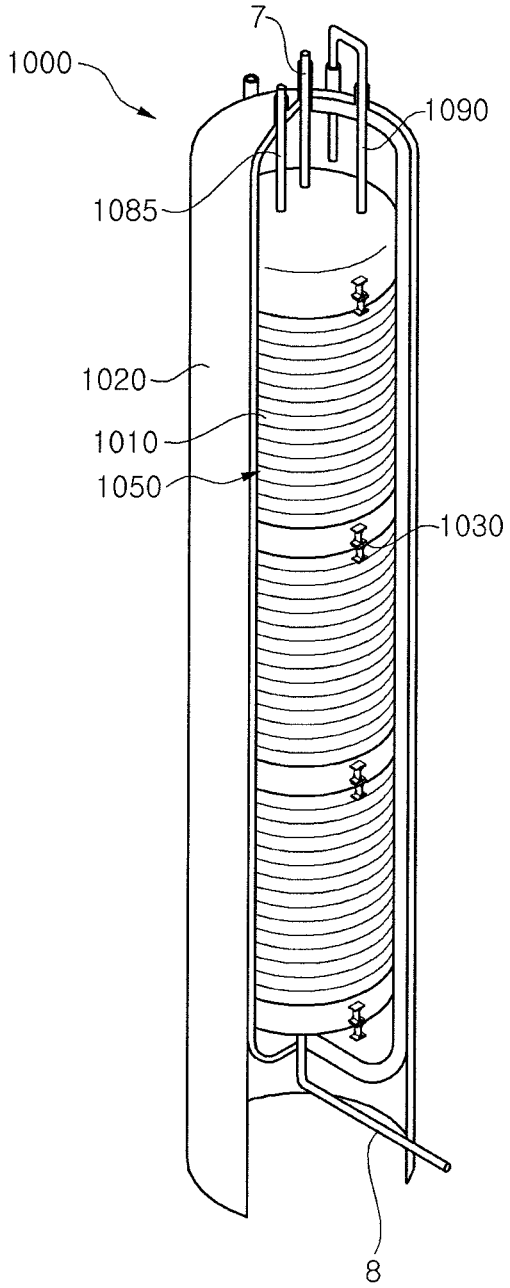
FIG. 58 is a partial cut-away view of the LNG storage container according to the embodiment of the present invention.
Figure 59:
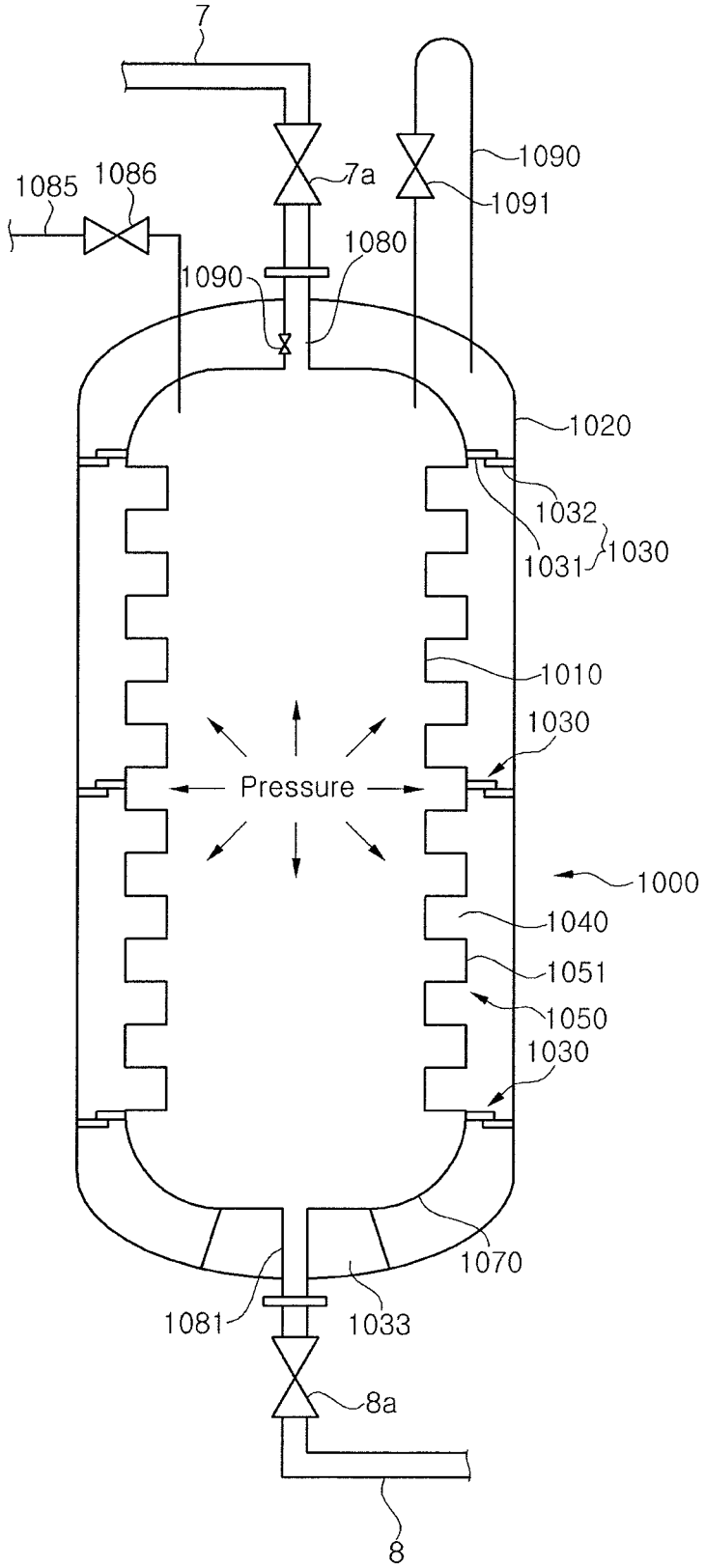
FIG. 59 is a longitudinal sectional view schematically showing the structure of the LNG storage container according to the embodiment of the present invention.
Figure 60:
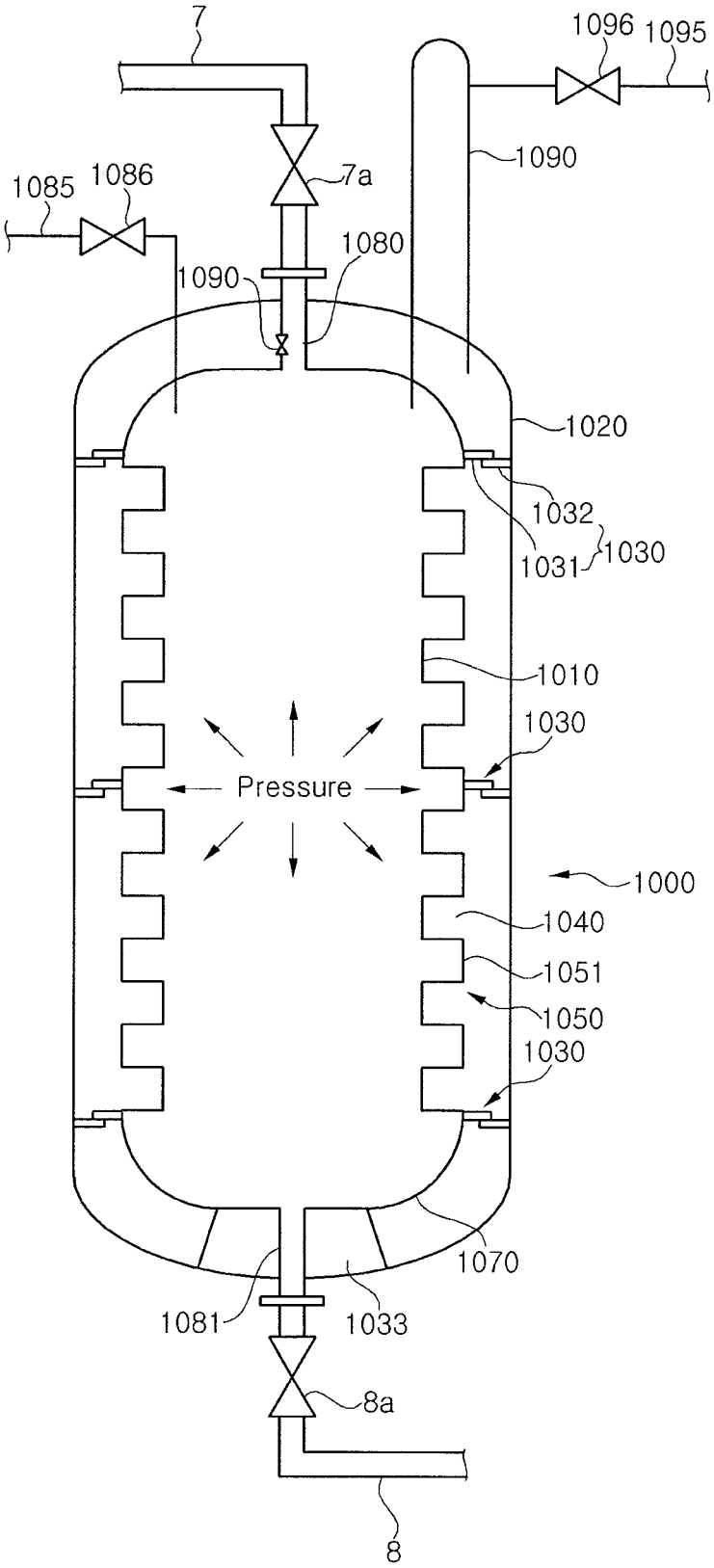
FIG. 60 is a longitudinal sectional view schematically showing the structure of the LNG storage container according to the embodiment of the present invention.
Figure 61:
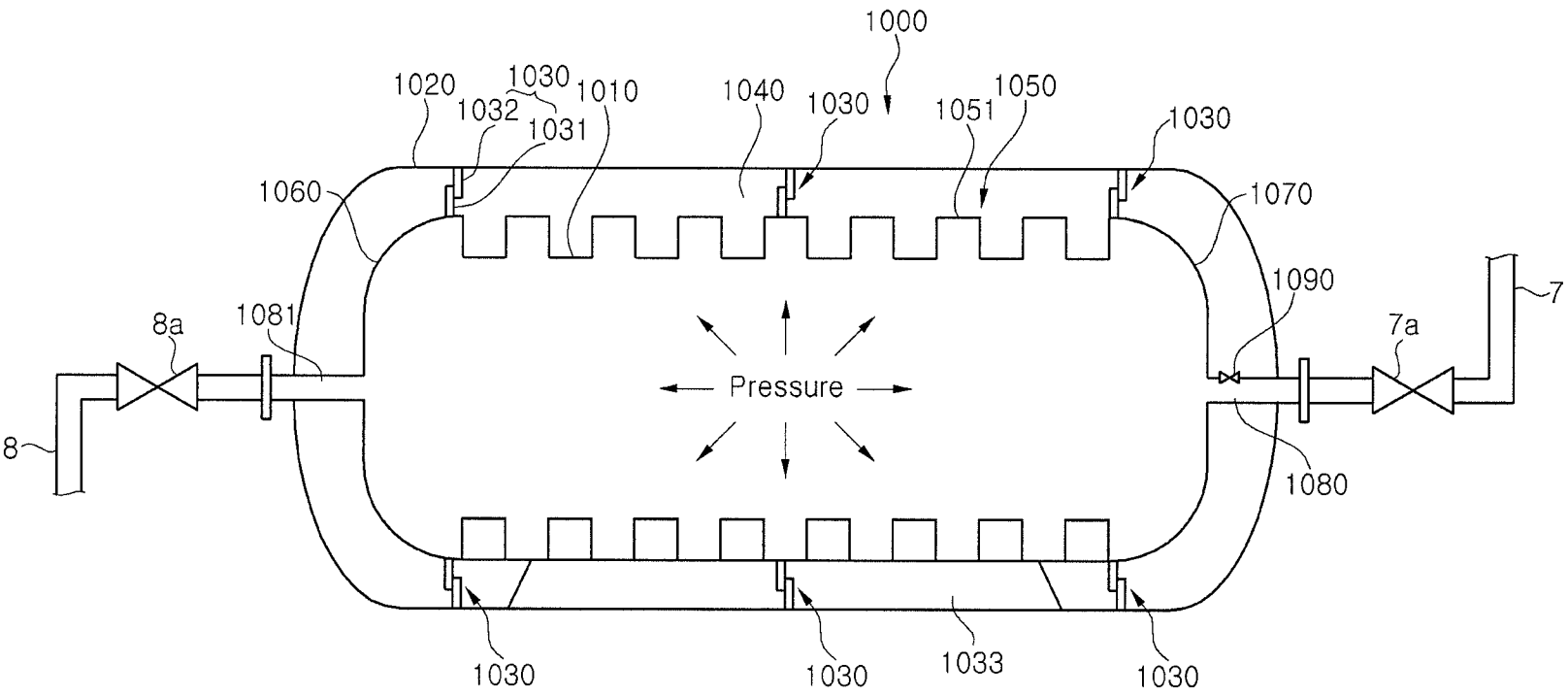
FIG. 61 is a longitudinal sectional view schematically showing the structure of the LNG storage container according to the embodiment of the present invention.

The equalizing line 1090 may be provided with a valve as shown in FIG. 54, or may be provided with a pipe as shown in FIGS. 58 to 60, which is to be described below. Therefore, as the internal pressure of the inner shell 1010 moves to the heat insulation layer part 1040 through the equalizing line 1090, the pressure balance is achieved between the inside and the outside of the inner shell 1010.

That is, since the pressure balance is achieved between the inside and the outside of the inner shell 1010 by the equalizing line 1090, the inner shell 1010 may be made of a metal having excellent low temperature characteristic, and the outer shell 1020 may be made of a steel material having excellent strength. Therefore, in addition to the LNG, the PLNG can be stored.

Also, since the thickness t1 of the inner shell 1010 is reduced, the use of the expensive metal having excellent low temperature characteristic can be reduced. Also, the storage container 1000 can prevent the structural defect caused by the internal pressure of the inner shell 1010 and can have superior durability.

Meanwhile, first and second connecting parts 1080 and 1081 are installed in upper and lower portions of the inner space of the inner shell 1010, respectively, and pass through the outer shell 1020 to protrude to the outside of the outer shell 1020. The LNG can be loaded into the inner shell 1010 through the loading line 7 connected to the first connecting part 1080, and can be unloaded from the inner shell 1010 through the unloading line 8 connected to the second connecting part 1081.

Meanwhile, valves 7*a* and 8*a* may be installed in the loading line 7 and the unloading line 8, respectively.

The LNG storage container 1000 of FIGS. 58 and 59 according to the embodiment of the present invention includes a first exhaust line 1085, a first exhaust valve 1086, and an equalizing line 1090. The equalizing line 1090 protrudes from the inner space of the inner shell 1010 to the outside of the storage container 1000, and connects to the space between the inner shell 1010 and the outer shell 1020.

The first exhaust line 1085 is connected to the upper inner space of the inner shell 1010 and extends outward, and the first exhaust valve 1086 is installed in the first exhaust line 1085 so as to open and close a gas flow. When the first exhaust valve 1086 is opened, the first exhaust line 1085 can exhaust gas from the inner space of the inner shell 1010 to the outside.

As opposed to the embodiment illustrated in FIG. 54, the equalizing line 1090 is provided with a pipe so that the equalizing line 1090 is elongated. Therefore, even when the LNG stored in the inside of the inner shell 1010 overflows, it is possible to prevent the LNG from leaking to the space between the inner shell 1010 and the outer shell 1020 through the equalizing line 1090.

In the equalizing line 1090, an on/off valve 1091 is installed to open and close the flow of the liquid, for example, natural gas or boil-off gas. Therefore, when the position or posture of storage container 1000 is changed, the on/off valve 1091 can block the movement of the liquid which may occur through the equalizing line 1090.

The LNG storage container 1000 of FIG. 60 according to the embodiment of the present invention includes a second exhaust line 1095, a second exhaust valve 1096, and an equalizing line 1090. The equalizing line 1090 is connected to the second exhaust line 1095 in which the second exhaust valve 1096 is installed.

The second exhaust valve 1096 can exhaust gas from the inner shell 1010 to the outside through the equalizing line 1090 and the second exhaust line 1095. Therefore, it is possible to avoid a complicated process of connecting the separate exhaust line 1085 to the inner shell 1010, as shown in FIGS. 58 and 59. Also, since the devices installed to pass through the storage container 1000 are reduced, the structural stability of the storage container 1000 can be maintained.

The inner shells 1010 of the storage containers 1000 according to various embodiments of the present invention can be made in a corrugated structure as shown in FIGS. 49 to 52, and detailed descriptions thereof are substantially identical to those of FIGS. 49 to 52.

That is, as shown in FIG. 54, the inner shell 1010 may be formed in a cylindrical (or tubular) type having a top cover 1060 in an upper portion, a bottom cover 1070 in a lower portion, and a corrugated structure 1050 in a lateral surface. Also, the inner shell 1010 may have various shapes, including a polyhedron.

Also, the corrugated structure 1050 formed in the inner shell 1010 may have various curved portions 152 (FIGS. 49 to 52) along the cross-sectional shape of the corrugation, and may have one or more corrugations 1051 with the various curved portions 152.

In the structures of the LNG storage containers of FIGS. 62 to 67 according to various embodiments of the present invention, LNG is stored in the inside of an inner shell 1010, and an outer shell 1020 is installed outside the inner shell 1010 to enclose the outside of the inner shell 1010, so that a space is formed between the outer shell 1020 and the inner shell 1010. A support 1030 and a heat insulation layer part 1040 are installed in the space between the inner shell 1010 and the outer shell 1020.

The support 1030 supports the inner shell 1010 to the outer shell 1020, and the heat insulation layer part 1040 reduces the heat transfer between the inner shell 1010 and the outer shell 1020 by laminating two or more heat insulation layers. The heat insulation layer installed on the contact surface with the outer shell 1020 has higher density than the heat insulation layer installed in the inner shell 1010.

If the LNG stored in the inner shell 1010 leaks from the inner shell 1010, or if the LNG overflows through the equalizing line 1090, which is to be described later, and directly contacts the outer shell 1020, it is highly likely that brittle fraction will occur in the outer shell 1020. Therefore, as the leaking or overflowing LNG flows toward the outer shell 1020, the high-density heat insulation layer prevents the LNG from directly contacting the outer shell 1020.

Therefore, it is preferable that a high-density heat insulator is installed on the contact surface with the outer shell 1020. A closed cell heat insulator may be used. When the closed cell heat insulator is installed in the outer shell 1020, it may be adhered to the outer shell 1020 by using a glue.

The closed cell heat insulator has a structure in which a pressure difference exists between the inside and outside of the heat insulator and which withstands a high pressure in order to exhibit heat insulation performance.

In the two or more heat insulation layers installed in the heat insulation layer part 1040, various types of heat insulators (for example, open cell heat insulators or closed cell heat insulators) may be used. As described above, the high-density heat insulator, that is, the closed cell heat insulator, is installed on the contact surface with the outer shell 1020. The heat insulator having lower density than the heat insulator used in the contact surface with the outer shell 1020, that is, the open cell heat insulator, may be installed as the heat insulation layer installed in the inner shell 1010.

The open cell heat insulator has a structure that air can freely pass through the inside of the heat insulator when used under a high pressure. And then, the open cell heat insulator is a heat insulator in which no pressure difference exits between the inside and outside of the heat insulator and which does not withstand a pressure. However, in the case of a powder type heat insulator, grains themselves may receive a pressure under a high pressure.

In general, since the closed cell heat insulator is expensive, the closed cell heat insulator is used only in the contact surface with the outer shell 1020. Thus, the manufacturing costs of the heat insulation layer part 1040 can be reduced. In this case, it is preferable to form the closed cell in a range of 20 to 80 mm.

Also, the open cell heat insulator is easy to install, and make it easy to assemble the storage container. Therefore, when the heat insulation layer part 1040 is made to have an appropriate thickness together with the open cell and the closed cell, it is possible to ensure the heat insulation performance and achieve the easy installation and the reduction of the manufacturing cost.

Examples of the closed cell heat insulator may include a block type glass bubble, a high-density polyurethane form (PUF), and the like. Examples of the open cell heat insulator may include a grain type glass bubble, and the like. The glass bubble has an open cell structure, but may be manufactured as the closed cell heat insulator by binding glass bubble grains in a block type by using inorganic or organic materials.

The inner shell 1010 forms an LNG storage space inside. The inner shell 1010 may be made of a metal that withstands a low temperature of the LNG. For example, the inner shell 1010 may be made of a metal having excellent low temperature characteristic, such as aluminum, stainless steel, and 5-9% nickel steel. Also, as can be seen from the drawings showing the various embodiments of the present invention, the inner shell 1010 may be formed in a tubular type, or may have various shapes, including a polyhedron.

The inner shell 1010 may be made to withstand a temperature of −163 to −95° C., and preferably, −120 to −95° C.

The outer shell 1020 encloses the outside of the inner shell 1010 such that a space is formed between the outer shell 1020 and the inner shell 1010. The outer shell 1020 may be made of a steel material that withstands the pressure of the LNG stored in the inner shell 1010. Due to an equalizing line 1090 to be described below, the outer shell 1020 shares the internal pressure of the inner shell 1010. Therefore, an amount of a material used for the inner shell 1010 may be reduced, leading to a reduction in the production costs of the LNG storage container 1000.

It is preferable that the outer shell 1020 is made to withstand a pressure of 13 to 25 bar.

Due to the equalizing line 1090 to be described below, the internal pressure of the inner shell 1010 becomes equal to the pressure of the space defined by the inner shell 1010 and the outer shell 1020 (that is, the space where the heat insulation layer part 1040 is formed). Therefore, the outer shell 1020 can withstand the pressure of the LNG. The pressure equal to the internal pressure of the inner shell 1010 refers to not a strictly equal pressure but a similar pressure.

Therefore, only if the inner shell 1010 is made to withstand a temperature of −163 to −95° C., the LNG storage container 1000 can safely store the LNG, regardless of whether or not the inner shell 1010 can withstand the pressure of the LNG stored therein.

That is, even when the LNG produced to have the constant pressure and temperature (for example, 17 bar and −115° C.) is stored in the inner shell 1010 of the storage container 1000, the LNG having the constant pressure and temperature can be safely stored in such a state that the outer shell 1020 and the heat insulation layer part 1040 are assembled.

Meanwhile, the inner shell 1010 may be made to have a thickness t1 thinner than a thickness t2 of the outer shell 1020. Therefore, when manufacturing the inner shell 1010, the use of expensive metal having excellent low temperature characteristic may be reduced.

Since the support 1030 is installed in the space between the inner shell 1010 and the outer shell 1020 such that the inner shell 1010 can be supported to the outer shell 1020, the inner shell 1010 and the outer shell 1020 are structurally reinforced. The support 1030 can be made a metal or a composite material (for example, a low-temperature steel, glassfiber reinforced epoxy) for withstanding the low temperature of the LNG. A single support may be installed along the lateral circumferences of the inner shell 1010 and the outer shell 1020, or a plurality of supports may be installed to be spaced apart from the lateral portions of the inner shell 1010 and the outer shell 1020 in a vertical direction.

When the support 1030 is fixed and supported to the inner shell 1010 and the outer shell 1020 by welding, a heat insulator such as a glass fiber may be disposed in the inside of the end portion of the support 1030 coming into contact with the outer shell 1020. Alternatively, a separate heat insulator may be disposed in the inside of the end portion of the support and fixed by welding. Therefore, the support 1030 can prevent the temperature of the inner shell 1010 from being transferred to the outer shell 1020.

Also, a lower support 1033 for supporting the inner shell 1010 may be additionally installed in a lower space between the inner shell 1010 and the outer shell 1020. As with the storage container of FIG. 67 according to the embodiment of the present invention, when the storage container 1000 is installed in a transverse direction, the lower support 1033 can be omitted.

Figure 62:
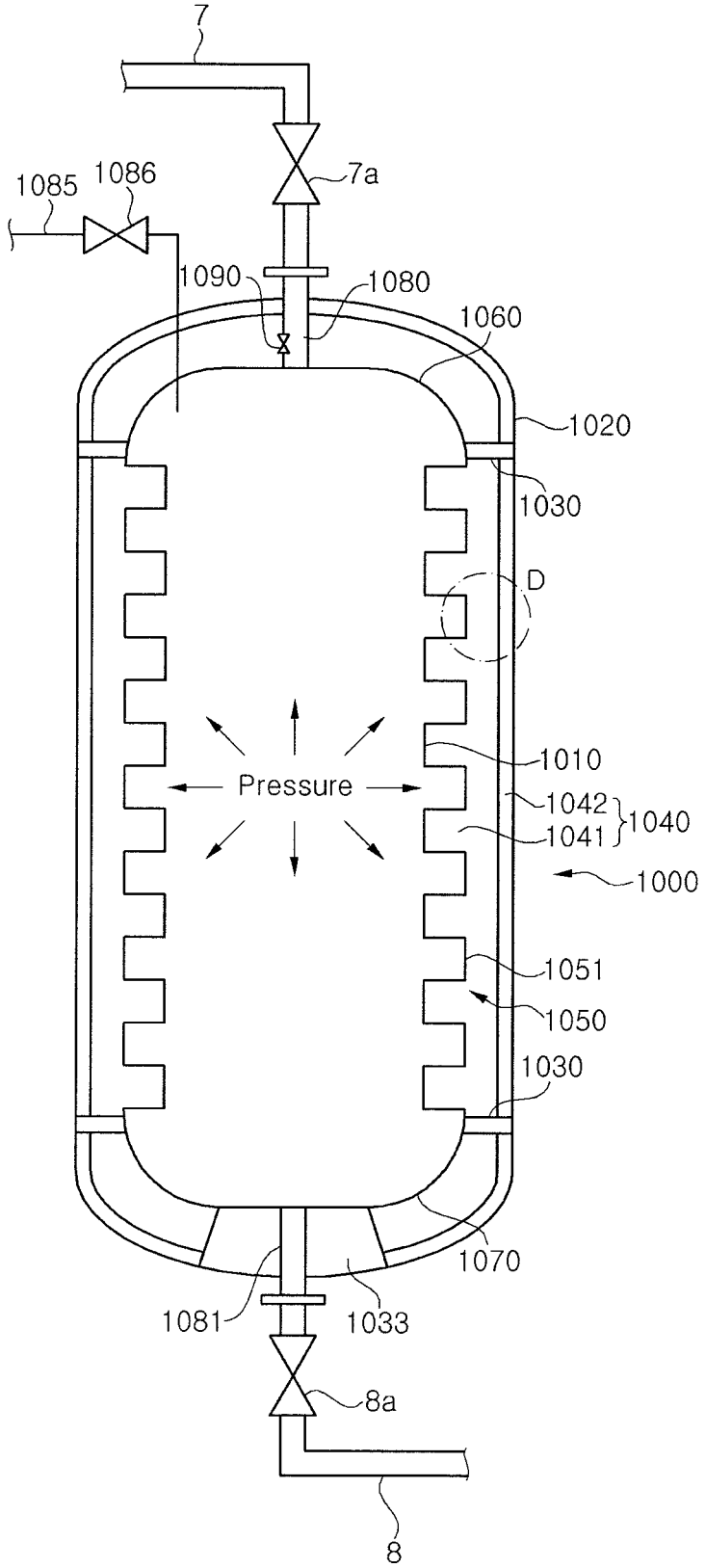
FIG. 62 is a longitudinal sectional view schematically showing the structure of the LNG storage container according to the embodiment of the present invention.
Figure 63:
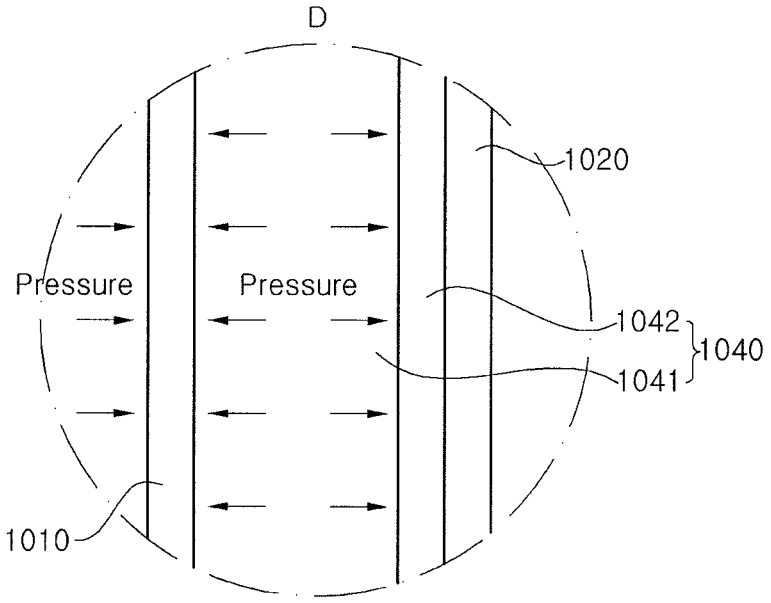
FIG. 63 is an enlarged view of a portion D of FIG. 62.

FIG. 62 is a longitudinal sectional view showing the structure of the LNG storage container according to the embodiment of the present invention, and FIG. 63 is an enlarged view of a portion D of FIG. 62.

A heat insulation layer part 1040 of FIGS. 62 and 63 according to an embodiment of the present invention may include a first heat insulation layer 1041 and a second heat insulation layer 1042.

In the inner shell (1010) side of the heat insulation layer 1040, the first insulation layer 1041 made of an open cell heat insulator is formed. In the outer shell (1020) side, the second insulation layer 1042 made of a closed cell heat insulator is formed.

The open cell heat insulator is not charged with high density by voids. Therefore, when pressure balance is achieved in the inner space of the inner shell 1010 and the space between the inner shell 1010 and the outer shell 1020 by the equalizing line 1090 to be described below and thus the spaces have the same pressure, a separate space for pressure balance need not be provided in the heat insulation layer part 1040.

Therefore, the space between the inner shell 1010 and the outer shell 1020, where the heat insulation layer part 1040 is provided, and the inner space of the inner shell 1010 may be connected together by the equalizing line 1090 in order for pressure balance.

Due to the equalizing line 1090, the pressure in the inside of the inner shell 1010 is balanced with the pressure in the outside of the inner shell 1010 (the inside of the outer shell 1020). Since the outer shell 1020 supports a considerable portion of the pressure, the thickness of the inner shell 1010 can be reduced.

The equalizing line 1090 may be formed in a side contacting the inner space of the outer shell 1020 in a first connecting part 1080 provided in the loading line 10 of the inner shell 1010.

Figure 64:
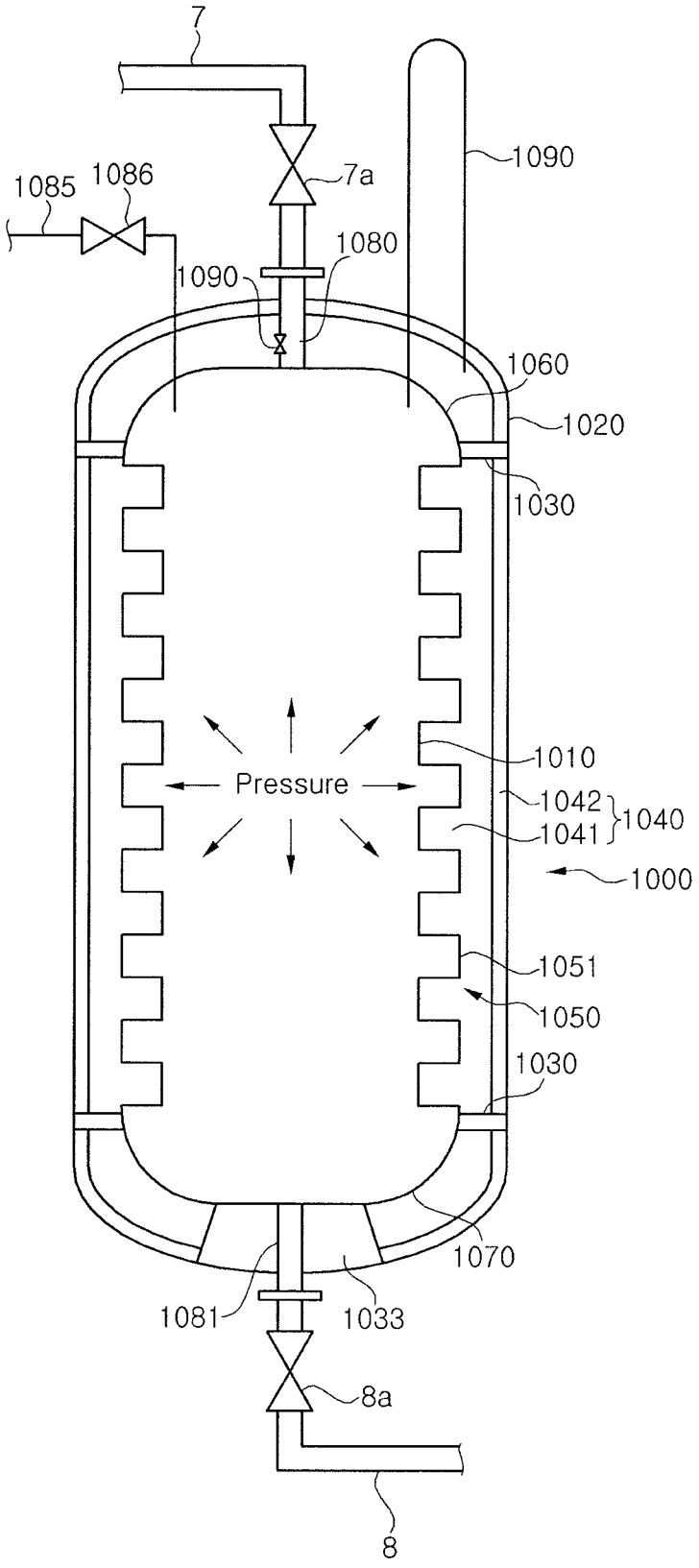
FIG. 64 is a longitudinal sectional view schematically showing the structure of the LNG storage container according to the embodiment of the present invention.
Figure 65:
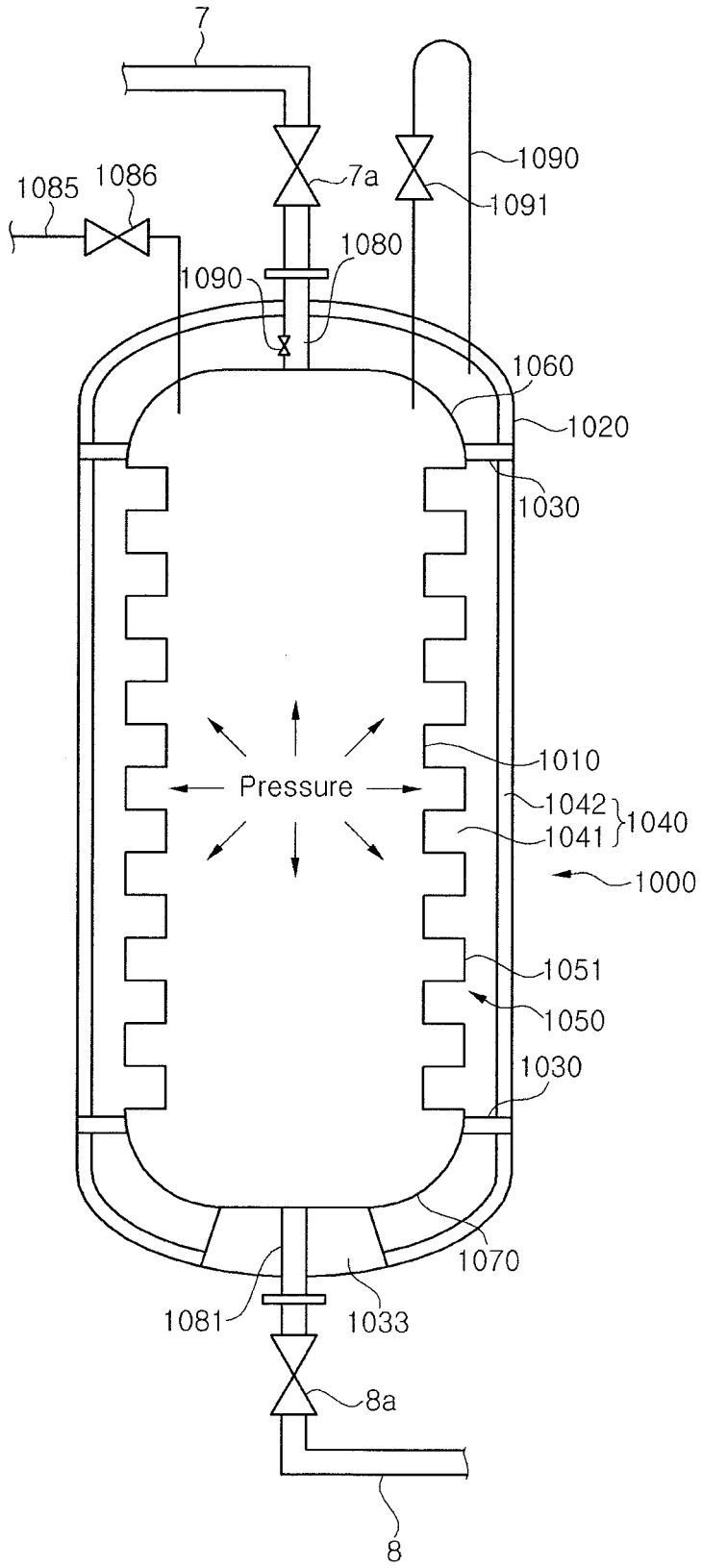
FIG. 65 is a longitudinal sectional view schematically showing the structure of the LNG storage container according to the embodiment of the present invention.
Figure 66:
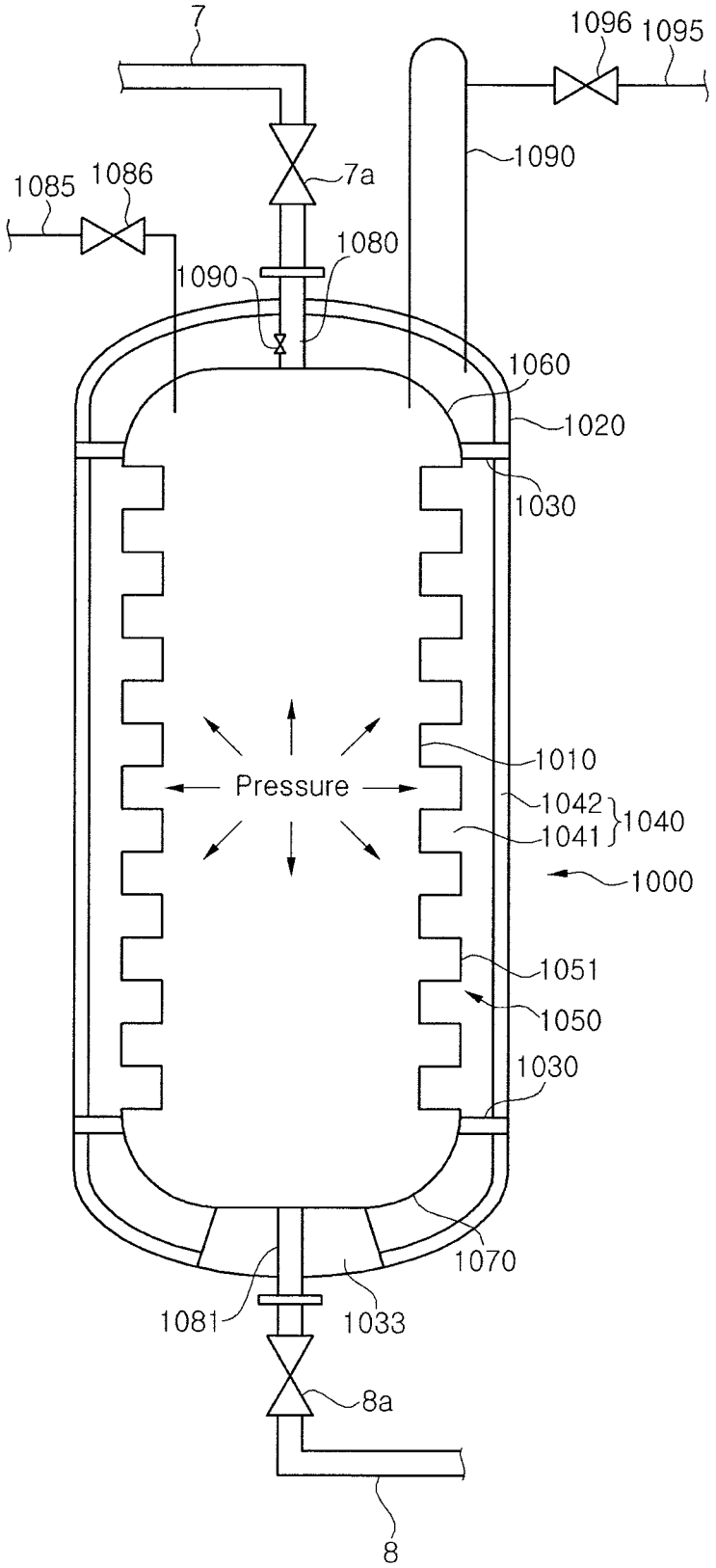
FIG. 66 is a longitudinal sectional view schematically showing the structure of the LNG storage container according to the embodiment of the present invention.
Figure 67:
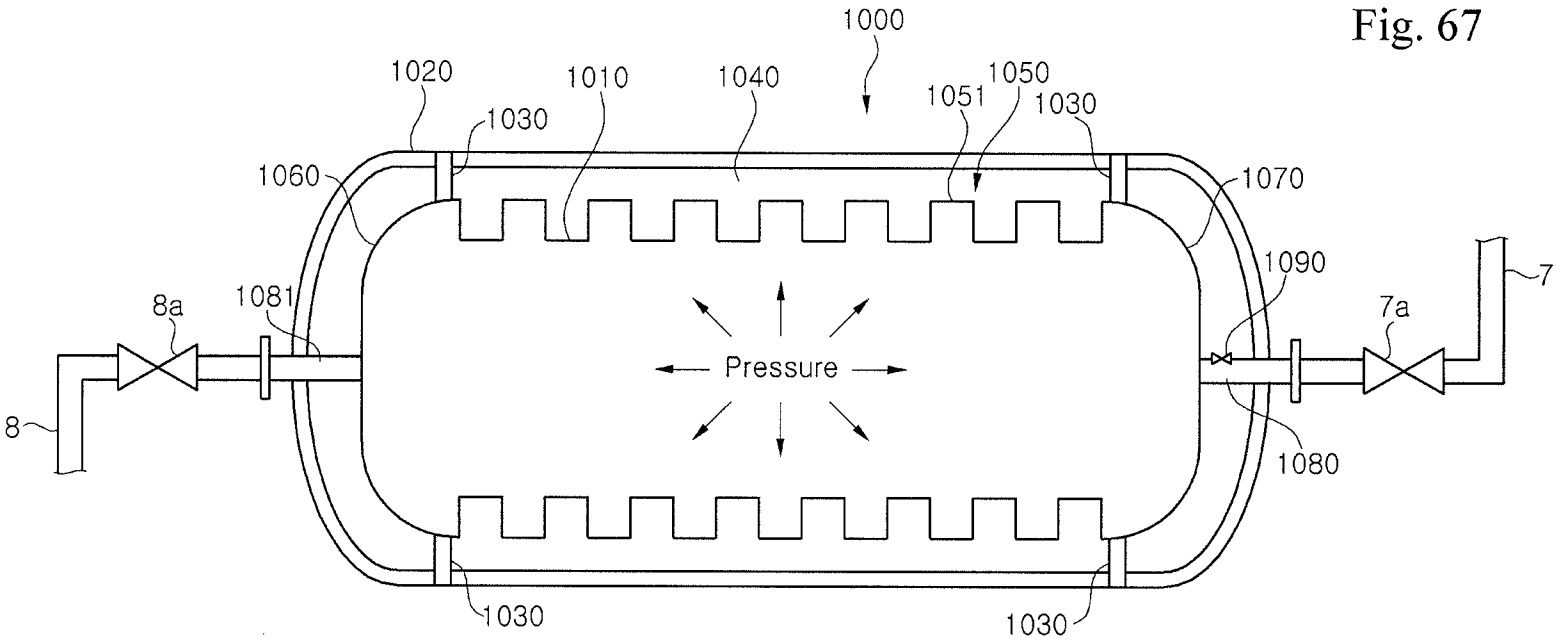
FIG. 67 is a longitudinal sectional view schematically showing the structure of the LNG storage container according to the embodiment of the present invention.

The equalizing line 1090 may be provided with a valve as shown in FIG. 62, or may be provided with a pipe as shown in FIGS. 64 to 66, which is to be described below.

Therefore, as the internal pressure of the inner shell 1010 moves to the heat insulation layer part 1040 through the equalizing line 1090, the pressure balance is achieved between the inside and the outside of the inner shell 1010.

The inner shell 1010 is made of a metal having excellent low temperature characteristic, and the outer shell 1020 is made of a steel material having excellent strength. The heat insulation layer part 1040 is provided with first and second heat insulation layers 1041 and 1042 having an appropriate thickness. Therefore, PLNG as well as LNG can be stored. Due to the pressure balance between the inside and the outside of the inner shell 1010, the thickness t1 of the inner shell 1010 is reduced, leading to a reduction in the use of an expensive metal having excellent low temperature characteristic.

Thus the structural defect caused by the internal pressure of the inner shell 1010 can be prevented, and the storage container 1000 can have superior durability.

Meanwhile, first and second connecting parts 1080 and 1081 are installed in upper and lower portions of the inner space of the inner shell 1010, respectively, and pass through the outer shell 1020 to protrude to the outside of the outer shell 1020. The LNG can be loaded into the inner shell 1010 through the loading line 7 connected to the first connecting part 1080, and can be unloaded from the inner shell 1010 through the unloading line 8 connected to the second connecting part 1081.

Meanwhile, valves 7*a* and 8*a* may be installed in the loading line 7 and the unloading line 8, respectively.

The LNG storage container 1000 of FIGS. 64 and 65 according to the embodiment of the present invention includes a first exhaust line 1085, a first exhaust valve 1086, and an equalizing line 1090. The equalizing line 1090 protrudes from the inner space of the inner shell 1010 to the outside of the storage container 1000, and connects to the space between the inner shell 1010 and the outer shell 1020.

The first exhaust line 1085 is connected to the upper inner space of the inner shell 1010 and extends outward, and the first exhaust valve 1086 is installed in the first exhaust line 1085 so as to open and close a gas flow. When the first exhaust valve 1086 is opened, the first exhaust line 1085 can exhaust gas from the inner space of the inner shell 1010 to the outside.

As opposed to the embodiment illustrated in FIG. 62, the equalizing line 1090 is provided with a pipe so that the equalizing line 1090 is elongated. Therefore, even when the LNG stored in the inside of the inner shell 1010 overflows, it is possible to prevent the LNG from leaking to the space between the inner shell 1010 and the outer shell 1020 through the equalizing line 1090.

In the equalizing line 1090, an on/off valve 1091 is installed to open and close the flow of the liquid, for example, natural gas or boil-off gas. Therefore, when the position or posture of storage container 1000 is changed, the on/off valve 1091 can block the movement of the liquid which may occur through the equalizing line 1090.

The LNG storage container 1000 according to the embodiment of the present invention, shown in FIG. 66, includes a second exhaust line 1095, a second exhaust valve 1096, and an equalizing line 1090. The equalizing line 1090 is connected to the second exhaust line 1095 in which the second exhaust valve 1096 is installed.

The second exhaust valve 1096 can exhaust gas from the inner shell 1010 to the outside through the equalizing line 1090 and the second exhaust line 1095. Therefore, as shown in FIGS. 64 and 65, it is possible to avoid a complicated process of connecting the separate exhaust line 1085 to the inner shell 1010. Also, since the devices installed to pass through the storage container 1000 are reduced, the structural stability of the storage container 1000 can be maintained.

The inner shells 1010 of the storage containers 1000 according to various embodiments of the present invention can be made in a corrugated structure as shown in FIGS. 49 to 52, and detailed descriptions thereof are substantially identical to those of FIGS. 49 to 52.

That is, as shown in FIG. 62, the inner shell 1010 may be formed in a cylindrical (or tubular) type having a top cover 1060 in an upper portion, a bottom cover 1070 in a lower portion, and a corrugated structure 1050 in a lateral surface. Also, the inner shell 1010 may have various shapes, including a polyhedron.

Also, the corrugated structure 1050 formed in the inner shell 1010 may have various curved portions 152 (FIGS. 49 to 52) along the cross-sectional shape of the corrugation, and may have one or more corrugations 1051 with the various curved portions 152.

A method for manufacturing the LNG storage container 1000 of FIGS. 62 to 67 according to an embodiment of the present invention includes: forming the outer shell 1020; and forming the second heat insulation layer 1042 by installing the closed cell heat insulator in the outer shell 1020 (for example, by adhering the closed cell heat insulator to the outer shell 1020 by a glue). Subsequently, the inner shell (for example, the inner shell 1010 having the corrugated structure) is inserted into the inside of the storage container such that the outer shell 1020 is disposed outside the storage container. The support 1030 supporting the inner shell 1010 to the outer shell 1020 is installed in the space between the inner shell 1010 and the outer shell 1020. The first heat insulation layer 1041 is formed by filling the low-density heat insulator (for example, the open cell heat insulator) into the space between the inner shell 1010 and the outer shell 1020.

The corrugated structure of the inner shell 1010 is made by forming a plurality of curved surfaces as many as desired by using a roller and then connecting the curved surfaces by welding.

Examples of the roller used for making the corrugated structure may include a general roller and any type of rollers capable of making the corrugated structure (corrugations or desired curved surfaces), such as a corrugated roller. The LNG storage container 1000 is manufactured by forming a plurality of corrugations by using the roller and then bonding joint portions by welding.

In the structures of the LNG storage containers of FIGS. 68 to 75 according to various embodiments of the present invention, LNG is stored in the inside of an inner shell 1010, and an outer shell 1020 is installed outside the inner shell 1010 to enclose the outside of the inner shell 1010, so that a space is formed between the outer shell 1020 and the inner shell 1010. A support 1030 and a heat insulation layer part 1040 reducing a heat transfer are installed in the space between the inner shell 1010 and the outer shell 1020.

The support 1030 supports the inner shell 1010 to the outer shell 1020, and the heat insulation layer part 1040 includes a passage 1043, through which a liquid flows, and a heat insulation layer 1044.

It is preferable that the passage 1043 is formed inside the inner shell 1010 such that the liquid can flow along the wall surface of the inner shell 1010, and the heat insulation layer 1044 is formed in the outer shell 1020 side.

If the LNG stored in the inner shell 1010 leaks from the inner shell 1010, or if the LNG overflows through the equalizing line 1090, which is to be described later, and directly contacts the outer shell 1020, it is highly likely that brittle fraction will occur in the outer shell 1020. Therefore, the leaking or overflowing cryogenic LNG flows through the space between the inner shell 1010 and the outer shell 1020, but does not directly contact the outer shell 1020. In this manner, the structural stability of the storage container 1000 can be ensured, and the heat insulation performance can be maintained.

The heat insulation layer 1044 may be provided with two or more heat insulator blocks 10441 installed at regular intervals in a vertical direction, and reinforced heat insulators 10442 may be installed between the respective heat insulator blocks 10441.

Figure 69:
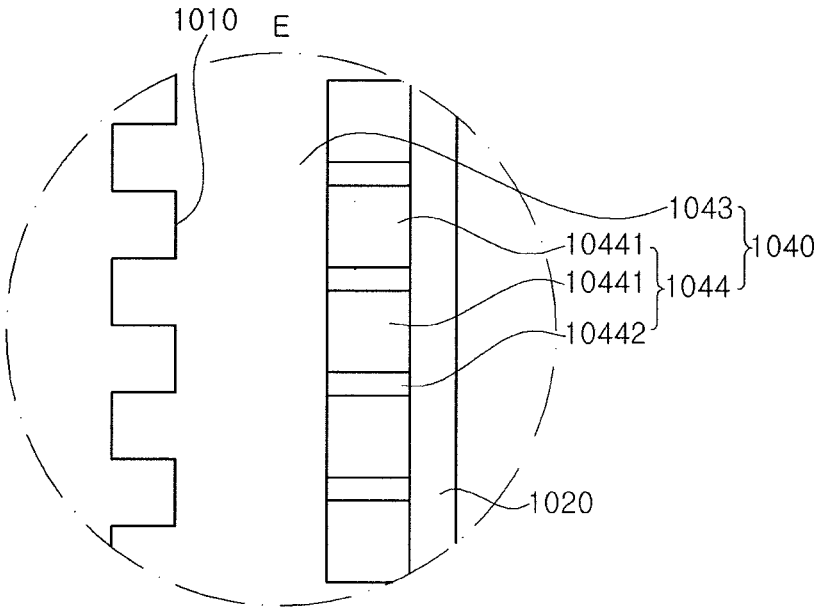
FIG. 69 is an enlarged view of a portion A of FIG. 68.
Figure 70:
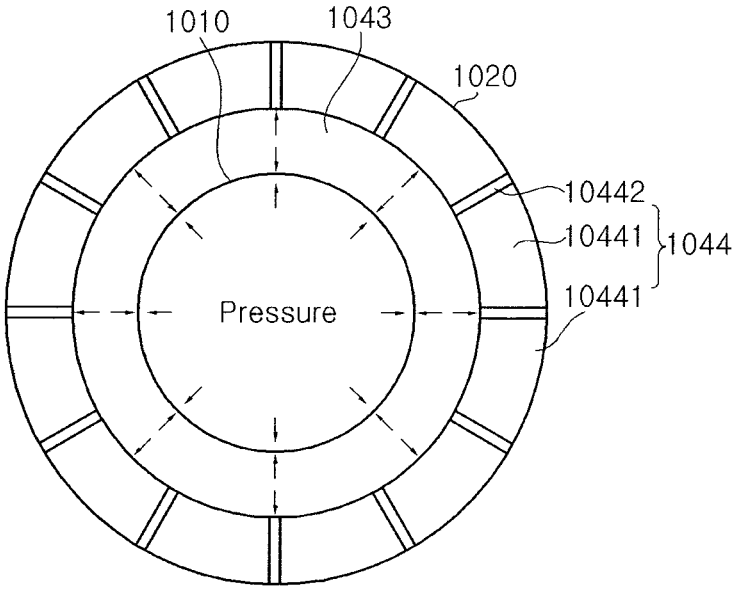
FIG. 70 is a sectional view taken along line B-B of FIG. 68.
Figure 71:
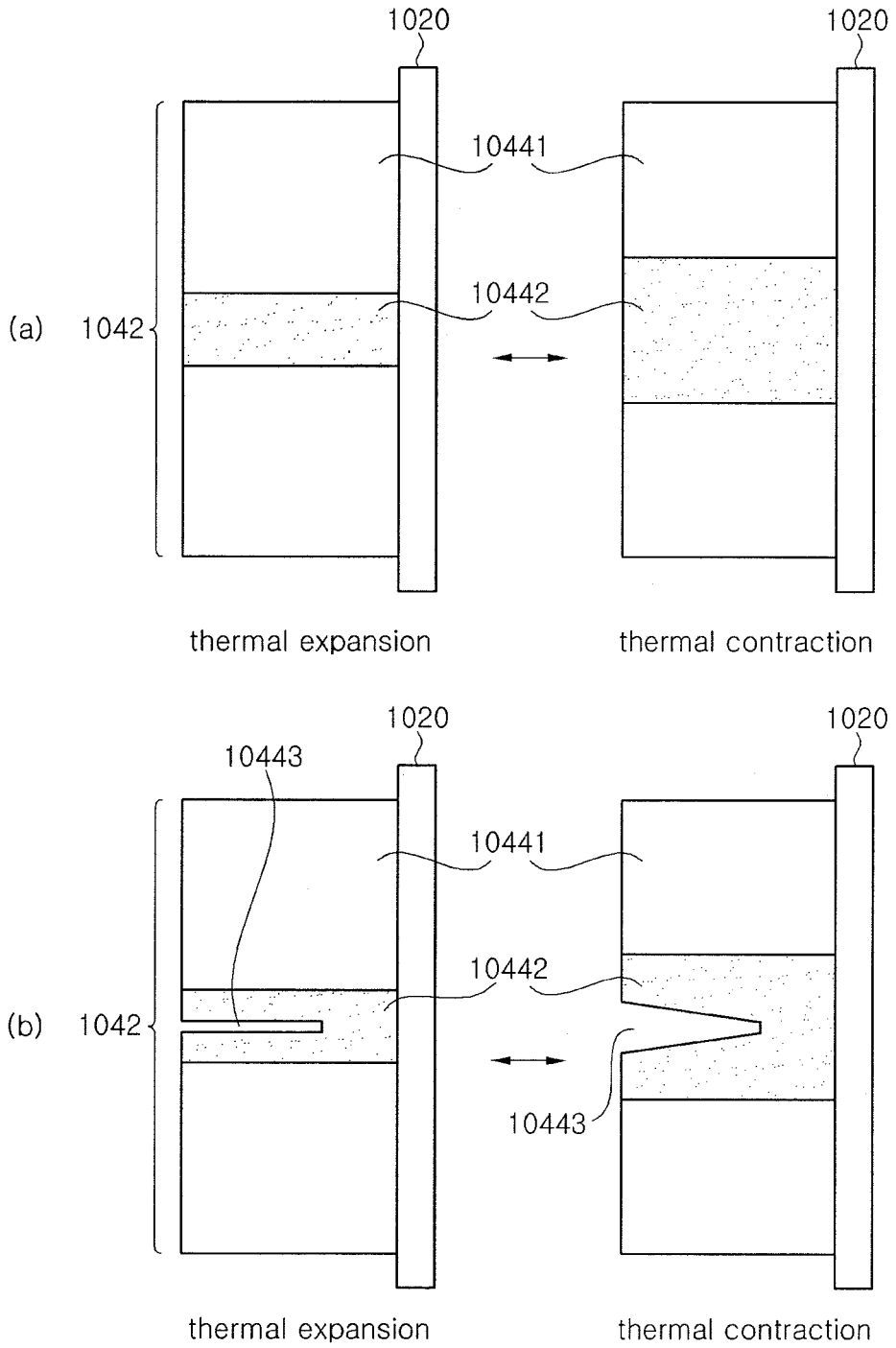
FIG. 71 is a diagram showing the thermal expansion and thermal contraction of a heat insulator block and a reinforced heat insulator according to the present invention.

If the heat insulator blocks 10441 are integrally formed or if the heat insulator blocks 10441 are formed into several large blocks, it is difficult to form the blocks themselves. Also, it is difficult to handle the heat insulator blocks 10441 during construction, resulting in a reduction in workability. Therefore, in order to improve the workability, it is preferable that the heat insulator blocks 10441 are formed into blocks with appropriate sizes and then laminated. As shown in FIGS. 69 and 70, the blocks may be laminated by brickwork.

In order to prevent the heat insulator blocks 10441 from being deformed and damaged by the thermal expansion or thermal contraction of the heat insulator blocks 10441, the reinforced heat insulators 10422 are installed between the respective heat insulator blocks 10441 to absorb the thermal expansion or thermal contraction of the heat insulator blocks 10441.

The reinforced heat insulators 10442 may be filled between the respective heat insulator blocks 10441 by pressurization or injection molding. In the case of the pressurization, it is preferable to use glass wool, and in the case of the injection molding, it is preferable to use polyurethane.

A reinforced heat insulator groove 10443 may be formed in the inner shell (1010) side of the reinforced heat insulators 10442. This is done for allowing the reinforced heat insulators 10442 to more effectively absorb the thermal expansion or thermal contraction of the heat insulator blocks 10441.

The reinforced heat insulator groove 10443 may be formed by filling the reinforced heat insulators 10442 between the respective heat insulator blocks 10441 by various methods and then digging the reinforced heat insulators 10442.

The heat insulator blocks 10441 may be formed by laminating two or more heat insulators to thereby efficiently reduce the heat transfer between the inner shell 1010 and the outer shell 1020.

In this case, it is preferable that the heat insulation layer installed in the contact surface with the outer shell 1020 has higher density than the heat insulation layer installed in the inner shell (1010) side. If the LNG stored in the inner shell 1010 leaks from the inner shell 1010 or overflows and directly contacts the outer shell 1020, it is highly likely that brittle fraction will occur in the outer shell 1020. Therefore, as the leaking or overflowing LNG flows toward the outer shell 1020, the high-density heat insulation layer prevents the leaking or overflowing LNG from directly contacting the outer shell 1020.

Therefore, it is preferable that a high-density heat insulator is installed on the contact surface with the outer shell 1020. A closed cell heat insulator may be used. When the closed cell heat insulator is installed in the outer shell 1020, it may be adhered to the outer shell 1020 by using a glue.

The closed cell heat insulator has a structure in which a pressure difference exists between the inside and outside of the heat insulator and which withstands a high pressure in order to exhibit heat insulation performance.

The high-density heat insulator (for example, high-density polyurethane foam, 1000 to 300 kg/m3) is not greatly deformed even in a pressurized state. Therefore, the high-density heat insulator is hardly affected by the leaking PLNG and can effectively maintain the heat insulation performance.

In the two or more heat insulators laminated in the heat insulator block 10441, various types of heat insulators (for example, open cell heat insulators or closed cell heat insulators) may be used. As described above, the high-density heat insulator, that is, the closed cell heat insulator, is installed on the contact surface with the outer shell 1020. The heat insulator having lower density than the heat insulator used in the contact surface with the outer shell 1020, that is, the open cell heat insulator, may be installed as the heat insulation layer installed in the inner shell 1010.

The open cell heat insulator has a structure that air can freely pass through the inside of the heat insulator when used under a high pressure. Thus the open cell heat insulator is a heat insulator in which no pressure difference exits between the inside and outside of the heat insulator and which does not withstand a pressure. However, in the case of a powder type heat insulator, grains themselves may receive a pressure under a high pressure.

In general, since the closed cell heat insulator is expensive, the closed cell heat insulator is used only in the contact surface with the outer shell 1020. Thus, the manufacturing costs of the heat insulation layer part 1040 can be reduced. In this case, it is preferable to form the closed cell in a range of 20 to 80 mm.

Also, the open cell heat insulator is easy to install, and make it easy to assemble the storage container. Therefore, when the heat insulator block 10441 is made to have an appropriate thickness together with the open cell and the closed cell, it is possible to ensure the heat insulation performance and achieve the easy installation and the reduction of the manufacturing cost.

Examples of the closed cell heat insulator may include a block type glass bubble, a high-density polyurethane form (PUF), and the like. Examples of the open cell heat insulator may include a grain type glass bubble, and the like. The glass bubble has an open cell structure, but may be manufactured as the closed cell heat insulator by binding glass bubble grains in a block type by using inorganic or organic materials.

The inner shell 1010 forms an LNG storage space inside. The inner shell 1010 may be made of a metal that withstands a low temperature of the LNG. For example, the inner shell 1010 may be made of a metal having excellent low temperature characteristic, such as aluminum, stainless steel, and 5-9% nickel steel. Also, as can be seen from the drawings showing the various embodiments of the present invention, the inner shell 1010 may be formed in a tubular type, or may have various shapes, including a polyhedron.

It is preferable that the inner shell 1010 is made to withstand a temperature of −120 to −95° C.

The outer shell 1020 encloses the outside of the inner shell 1010 such that a space is formed between the outer shell 1020 and the inner shell 1010. The outer shell 1020 may be made of a steel material that withstands the pressure of the LNG stored in the inner shell 1010. Due to an equalizing line 1090 to be described below, the outer shell 1020 shares the internal pressure of the inner shell 1010. Therefore, an amount of a material used for the inner shell 1010 may be reduced, leading to a reduction in the production costs of the LNG storage container 1000.

It is preferable that the outer shell 1020 is made to withstand a pressure of 13 to 25 bar.

Due to the equalizing line 1090 to be described below, the internal pressure of the inner shell 1010 becomes equal to the pressure of the space defined by the inner shell 1010 and the outer shell 1020 (that is, the space where the heat insulation layer part 1040 is formed). Therefore, the outer shell 1020 can withstand the pressure of the LNG. The pressure equal to the internal pressure of the inner shell 1010 refers to not a strictly equal pressure but a similar pressure.

Therefore, only if the inner shell 1010 is made to withstand a temperature of −120 to −95° C., the LNG storage container 1000 can safely store the LNG, regardless of whether or not the inner shell 1010 can withstand the pressure of the LNG stored therein.

That is, even when the LNG produced to have the constant pressure and temperature (for example, 17 bar and −115° C.) is stored in the inner shell 1010 of the storage container 1000, the LNG having the constant pressure and temperature can be safely stored in such a state that the outer shell 1020 and the heat insulation layer part 1040 are assembled.

Meanwhile, the inner shell 1010 may be made to have a thickness t1 thinner than a thickness t2 of the outer shell 1020. Therefore, when manufacturing the inner shell 1010, the use of expensive metal having excellent low temperature characteristic may be reduced.

Since the support 1030 is installed in the space between the inner shell 1010 and the outer shell 1020 such that the inner shell 1010 can be supported to the outer shell 1020, the inner shell 1010 and the outer shell 1020 are structurally reinforced. The support 1030 can be made a metal (for example, a low-temperature steel) for withstanding the low temperature of the LNG. A single support may be installed along the lateral circumferences of the inner shell 1010 and the outer shell 1020, or a plurality of supports may be installed to be spaced apart from the lateral portions of the inner shell 1010 and the outer shell 1020 in a vertical direction.

When the support 1030 is fixed and supported to the inner shell 1010 and the outer shell 1020 by welding, a heat insulator such as a glass fiber may be disposed in the inside of the end portion of the support 1030 coming into contact with the outer shell 1020. Alternatively, a separate heat insulator may be disposed in the inside of the end portion of the support and fixed by welding. Therefore, the support 1030 can prevent the temperature of the inner shell 1010 from being transferred to the outer shell 1020.

Also, a lower support 1033 for supporting the inner shell 1010 to the outer shell 1020 may be additionally installed in a lower space between the inner shell 1010 and the outer shell 1020. As with the storage container of FIG. 75 according to the embodiment of the present invention, when the storage container 1000 is installed in a transverse direction, the lower support 1033 can be omitted.

Figure 68:
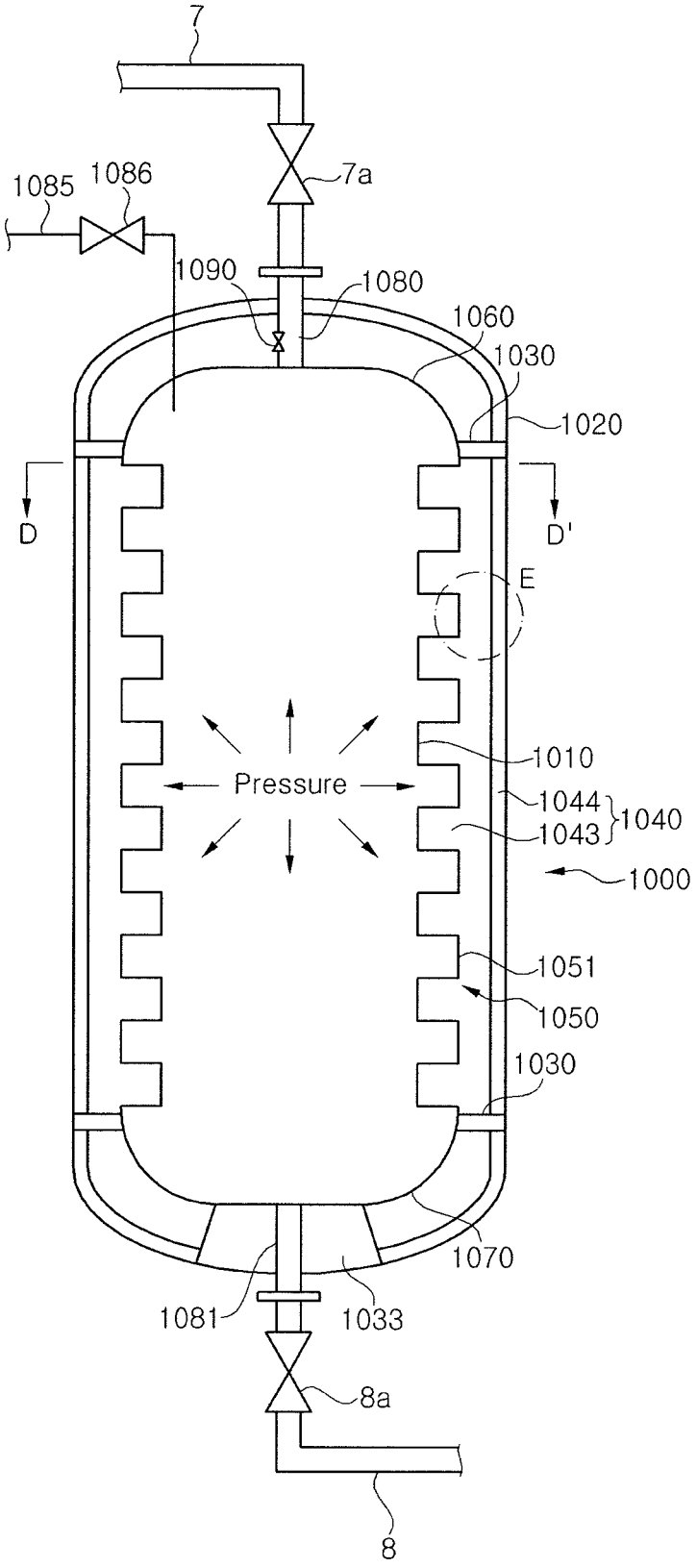
FIG. 68 is a longitudinal sectional view schematically showing the structure of the LNG storage container according to the embodiment of the present invention.

FIG. 68 is a longitudinal sectional view schematically showing the structure of the LNG storage container according to the embodiment of the present invention, and FIG. 69 is an enlarged view of a portion E of FIG. 69.

A heat insulation layer part 1044 of FIGS. 68 and 69 according to an embodiment of the present invention may include a passage 1043 and a heat insulation layer 1044.

Since the passage 1043, through which the fluid can flow, is located in the inner shell (1010) side of the heat insulation layer part 1040 (that is, a space between the heat insulation layer 1044 and the inner shell 1010), the internal pressure of the inner shell 1010 and the external pressure of the inner shell 1010 can easily achieve the pressure balance through an equalizing line 1090.

As described above, the heat insulator block 10441 having two or more laminated heat insulators is installed in the heat insulation layer 1044. Therefore, the inner shell (1010) side of the heat insulator block 10441 may be made of the open cell, and the outer shell (1020) side may be made of the closed cell.

When the storage container 1000 is manufactured in a small size as necessary, the passage 1043 is inevitably formed in a small size. Therefore, the open cell heat insulator, in which body-density charging is not caused by voids, is used in the inner shell (1010) side of the heat insulator block 10441, such that the passage 1043 can share the internal pressure of the inner shell 1010 more greatly by the equalizing line 1090 to be described below.

As the heat insulation layer part 1040 shares a larger portion of the internal pressure of the inner shell 1010, the use of the low-temperature steel can be reduced when the inner shell 1010 is manufactured. Therefore, the manufacturing cost of the inner shell 1010 can be reduced.

The space between the inner shell 1010 and the outer shell 1020, where the heat insulation layer part 1040 is provided, and the space inside the inner shell 1010 are connected together by the equalizing line 1090 in order for pressure balance.

Due to the equalizing line 1090, the pressure in the inside of the inner shell 1010 is balanced with the pressure in the outside of the inner shell 1010 (the inside of the outer shell 1020). Since the outer shell 1020 supports a considerable portion of the pressure, the thickness of the inner shell 1010 can be reduced.

The equalizing line 1090 may be formed in a side contacting the inner space of the outer shell 1020 in a first connecting part 1080 provided in the loading line 7 of the inner shell 1010.

Figure 72:
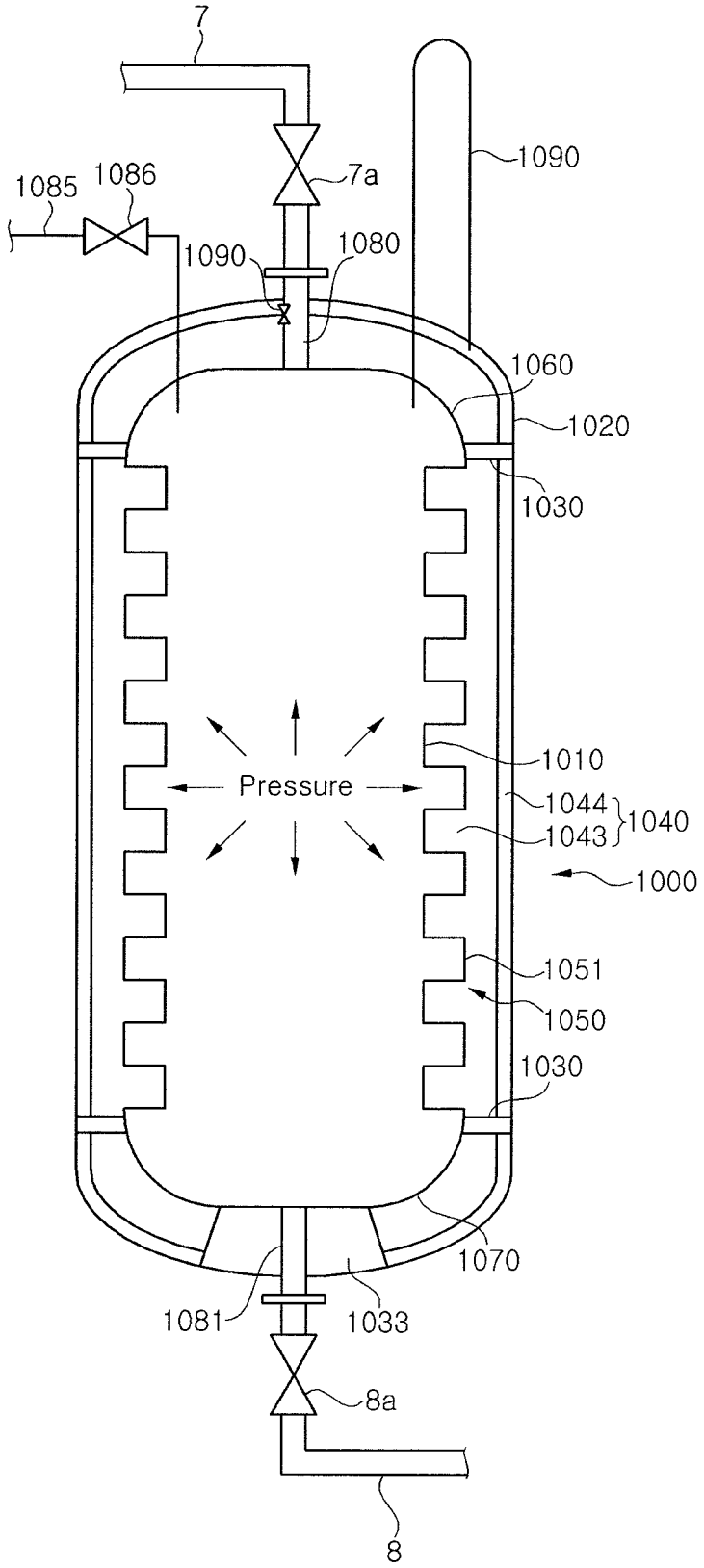
FIG. 72 is a longitudinal sectional view schematically showing the structure of the LNG storage container according to the embodiment of the present invention.
Figure 73:
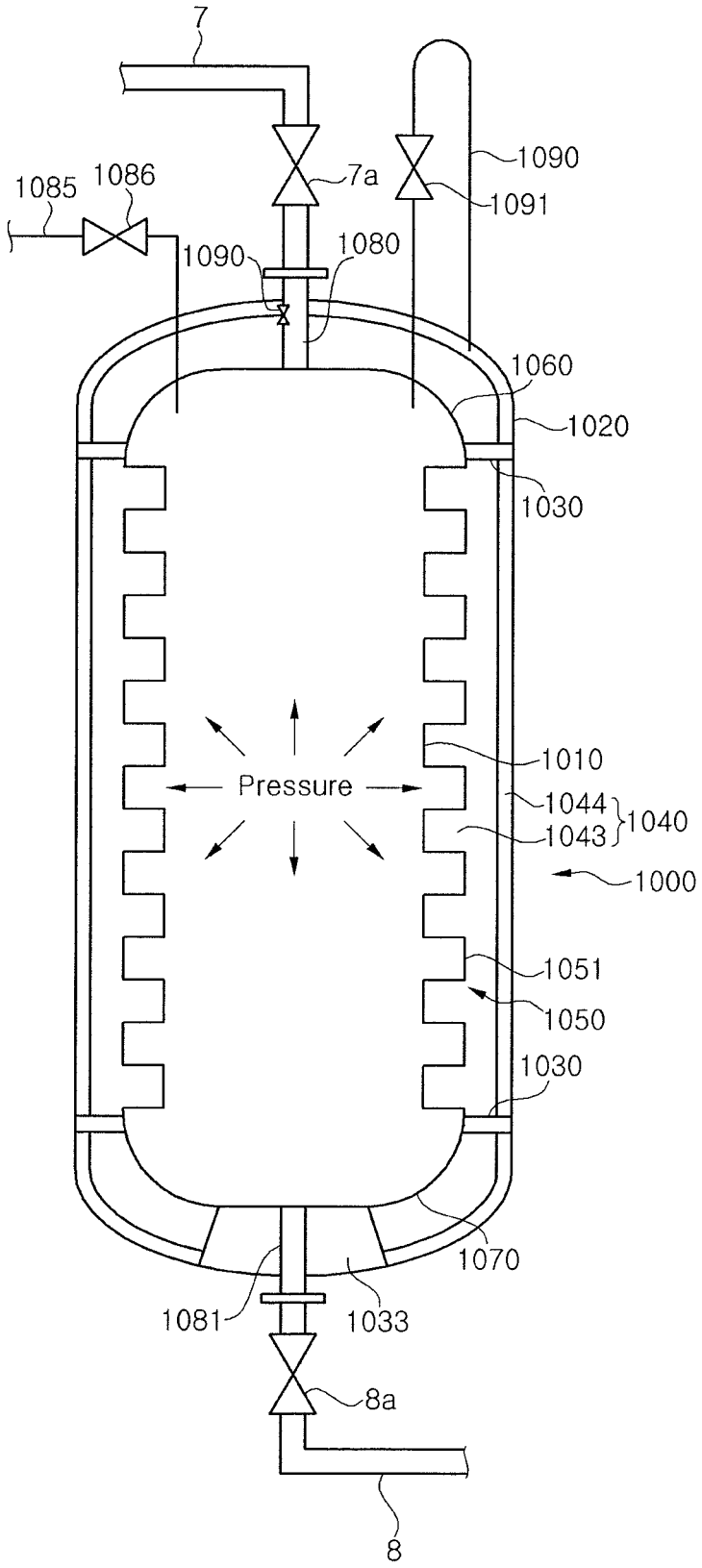
FIG. 73 is a longitudinal sectional view schematically showing the structure of the LNG storage container according to the embodiment of the present invention.
Figure 74:
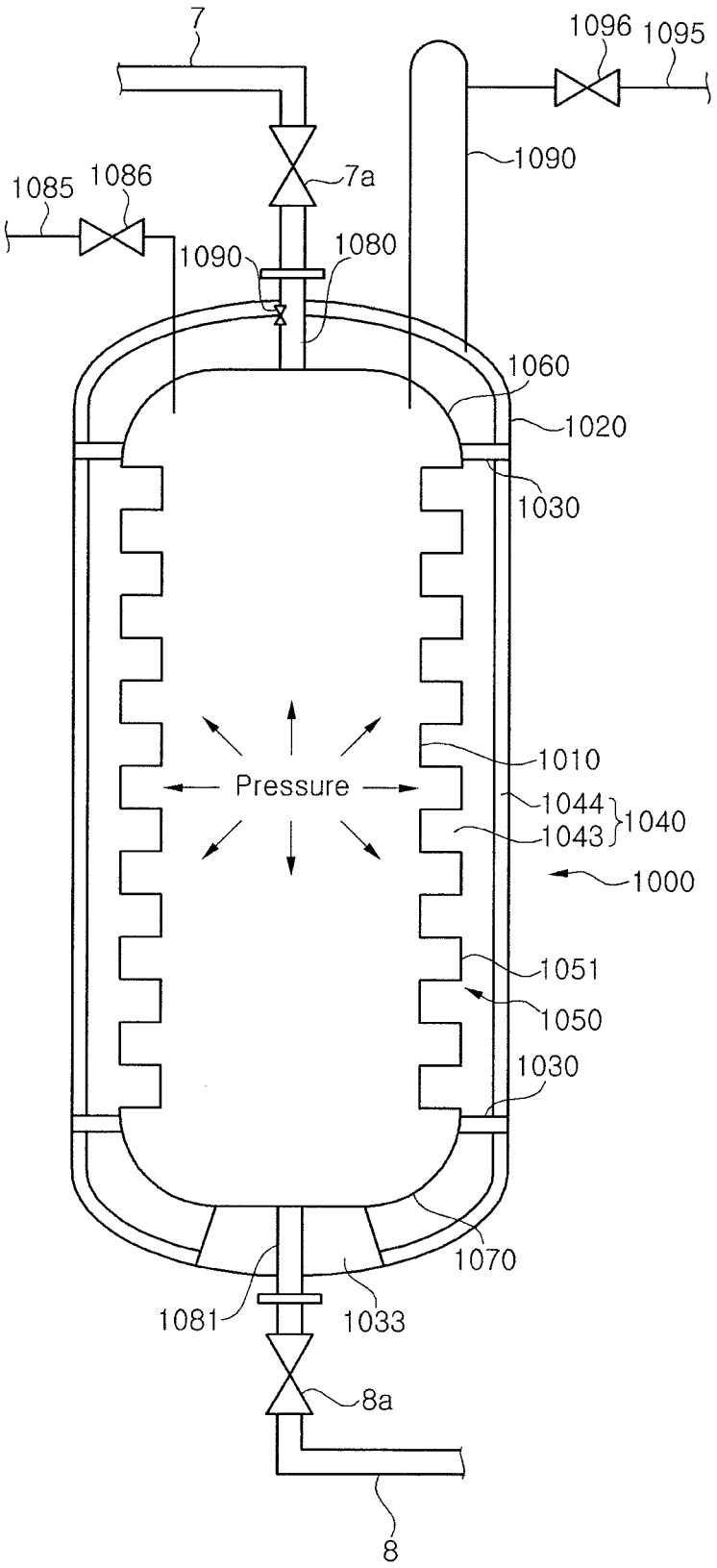
FIG. 74 is a longitudinal sectional view schematically showing the structure of the LNG storage container according to the embodiment of the present invention.
Figure 75:
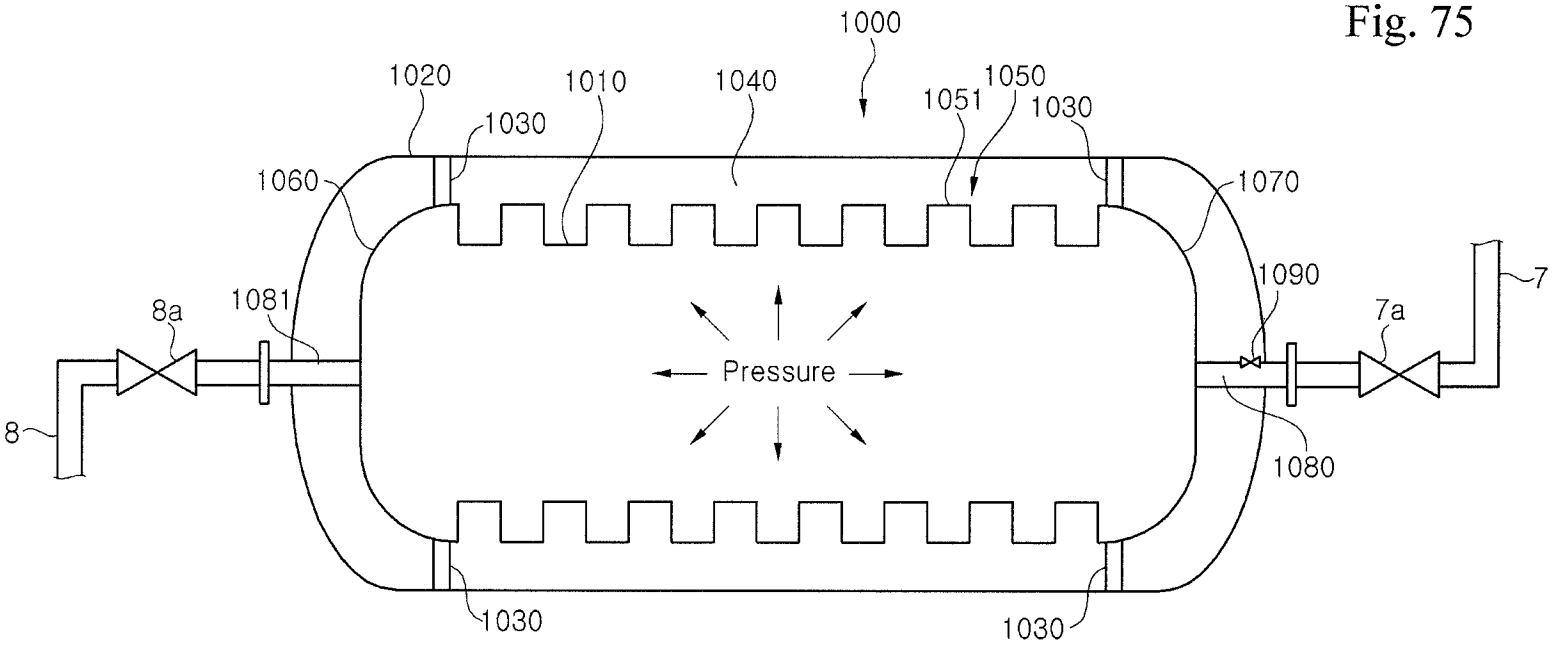
FIG. 75 is a longitudinal sectional view schematically showing the structure of the LNG storage container according to the embodiment of the present invention.

The equalizing line 1090 may be provided with a valve as shown in FIG. 68, or may be provided with a pipe as shown in FIGS. 72 to 74, which is to be described below. Therefore, as the internal pressure of the inner shell 1010 moves to the heat insulation layer part 1040 through the equalizing line 1090, the pressure balance is achieved between the inside and the outside of the inner shell 1010.

That is, the inner shell 1010 is made of a metal having excellent low temperature characteristic, and the outer shell 1020 is made of a steel material having excellent strength. The passage 1043 is formed along the wall surface of the inner shell 1010. The heat insulator block 10441 is provided with two or more heat insulators having an appropriate thickness. Therefore, PLNG as well as LNG can be stored. Due to the pressure balance between the inside and the outside of the inner shell 1010, the thickness t1 of the inner shell 1010 is reduced, leading to a reduction in the use of an expensive metal having excellent low temperature characteristic.

Thus, the structural defect caused by the internal pressure of the inner shell 1010 can be prevented and the storage container 1000 can have superior durability.

Meanwhile, first and second connecting parts 1080 and 1081 are installed in upper and lower portions of the inner space of the inner shell 1010, respectively, and pass through the outer shell 1020 to protrude to the outside of the outer shell 1020. The LNG can be loaded into the inner shell 1010 through the loading line 7 connected to the first connecting part 1080, and can be unloaded from the inner shell 1010 through the unloading line 8 connected to the second connecting part 1081.

Meanwhile, valves 7*a* and 8*a* may be installed in the loading line 7 and the unloading line 8, respectively.

The LNG storage container 1000 of FIGS. 72 and 73 according to the embodiment of the present invention includes a first exhaust line 1085, a first exhaust valve 1086, and an equalizing line 1090. The equalizing line 1090 protrudes from the inner space of the inner shell 1010 to the outside of the storage container 1000, and connects to the space between the inner shell 1010 and the outer shell 1020.

The first exhaust line 1085 is connected to the upper inner space of the inner shell 1010 and extends outward, and the first exhaust valve 1086 is installed in the first exhaust line 1085 so as to open and close a gas flow. When the first exhaust valve 1086 is opened, the first exhaust line 1085 can exhaust gas from the inner space of the inner shell 1010 to the outside.

As opposed to the embodiment illustrated in FIG. 68, the equalizing line 1090 is provided with a pipe so that the equalizing line 1090 is elongated. Therefore, even when the LNG stored in the inside of the inner shell 1010 overflows, it is possible to prevent the LNG from leaking to the space between the inner shell 1010 and the outer shell 1020 through the equalizing line 1090.

In the equalizing line 1090, an on/off valve 1091 is installed to open and close the flow of the fluid, for example, natural gas or boil-off gas. Therefore, when the position or posture of storage container 1000 is changed, the on/off valve 1091 can block the movement of the fluid which may occur through the equalizing line 1090.

The LNG storage container 1000 according to the embodiment of the present invention, shown in FIG. 74, includes a second exhaust line 1095, a second exhaust valve 1096, and an equalizing line 1090. The equalizing line 1090 is connected to the second exhaust line 1095 in which the second exhaust valve 1096 is installed.

The second exhaust valve 1096 can exhaust gas from the inner shell 1010 to the outside through the equalizing line 1090 and the second exhaust line 1095. Thus, as shown in FIGS. 72 and 73, it is possible to avoid a complicated process of connecting the separate exhaust line 1085 to the inner shell 1010. Also, since the devices installed to pass through the storage container 1000 are reduced, the structural stability of the storage container 1000 can be maintained.

The inner shells 1010 of the storage containers 1000 according to various embodiments of the present invention can be made in a corrugated structure as shown in FIGS. 49 to 52, and detailed descriptions thereof are substantially identical to those of FIGS. 49 to 52.

That is, as shown in FIG. 68, the inner shell 1010 may be formed in a cylindrical (or tubular) type having a top cover 1060 in an upper portion, a bottom cover 1070 in a lower portion, and a corrugated structure 1050 in a lateral surface. Also, the inner shell 1010 may have various shapes, including a polyhedron.

The corrugated structure 1050 formed in the inner shell 1010 may have various curved portions 1052 along the corrugated cross-sectional shape, and may have one or more corrugations 1052 with the various curved portions 1051.

According to the present invention, LNG or PLNG can be efficiently stored and supplied to a consumption place. Manufacturing costs can be reduced by minimizing the use of a metal having excellent low temperature characteristic. Also, various purposes and consumer's demands can be easily satisfied, and diversity in types and sizes of container carriers can be ensured.

Also, the structural stability can be ensured by designing the storage container such that the internal pressure of the inner shell and the internal pressure of the heat insulation layer part have a similar value. By using a steel that withstands the internal pressure of the outer shell, the use of an expensive metal having excellent low temperature characteristic, leading to a reduction in the manufacturing cost of the storage container.

Also, due to the inner shell having the corrugated structure, the structural strength of the inner shell is increased, and the buckling strength is also remarkably increased. Therefore, the container can be manufactured with a thin plate, leading to a reduction in the manufacturing cost thereof.

Also, since the inner shell having the corrugated structure can absorb the thermal deformation of the inner shell, it is possible to prevent the occurrence of excessive thermal stress and ensure the structural stability.

Also, by using the simple configuration, it is possible to prevent the concentration of the thermal stress caused by the thermal deformation occurring in the support structure supporting the inner shell and the outer shell. Therefore, the durability of the container can be increased, and the manufacturing cost of the support structure can be reduced.

Also, the external support minimizes a heat transfer by using a reinforced plastic having a low heat transfer coefficient, and a separate connection plate is installed to connect the external support to the external shell. Therefore, the external support can be easily connected to the outer shell by welding.

Also, even in a pressurized state, it is possible to prevent a cooling damage of the outer shell due to the damage of the heat insulator. Even when the LNG leaks out to the heat insulation layer, the heat insulation performance can be ensured by the closed shell.

Also, by appropriately using the open cell and the closed cell, the use of the expensive closed cell can be minimized, and the pressure balance can be achieved between the inside and outside of the inner shell. The storage container can be conveniently assembled, and the manufacturing cost of the heat insulation layer can be reduced.

Also, the construction convenience can be increased by manufacturing the heat insulation layer part into heat insulator blocks having an appropriate size. Also, by installing the reinforced heat insulator capable of absorbing the contraction and expansion of the heat insulators between the heat insulator blocks, cracks in the inside of the heat insulator and the contact surface can be avoided even in the thermal contraction and expansion of the heat insulator. The structural stability can be increased, and the heat insulation performance can be constantly maintained.

While the embodiments of the present invention has been described with reference to the specific embodiments, it will be apparent to those skilled in the art that various changes and modifications may be made without departing from the spirit and scope of the invention as defined in the following claims.

What is claimed is:

1. A liquefied natural gas (LNG) storage container comprising:

an inner shell configured to store LNG inside;

an outer shell configured to enclose the inner shell such that a space is formed between the inner shell and the outer shell;

a first inner support fixed to an outer surface of the inner shell at a first location;

a second inner support fixed to the outer surface of the inner shell at a second location that is distanced from the first location along an axis;

a first outer support fixed to an inner surface of the outer shell and aligned with the first inner support;

a second outer support fixed to the inner surface of the outer shell and aligned with the second inner support; and a corrugation provided in the inner shell between the first location and the second location along the axis, wherein the first inner support is connected to the first outer support and the second inner support is connected to the second outer support such that movement of the first inner support relative to the second inner support along the axis is substantially limited while permitting movement of the first inner support relative to the first outer support along a first direction perpendicular to the axis and also permitting movement of the second inner support relative to the second outer support along a second direction perpendicular to the axis, and wherein with substantial limitation of relative movement between the first and second inner supports, the corrugation is configured to absorb thermal expansion and contraction of the inner shell along the axis.

2. The LNG storage container according to claim 1, wherein the corrugation includes one or more curved portions.

3. The LNG storage container according to claim 1, wherein the corrugation includes one or more of angled portions.

4. The LNG storage container according to claim 1, wherein a sliding bar is formed in one of the first inner support and the first outer support, and a sliding hole is formed in the other of the first inner support and the first outer support such that the sliding bar is slidably movable within the sliding hole in the first and second directions.

5. The LNG storage container according to claim 4, wherein the sliding bar is formed to protrude from the one of the first inner support and the first outer support.

6. The LNG storage container according to claim 5, wherein the sliding bar has a sliding head at its distal end, the sliding head positioned outside of the sliding hole and configured to retain the sliding bar within the sliding hole and limit movement of the first inner support relative to the second inner support along the axis.

7. The LNG storage container according to claim 1, wherein the first and second inner supports and the first and second outer supports include an upper flange and a lower flange, and webs connecting the upper flange and the lower flange.

8. The LNG storage container according to claim 7, wherein a sliding hole is formed in the upper flange of the first and second outer supports, and a sliding bar is formed in the lower flange of the first and second inner supports that are disposed on top of the first and second outer support.

9. The LNG storage container according to claim 8, wherein the first and second inner supports are made of a metal that withstands a low temperature, the first and second outer supports are made of a reinforced plastic, the first and second outer supports are connected to a connection plate, which is made of a metal withstanding a low temperature, and the connection plate is welded to the outer shell so that the first and second supports are connected to the outer shell.

10. The LNG storage container according to claim 9, further comprising:

a plurality of additional inner supports fixed to the outer surface of the inner shell and spaced a distance along the axis from the first inner support or the second inner support; and a plurality of additional outer supports fixed to the inner surface of the outer shell and connected to the plurality of additional inner supports.

11. The LNG storage container according to claim 1, further comprising:

an equalizing line connecting an inner space of the inner shell and the space between the inner shell and the outer shell.

12. The LNG storage container according to claim 11, wherein the equalizing line extends from the inner space of the inner shell to an outside of the storage container and is connected to the space between the inner shell and the outer shell.

13. The LNG storage container according to claim 12, wherein one end of the equalizing line communicates with the inside of the inner shell, the other end of the equalizing line communicates with the space between the inner shell and the outer shell, and the other end of the equalizing line is located at a ½ position of a width (h) of the space.

14. The LNG storage container according to claim 13, wherein an equalizing line flange is formed in the outer shell side contacting the equalizing line protruding to the outside of the storage container, such that the equalizing line flange is connected to the equalizing line, and the equalizing line flange and the equalizing line are made of a metal that withstands a low temperature of the LNG.

15. The LNG storage container according to claim 1, wherein a first heat insulation layer made of an open cell heat insulator is formed in the inner shell side of the heat insulation layer part, and a second heat insulation layer made of a closed cell heat insulator is formed in the outer shell side.

16. The LNG storage container according to claim 1, wherein a passage allowing a liquid to flow along a wall surface of the inner shell is formed in the inner shell side of the heat insulation layer part, and a heat insulation layer is formed in the outer shell side.

17. The LNG storage container according to claim 16, wherein the heat insulation layer is provided with two or more heat insulator blocks installed at regular intervals in a direction parallel to the longitudinal axis, and reinforced heat insulators are installed respectively between the heat insulator blocks.

18. The LNG storage container according to claim 1, wherein the inner shell is made of a metal that withstands a low temperature of the LNG, and the outer shell is made of steel material that withstands internal pressure.

19. The LNG storage container according to claim 18, wherein the inner shell withstands a temperature of of −120 to −95° C., and the outer shell withstands a pressure of 13 to 25 bar.

20. The LNG storage container according, to claim 19, wherein the inner shell withstands a pressure of 0.5 bar.

21. The LNG storage container according to claim 1, further comprising:

a heat insulation layer including two or more laminated heat insulation layers in the space between the inner shell and the outer shell so as to reduce a heat transfer between the inner shell and the outer shell, wherein the two or more insulation layers comprise an inner insulation layer and an outer insulation layer interposed between the inner insulation layer and the outer shell, the outer insulation layer is higher in density than the inner insulation layer.

22. The LNG storage container according to claim 1, further comprising:

a heat insulation layer part including heat insulation layers in the space between the inner shell and the outer shell so as to reduce a heat transfer between the inner shell and the outer shell, wherein the heat insulation layer includes a passage configured to allow a liquid to flow therethrough, and a heat insulation layer comprises heat insulator.

23. The LNG storage container according to claim 22, wherein the heat insulation layer is provided with two or more heat insulator blocks installed at regular intervals in a direction parallel to the longitudinal axis, and reinforced heat insulators are installed respectively between the heat insulator blocks.

24. The LNG storage container according to claim 23, wherein the reinforced heat insulators are filled respectively between the heat insulator blocks by injection molding.

25. The LNG storage container according to claim 24, wherein a reinforced heat insulator groove is formed in the inner shell side of the reinforced heat insulator.

26. The LNG storage container according to claim 1, wherein the inner shell is in a cylindrical shape, and the axis is a longitudinal axis of the cylindrical shape.

27. The LNG storage container according to claim 1, wherein the inner shell is in a cylindrical shape, and the axis is a longitudinal axis of the cylindrical shape, wherein the cylindrical inner shell is arranged such that the axis is generally perpendicular to the ground, wherein a portion of the first inner support overlays a portion of the first outer support such that weight applied to the first inner support is at least in part applied to the first outer support.

28. The LNG storage container according to claim 27, wherein a portion of the second inner support overlays a portion of the second outer support such that weight applied to the second inner support is at least in part applied to the second outer support.

29. The LNG storage container according to claim 27, wherein a portion of the second inner support is in abutting contact with a portion of the second outer support such that movement of the second inner support relative to the second inner support along the axis is substantially limited by the abutting contact with the portion of the second outer support.

30. The LNG storage container according to claim 1, further comprising a heat insulation layer installed in the space between the inner shell and the outer shell.

* * * * *